US011316243B2

(12) United States Patent
Huang et al.

(10) Patent No.: US 11,316,243 B2
(45) Date of Patent: Apr. 26, 2022

(54) ANTENNA APPARATUS AND ELECTRONIC DEVICE

(71) Applicant: Etheta Communication Technology (Shenzhen) Co., Ltd., Shenzhen (CN)

(72) Inventors: Huan-Chu Huang, Taoyuan (CN); Dasong Gao, Shenzhen (CN); Zhixing Qi, Shenzhen (CN); Hong Lin, Shenzhen (CN); Yanchao Zhou, Shenzhen (CN)

( * ) Notice: Subject to any disclaimer, the term of this patent is extended or adjusted under 35 U.S.C. 154(b) by 0 days.

(21) Appl. No.: 17/537,444

(22) Filed: Nov. 29, 2021

(65) Prior Publication Data

US 2022/0085480 A1 Mar. 17, 2022

(30) Foreign Application Priority Data

Nov. 16, 2021 (CN) ..... 202111354677.1

(51) Int. Cl.
*H01Q 1/12* (2006.01)
*H01Q 1/52* (2006.01)

(52) U.S. Cl.
CPC ..... *H01Q 1/12* (2013.01); *H01Q 1/52* (2013.01); *H01Q 1/526* (2013.01)

(58) Field of Classification Search
CPC ..... H01Q 1/12; H01Q 1/526; H01Q 1/52
USPC ..... 343/841
See application file for complete search history.

(56) References Cited

U.S. PATENT DOCUMENTS

| | | | | |
|---|---|---|---|---|
| 2010/0099367 | A1* | 4/2010 | Shamim | G01T 1/026 455/95 |
| 2019/0058246 | A1 | 2/2019 | Lee et al. | |
| 2019/0123441 | A1* | 4/2019 | Sudo | H01Q 5/50 |
| 2019/0385787 | A1 | 12/2019 | Ichikawa | |
| 2020/0052367 | A1* | 2/2020 | Zhu | H01Q 5/30 |
| 2020/0203831 | A1 | 6/2020 | Ichikawa | |
| 2021/0036434 | A1* | 2/2021 | Yeom | H01Q 3/38 |

* cited by examiner

*Primary Examiner* — Hai V Tran

(57) ABSTRACT

The present disclosure discloses an antenna apparatus and an electronic device. The antenna apparatus includes a circuit board, an antenna stand arranged on the circuit board, and an antenna structure arranged on the antenna stand. The antenna structure includes a flexible printed circuit board, a millimeter wave (mm-wave) antenna arranged on the flexible printed circuit board, and a non-mm-wave antenna arranged on the flexible printed circuit board.

18 Claims, 51 Drawing Sheets

ANTENNA APPARATUS AND ELECTRONIC DEVICE

TECHNICAL FIELD

The present disclosure relates to the technical field of antennas, in particular to an antenna apparatus and an electronic device having the above-mentioned antenna apparatus.

BACKGROUND ART

With the advent of the 5G era, communication requirements of higher-order multiple-input and multiple-output (MIMO), coverage requirements of more new frequency bands, and even addition of millimeter wave (mm-wave) bands have led to a need of an electronic device such as a mobile phone for having more antennas (i.e., including mm-wave and non-mm-wave antennas). If the whole space cannot be significantly enlarged, higher antenna design difficulty will be caused, and even the production competitiveness is reduced because of increase in the overall size due to less compact antenna placement or design.

As we all know, spaces on internal circuit boards of mobile phones and other electronic devices are quite tight and compact, and this situation is becoming more and more serious. Therefore, how to accommodate multiple kinds of antennas with qualified performance under a limited system space and acceptable cost and make a board space better utilized is a hot topic in the design of antenna apparatuses for mobile phones and other electronic devices.

SUMMARY

In view of this, it is necessary to provide an antenna apparatus and an electronic device to improve the above-mentioned problems.

In order to achieve the above objective, in a first aspect, one embodiment of the present disclosure discloses an antenna apparatus, including:

a circuit board;

an antenna stand arranged on the circuit board;

an antenna structure arranged on the antenna stand, the antenna structure including a flexible printed circuit board, a millimeter wave (mm-wave) antenna arranged on the flexible printed circuit board, and a non-mm-wave antenna arranged on the flexible printed circuit board.

Compared to the existing art, the antenna structure formed by the mm-wave antenna and the non-mm-wave antenna is arranged on the flexible printed circuit board, and the antenna structure is arranged on the antenna stand on the circuit board, so that integration of the mm-wave antenna and the non-mm-wave antenna is realized, and the antenna stand effectively bears the antenna structure; furthermore, the antenna performance is improved by use of the height of the stand; the design flexibility of the antenna structure and the antenna apparatus is increased; the challenge for disposing a number of antennas in the electronic device is solved; and the space utilization rate is increased in a limited space, thereby improving the product competitiveness.

In one embodiment, the antenna structure further includes a mm-wave radio-frequency integrated circuit (RFIC); the mm-wave RFIC is arranged on the flexible printed circuit board and is located between the flexible printed circuit board and the antenna stand; the mm-wave RFIC is electrically connected to the mm-wave antenna; the antenna structure further includes a mm-wave antenna connector; the mm-wave antenna connector is arranged on the flexible printed circuit board and is electrically connected to the mm-wave RFIC; the mm-wave antenna connector and the mm-wave RFIC are spaced apart from each other; the antenna stand has a first gap part; and at least part of the mm-wave antenna connector is located in the first gap part and is used to be connected to another connector. It can be understood that the mm-wave RFIC is arranged on the flexible printed circuit board, which can increase the space utilization rate. Furthermore, a path between the mm-wave RFIC and the mm-wave antenna is relatively short, so the power loss on the path may be relatively low, which can improve the radiation performance of the mm-wave antenna. In addition, it may also be convenient for the mm-wave antenna connector to electrically connect the mm-wave antenna and the mm-wave RFIC to the circuit board and the like, thus achieving the technical effects of convenient assembling, reliable signal transmission, improved placement degree-of-freedom of the mm-wave antenna, and the like. The design of the first gap part is also conductive to connection of the mm-wave antenna connector to another connector, thus achieving the technical effects of convenient assembling and reliable signal transmission, and the like.

In one embodiment, the antenna apparatus further includes a first conductive member; the antenna stand has an opening; the antenna structure covers the opening; one end of the first conductive member is arranged on the circuit board, and the other end of the first conductive member passes through the opening and is connected to the mm-wave RFIC; the mm-wave RFIC includes the mm-wave RFIC main body electrically connected to the mm-wave antenna and a shielding case arranged at a periphery of the mm-wave RFIC main body; the shielding case is electrically connected to the non-mm-wave antenna; the shielding case is further grounded via the first conductive member; and the first conductive member includes a first metal block. By means of the shielding case, the mm-wave RFIC can be protected from signal crosstalk, so the reliability is improved, and a relatively good radiative wireless communication effect is achieved. The first conductive member may further play an isolation role, and can also discharge heat to the outside while it is grounded, so as to reduce the temperature of the antenna apparatus (the mm-wave RFIC main body) and maintain the stability of a wireless communication function, thus improving the product performance and the grip comfort of a user.

In one embodiment, the antenna apparatus further includes a housing which is arranged at a periphery of the circuit board; and at least part of the housing is electrically connected to the non-mm-wave antenna. At least part of the housing is electrically connected to the non-mm-wave antenna, so that the housing can be at least partially used as an antenna at the same time, which not only helps to increase the length and/or enlarge the area of the antenna structure (particularly the length and/or area of a low-frequency antenna), but also is conductive to reducing the overall size of the antenna structure. Furthermore, the housing is generally located on the outermost side of the electronic device, which is also conductive to avoiding an antenna signal from being shielded, thus improving the antenna performance and the wireless communication experience of the user; and in addition, the design degree-of-freedom of the position and size of a break joint on the housing may be larger (i.e., the product appearance design may be better), which thus contributes to improving the overall competitiveness of a product.

In one embodiment, the housing includes a side wall structure annularly arranged at the periphery of the circuit board; the side wall structure includes a side wall part and an antenna part connected to the side wall part; the antenna part is electrically connected to the non-mm-wave antenna; and the side wall part and the antenna part are connected in sequence along an annular arrangement direction. The side wall structure is annularly arranged at the periphery of the circuit board and can protect the circuit board; furthermore, by means of electrically connecting the antenna part of the side wall structure to the non-mm-wave antenna and connecting the side wall part and the antenna part in sequence along the annular arrangement direction, the length and/or area of the non-mm-wave antenna can be effectively increased and/or enlarged, and it is favorable for reducing the overall size of the antenna structure; and in addition, the design degree-of-freedom of the position and size of the break joint on the housing may be larger (i.e., the product appearance design may be better), which thus contributes to improving the overall competitiveness of a product.

In one embodiment, both the side wall part and the antenna part are metal conductive materials; break joints are respectively formed between two ends of the antenna part and the side wall part; insulating packing media are arranged in the break joints; the antenna part is grounded and/or the antenna part is also electrically connected to a non-mm-wave antenna feed source assembly; and the non-mm-wave antenna feed source assembly is arranged on the circuit board. Both the side wall part and the antenna part are the metal conductive materials. The materials are simple and easy to realize, and they can be integrated, so as to ensure the production efficiency. Further, by the arrangement of the break joints and the insulating packing media, the antenna performance is favorably improved, and the wireless communication experience is enhanced. The antenna part is arranged at the periphery of the circuit board and can also be grounded and/or the antenna part is also electrically connected to the non-mm-wave antenna feed source assembly, which ensures the realization of antenna functions, facilitates assembling, has an effect of protecting a system of the electronic device, and can be used as one part of the appearance design.

In one embodiment, the non-mm-wave antenna directly contacts the antenna part, so as to be electrically connected to the antenna part. The non-mm-wave antenna directly contacts the antenna part, so as to realize their electrical connection, and this also has the technical effects of easy design, simple structure, convenient assembling, and the like.

In one embodiment, a gap is reserved between the antenna stand and the antenna part; the non-mm-wave antenna is electrically connected to the antenna part through a transmission line on the circuit board; and the transmission line is also electrically connected to the non-mm-wave antenna feed source assembly. By means of the transmission line on the circuit board, the non-mm-wave antenna is electrically connected to the antenna part and the non-mm-wave antenna feed source assembly, which can increase the design degree-of-freedom of the antenna apparatus and can increase the degree-of-freedom of system stacking and improve the product competitiveness.

In one embodiment, the antenna part is grounded and is also electrically connected to the non-mm-wave antenna feed source assembly; the number of the non-mm-wave antenna feed source assemblies is at least two; and each of two ends of the antenna part is electrically connected to one non-mm-wave antenna feed source assembly. The antenna part is grounded and is also electrically connected to the non-mm-wave antenna feed source assembly, thus ensuring the realization of the function of the non-mm-wave antenna. Each of two ends of the antenna part is electrically connected to one non-mm-wave antenna feed source assembly, so that a radiation effect of two non-mm-wave antennas can be achieved at the same time, and even a multiple-input and multiple-output (MIMO) effect can be achieved, without increasing the size of the antenna apparatus. Therefore, the user experience of the antenna apparatus is relatively high, and the overall competitiveness of the product is relatively high.

In one embodiment, the antenna part includes a first intermediate part, a first antenna part connected between the intermediate part and the antenna structure, and a second antenna part connected to an end of the first intermediate part away from the first antenna part; the first intermediate part is provided with a second conductive member; and the second antenna part is grounded or the first intermediate part is grounded through the second conductive member. The above structure makes the antenna part have various different grounding ways. The antenna design and placement are more flexible, and the structure is simple, easy to realize, and higher in reliability.

In one embodiment, the second conductive member includes a second metal block; the second metal block is arranged on the circuit board and contacts the first intermediate part, so as to be electrically connected to the first intermediate part; the number of the non-mm-wave antenna feed source assemblies is at least two; and each of the first antenna part and the second antenna part is electrically connected to one non-mm-wave antenna feed source assembly. The first intermediate part is grounded through a second conductive member so that each of two ends of the non-mm-wave antenna formed by the antenna part can be electrically connected to one non-mm-wave antenna feed source assembly, thus a radiation effect of two non-mm-wave antennas can be achieved at the same time, and even a MIMO effect can be achieved, without increasing the size of the antenna apparatus. Therefore, the user experience of the antenna apparatus is relatively high, and the overall competitiveness of the product is relatively high. The second conductive member includes a second metal block so that the second conductive member can further play a role of isolation and electrical connection (such as grounding) to maintain the stability of the wireless communication function, thus improving the product performance.

In one embodiment, the side wall structure includes a gap penetrating through the side wall structure; at least part of the antenna structure is located in the gap; the antenna apparatus further includes a decorative member; at least part of the mm-wave antenna and/or the non-mm-wave antenna corresponds to the gap; and the decorative member is located in the gap and covers at least part of the mm-wave antenna and/or the non-mm-wave antenna. Since at least part of the antenna structure is arranged in the gap, stable and reliable assembling of the antenna structure and the housing can be realized, and the gap can also avoid an antenna signal from being shielded, which enhances the wireless communication experience. Further, the decorative member can not only protect the antenna structure, avoid damage, and improve the reliability, but also improve the appearance beauty of the electronic device using the antenna apparatus and improve the product competitiveness.

In one embodiment, the housing has a groove on the inner side; at least part of the antenna structure is located in the groove; and at least part of the mm-wave antenna and the non-mm-wave antenna corresponds to the groove. At least part of the antenna structure is arranged in the groove, which can realize stable and reliable assembling of the antenna structure and the housing; furthermore, the groove can also reduce shielding of an antenna signal, which enhances the wireless communication experience; the groove can also protect the antenna structure, avoid damage, and improve the reliability and can also improve the appearance beauty of the electronic device using the antenna apparatus and improve the product competitiveness.

In one embodiment, the antenna stand includes a first supporting part and a second supporting part; the second supporting part is connected with the circuit board; the first supporting part is connected to a side of the second supporting part away from the circuit board and is opposite to the circuit board; the flexible printed circuit board includes a first part and a second part connected to the first part; the first part is arranged on the first supporting part; and at least part of the second part is arranged on the second supporting part and is connected to the circuit board. It can be understood that the antenna stand having the first supporting part and the second supporting part can realize effective bearing for a three-dimensional antenna structure having the first part and the second part and increase the design flexibility of the antenna apparatus. In addition, the three-dimensional antenna structure is also favorable for improving the antenna performance and the wireless communication experience.

In one embodiment, the first supporting part, the second supporting part, and the circuit board are further encircled to form an accommodating space; the non-mm-wave antenna is electrically connected to the non-mm-wave antenna feed source assembly; and the non-mm-wave antenna feed source assembly is arranged on the circuit board. It can be understood that the designed accommodating space can accommodate devices (such as the non-mm-wave antenna feed source assembly, the mm-wave antenna RFIC, and other electronic devices), thus improving the space utilization rate of the antenna apparatus and the compactness and extreme performance of the system design, which is conductive to avoiding increase of the device size and improving the overall competitiveness of the product. Further, the non-mm-wave antenna feed source assembly and/or the mm-wave antenna RFIC are arranged on the part of the circuit board that is encircled to form the accommodating space, which is conductive to electrically connecting the antenna structure to the non-mm-wave antenna feed source assembly and/or the mm-wave antenna RFIC, reducing the loss of the transmission line, and improving the signal transmission effect.

In one embodiment, the antenna stand further includes a third supporting part; the third supporting part is connected to the first supporting part, the second supporting part, and the circuit board; the flexible printed circuit board includes a third part; the third part is connected to the first part and the second part and is arranged on the third supporting part; and at least part of the non-mm-wave antenna is arranged on the third part. By means of the third supporting part, the effective bearing for the three-dimensional antenna structure is further enhanced, and the design flexibility of the antenna apparatus is increased.

In one embodiment, the second supporting part has an opening part; and at least part of the second part is electrically connected to the non-mm-wave antenna feed source assembly via an electrical connection member passing through the opening part. The second part and the non-mm-wave antenna feed source assembly are electrically connected through the electrical connection member, which can increase the design degree-of-freedom of the antenna apparatus and improve the product competitiveness.

In one embodiment, the antenna structure includes a first conductive line, and the first conductive line is at least arranged to the second part and electrically connected between the mm-wave antenna and the circuit board. By means of the first conductive line, signal transmission between the mm-wave antenna and the circuit board and/or the antenna performance can be realized.

In one embodiment, the second part includes a first sub-part arranged on the second supporting part and a second sub-part connected to the first sub-part; the second sub-part and the first sub-part are in bending connection; the second sub-part is superposed with the circuit board and is connected with the circuit board; the circuit board is provided with a mm-wave RFIC; the second sub-part is electrically connected with the mm-wave RFIC so that the mm-wave antenna is electrically connected to the mm-wave RFIC; and the second sub-part is also electrically connected with the non-mm-wave antenna feed source assembly so that the non-mm-wave antenna is electrically connected to the non-mm-wave antenna feed source assembly. The bent second sub-part is superposed with the circuit board and is connected with the circuit board, which can facilitate the electrical connection between the second part and an external device (such as the mm-wave RFIC) and improve the assembling efficiency.

In one embodiment, an end of the first conductive line away from the mm-wave antenna and at least part of the non-mm-wave antenna are arranged on the same second sub-part, so as to be electrically connected to the circuit board. It can be understood that by means of the above arrangement, the integration property of electrical connection positions of the antenna structure can be improved, and electrical connection to the circuit board is facilitated, thus improving the assembling efficiency.

In one embodiment, an end of the first conductive line away from the mm-wave antenna and at least part of the non-min-wave antenna are arranged on different second sub-parts, so as to be electrically connected to the circuit board. Different second sub-parts are in bending connection to the same side of the first sub-part. It can be understood that by means of the above arrangement, it is favorable for avoiding mutual interference between the mm-wave antenna and the non-mm-wave antenna and improving the design degree-of-freedom of the antenna apparatus.

In one embodiment, the second supporting part has an opening part; the second sub-part passes through the opening part; and an end of the second sub-part away from the first sub-part is electrically connected to the circuit board. The arrangement of the opening part can facilitate the bending of the second sub-part relative to the first sub-part; after the bending, the bottom of the second sub-part and the bottom of the first sub-part can be substantially located on the same plane, thereby favorably improving the assembling flatness of the antenna structure and the degree-of-freedom of system stacking.

In one embodiment, the antenna stand includes an inner surface and an outer surface, and the antenna structure is arranged on the outer surface. The antenna structure is arranged on the outer surface, which can improve the radiation effect of the antenna structure. The flexible printed circuit board includes a first surface and a second surface located on a side opposite to the first surface; at least part of the mm-wave antenna is arranged on the first surface; and at least part of the non-mm-wave antenna is arranged on the first surface. By means of disposing at least part of the mm-wave antenna and at least part of the non-mm-wave antenna on the same surface, a compact design of the antenna apparatus can be realized, and the requirement of the antenna apparatus for the overall size of the electronic device is lowered, thus reducing the cost and improving the product competitiveness. The non-mm-wave antenna includes a plurality of opening regions; the mm-wave antenna includes a plurality of mm-wave antenna units; and the plurality of mm-wave antenna units are respectively arranged in the plurality of opening regions. By the arrangement of the plurality of mm-wave antenna units, the communication capability of the mm-wave antenna can be improved, and the usage requirement of the existing electronic device for a plurality of mm-wave antennas is met. The plurality of mm-wave antenna units are respectively arranged in the plurality of opening regions, so that the non-mm-wave antenna can effectively improve the mutual signal coupling between the plurality of mm-wave antenna units and improve the isolation between the mm-wave antenna units, so as to enhance the radiation effect of the mm-wave antenna. By the above arrangement, the antenna apparatus can be designed to be more compact to increase the space utilization rate, which is favorable for reducing the mutual coupling between the mm-wave antenna and the non-mm-wave antenna and improving the wireless communication performance of the mm-wave antenna, thus improving the overall competitiveness of the product.

In one embodiment, the first surface is a surface away from one side of the outer surface, and the second surface is a surface close to one side of the outer surface. In particular, when at least part of the mm-wave antenna and at least part of the non-mm-wave antenna are located on the first surface and are close to an outer side of the electronic device, the antenna apparatus further has a technical effect of good radiation effect.

In one embodiment, one part of the non-mm-wave antenna is arranged on the first surface, and the other part of the non-mm-wave antenna is arranged on the second surface; the antenna stand includes an opening corresponding to the other part of the non-mm-wave antenna; the antenna apparatus includes a third conductive member; the third conductive member is arranged on the circuit board and contacts the other part of the non-mm-wave antenna through the opening, so as to ground the other part of the non-mm-wave antenna; the third conductive member includes a third metal block; the other part of the non-mm-wave antenna includes a second intermediate part, a third antenna part, and a fourth antenna part; the third antenna part and the fourth antenna part are respectively connected to two ends of the second intermediate part; and each of the third antenna part and the fourth antenna part is electrically connected to one non-mm-wave antenna feed source assembly located on the circuit board. It can be understood that the third conductive member can achieve the technical effects of isolation, supporting, electrical connection, heat dissipation, and the like. The third conductive member includes a third metal block, so that the third conductive member may further play an isolation role, and can also discharge heat to the outside while it is grounded, so as to reduce the temperature of the antenna apparatus (the mm-wave RFIC) and maintain the stability of a wireless communication function, thus improving the product performance and the grip comfort of the user. The second intermediate part is grounded through the third conductive member, achieving an isolation effect, so that each of two ends of the non-mm-wave antenna formed by the antenna part can be electrically connected to one non-mm-wave antenna feed source assembly, thus a radiation effect of two non-mm-wave antennas can be achieved at the same time, and even a MIMO effect can be achieved, without increasing the size of the antenna apparatus. Therefore, the user experience of the antenna apparatus is relatively high, and the overall competitiveness of the product is relatively high.

In one embodiment, the third metal block has a second gap part; and at least part of the flexible printed circuit board passes through the second gap part and is superposed and electrically connected with the circuit board. By the arrangement of the second gap part, the bending of at least part of the flexible printed circuit board can be facilitated, thus facilitating improving the assembling flatness of the antenna structure and avoiding an increase in the path loss due to the fact that the flexible printed circuit board bypasses the third metal block. Therefore, it is favorable for improving the wireless communication performance.

In a second aspect, one embodiment of the present disclosure discloses an electronic device. The electronic device includes the antenna apparatus of any one of the above embodiments.

In the electronic device, the antenna structure formed by the mm-wave antenna and the non-mm-wave antenna is arranged on the flexible printed circuit board, and the antenna structure is arranged on the antenna stand on the circuit hoard, so that integration of the mm-wave antenna and the non-mm-wave antenna is realized, and the antenna stand effectively bears the antenna structure; the design flexibility of the antenna structure and the antenna apparatus is increased; the challenge for disposing a number of antennas in the electronic device is solved; and the space utilization rate is increased in a limited space, thereby improving the product competitiveness. In addition, the electronic device uses the antenna apparatus in the foregoing embodiments, so that it also has other further features and advantages of the antenna apparatus, and descriptions thereof are omitted here.

BRIEF DESCRIPTION OF THE DRAWINGS

In order to explain the technical solutions of the embodiments of the present disclosure more clearly, the following will briefly introduce the accompanying drawings used in the embodiments. Apparently, the drawings in the following description are only some embodiments of the present disclosure. Those of ordinary skill in the art can obtain other drawings based on these drawings without creative work.

DETAILED DESCRIPTION OF THE EMBODIMENTS

Figure 1:
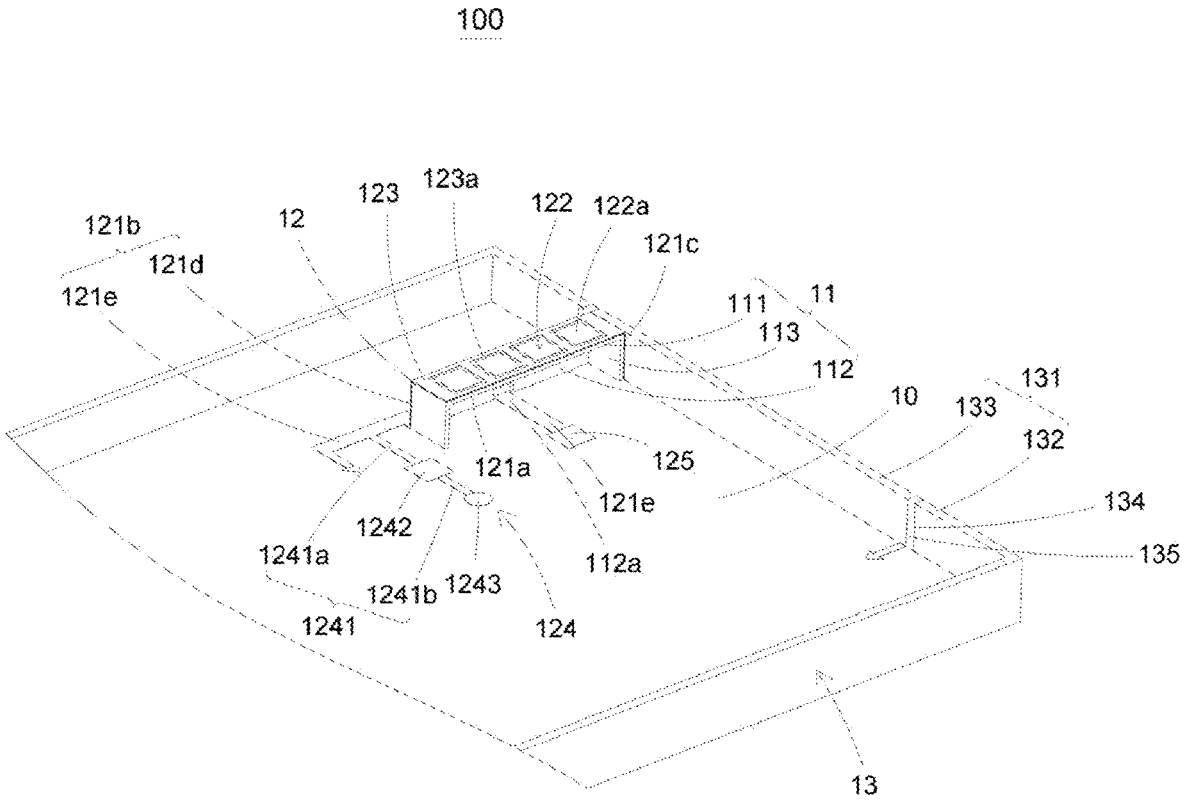
FIG. 1 is a three-dimensional diagram of an antenna apparatus disclosed in Embodiment I of the present disclosure.

The technical solutions in the embodiments of the present disclosure will be clearly and completely described below in conjunction with the accompanying drawings in the embodiments of the present disclosure. Apparently, the described embodiments are only a part of the embodiments of the present disclosure, rather than all the embodiments. Based on the embodiments in the present disclosure, all other embodiments obtained by those of ordinary skill in the art without creative work shall fall within the protection scope of the present disclosure.

In the present disclosure, orientations or positional relationships indicated by the terms "upper", "lower", "left", "right", "front", "rear", "top", "bottom", "inner", "outer", "middle", "vertical", "horizontal", "transverse", "longitudinal", etc. are based on orientations or positional relationships shown in the drawings. These terms are mainly used to better describe the present disclosure and embodiments of the present disclosure, and are not used to limit that the indicated device, element, or component must have a specific orientation, or be constructed and operated in a specific orientation.

In addition, some of the above terms may be used to indicate other meanings in addition to the orientations or position relationships. For example, the term "upper" may also be used to indicate a certain dependence relationship or connection relationship in some cases. For those of ordinary skill in the art, the specific meanings of the above terms in the present disclosure can be understood according to specific situations.

In addition, the terms "install", "arrange", "provide", "connect" and "couple" should be understood broadly. For example, it can be a fixed connection, a detachable connection, an integral structure, a mechanical connection, an electrical connection, a direct connection, an indirect connection through an intermediate medium, or a communication between two devices, elements or components. For those of ordinary skill in the art, the specific meanings of the above terms in the present invention can be understood according to specific situations.

In addition, the terms "first", "second", etc., are used primarily to distinguish different devices, elements or components (the specific type and construction may be the same or different) and are not used to indicate or imply the relative importance or quantity of the indicated device, element or component. Unless otherwise stated, "plurality" means two or more.

Embodiment I

Figure 2:
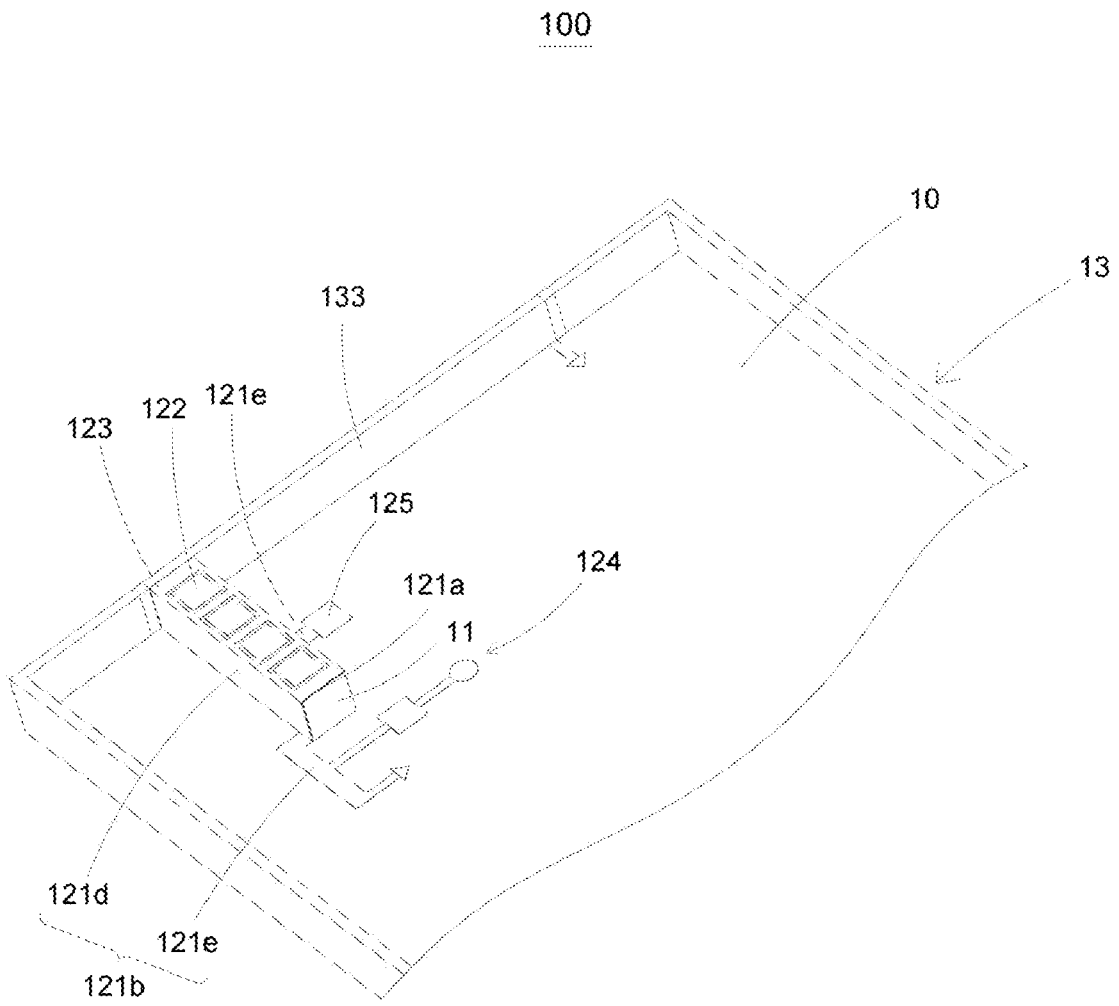
FIG. 2 is a three-dimensional diagram from another view of the antenna apparatus shown in FIG. 1.
Figure 3:
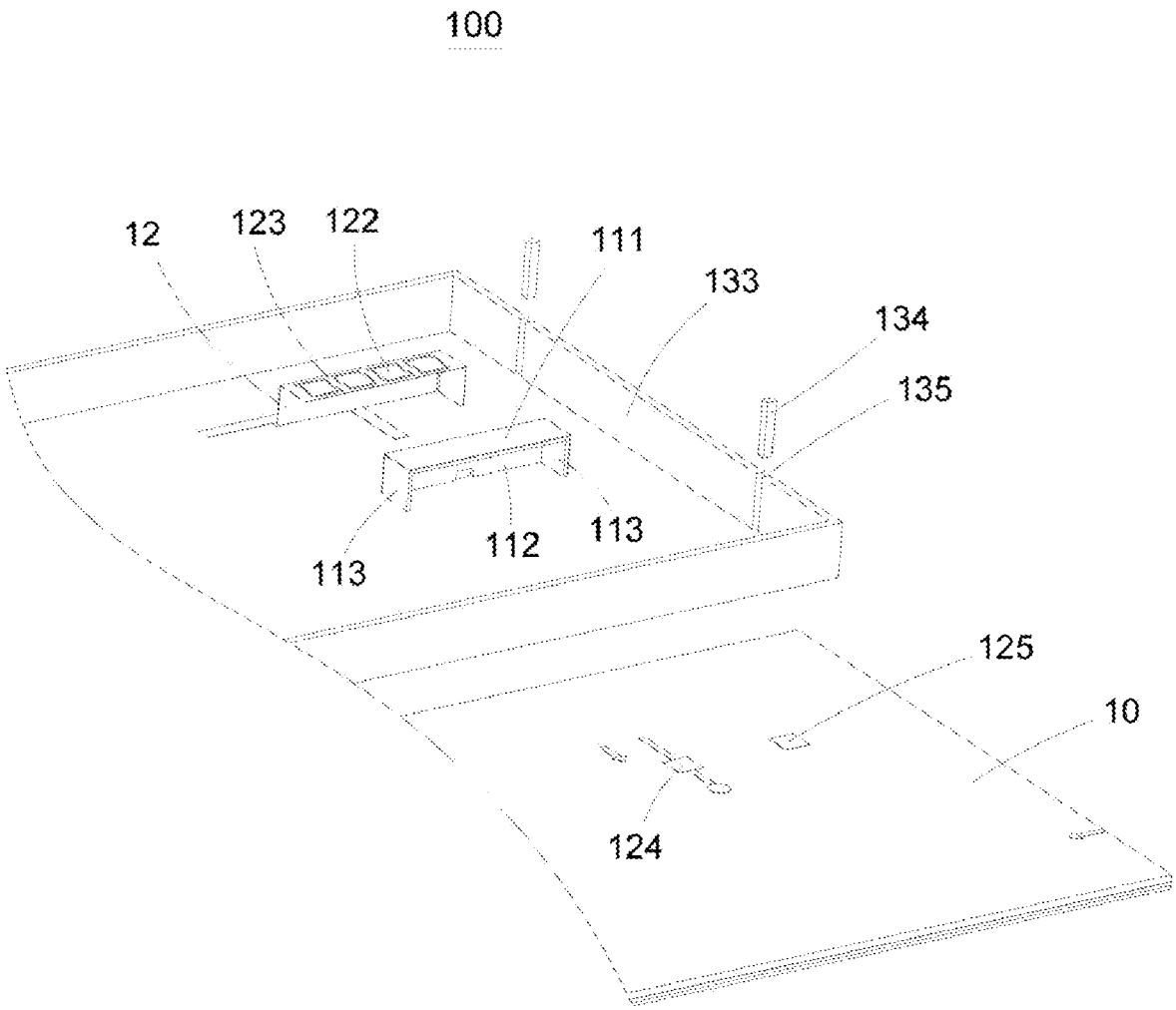
FIG. 3 is an exploded diagram of the antenna apparatus of FIG. 1.

As shown in FIG. 1, FIG. 2, and FIG. 3, the antenna apparatus 100 includes a circuit board 10, an antenna stand 11 arranged on the circuit board 10, and an antenna structure 12 arranged on the antenna stand 11. The antenna structure 12 includes a flexible printed circuit board 121, a millimeter wave (mm-wave) antenna 122 arranged on the flexible printed circuit board 121, and a non-mm-wave antenna 123 arranged on the flexible printed circuit board 121.

Compared to the existing art, the antenna structure 12 formed by the mm-wave antenna 122 and the non-mm-wave antenna 123 is arranged on the flexible printed circuit board 121, and the antenna structure 12 is arranged on the antenna stand 11 on the circuit board 10, so that integration of the mm-wave antenna 122 and the non-mm-wave antenna 123 is realized, and the antenna stand 11 effectively bears the antenna structure 12; the design flexibility of the antenna structure 12 and the antenna apparatus 100 is increased; the challenge for disposing a number of antennas in the electronic device is solved; and the space utilization rate is increased in a limited space, thereby improving the product competitiveness.

The antenna apparatus 100 further includes a housing 13 which is arranged at a periphery of the circuit board 10; and at least part of the housing 13 is electrically connected to the non-mm-wave antenna 123. The housing 13 may be a border of the electronic device using the antenna apparatus 100, but is not limited to a border, or it may be a front cover or a rear cover. At least part of the housing 13 is a conductive material and is electrically connected to the non-mm-wave antenna 123. The circuit board 10 may be a main board of the electronic device. It may specifically be a printed circuit board.

At least part of the housing 13 is electrically connected to the antenna structure 12, so that at least part of the housing 13 can be used as an antenna at the same time, which not only helps to increase the length and/or enlarge the area of the antenna structure 12 (particularly the length and/or area of a low-frequency antenna), but also is conductive to reducing the overall size of the antenna structure 12. Furthermore, the housing 13 is generally located on the outermost side of the electronic device, which is also conductive to avoiding an antenna signal from being shielded, thus improving the antenna performance, the wireless communication experience of a user, and the overall competitiveness of a product.

Specifically, the housing 13 includes a side wall structure 131 annularly arranged at a periphery of the circuit board 10; the side wall structure 131 includes a side wall part 132 and an antenna part 133 connected to the side wall part 132; the antenna part 133 is electrically connected to the non-mm-wave antenna 123; and the side wall part 132 and the antenna part 133 are connected in sequence along an annular arrangement direction. It can be understood that the antenna part 133 is a conductive material.

The side wall structure 131 is annularly arranged at the periphery of the circuit board 10 and can protect the circuit board 10; furthermore, by means of electrically connecting the antenna part 133 of the side wall structure 131 to the non-mm-wave antenna 123 and connecting the side wall part 132 and the antenna part 133 in sequence along the annular arrangement direction, the length and/or area of the non-mm-wave antenna 123 can be effectively increased and/or enlarged, and it is favorable for reducing the overall size of the antenna structure 12.

In this embodiment, break joints 134 are respectively formed between two ends of the antenna part 133 and the side wall part 132; insulating packing media 135 are arranged in the break joints 134; and the antenna part 133 is further grounded through the circuit board 10. Both the side wall part 132 and the antenna part 133 are metal conductive materials. The materials are simple and easy to realize, and they can be integrated, so as to ensure the production efficiency. Further, by the arrangement of the break joints 134 and the insulating packing media 135, the antenna signal can be avoided from being shielded, which is conductive to improving the antenna performance and enhancing the wireless communication experience; and furthermore, the design degree-of-freedom of the position and size of the break joint on the housing 13 may be larger (i.e., the product appearance design may be better), which thus contributes to improving the overall competitiveness of the product. The antenna part 133 is arranged at the periphery of the circuit board 10 and can also be grounded and/or the antenna part 133 is also electrically connected to a non-mm-wave antenna feed source assembly 124, which ensures the realization of antenna functions, facilitates assembling, has an effect of protecting a system of the electronic device, and can be used as one part of the appearance design.

An end of the antenna part 133 away from the antenna structure 12 may be grounded, so that the non-mm-wave antenna 123 is grounded via the antenna part 133, and the non-mm-wave antenna 123 is also used to be electrically connected to the non-mm-wave antenna feed source assembly 124. Specifically, the end of the antenna part 133 away from the antenna structure 12 may directly contact a grounded point on the circuit board 10. The above-mentioned structure is simpler, easy to realize, and higher in reliability. The non-mm-wave antenna 123 directly contacts the antenna part 133, so as to be electrically connected to the antenna part 133. The non-mm-wave antenna 123 directly contacts the antenna part 133, so as to realize their electrical connection, and this also has the technical effects of easy design, simple structure, convenient assembling, and the like. In particular, the non-mm-wave antenna feed source assembly 124 may be arranged on the circuit board 10. The mm-wave antenna 122 is used to be electrically connected to a mm-wave radio-frequency integrated circuit (RFIC) 125. The mm-wave RFIC 125 may be arranged on the circuit board 10, or may be arranged on the flexible printed circuit board 121. In Embodiment I, a schematic illustration is mainly made by disposing the mm-wave RFIC 125 on the circuit board 10.

Further, it can be understood that the non-mm-wave antenna feed source assembly 124 can include a feeder line 1241, a matching network 1242, and a feed source 1243. The non-mm-wave antenna 123 is connected with the matching network 1242 and the feed source 1243 in sequence via the feeder line 1241. The feeder line 1241 can include a first feeder line 1241*a* and a second feeder line 1241*b*; the first feeder line 1241*a* is connected with the matching network 1242 and the feed source 1243; one end of the second feeder line 1241*b* is connected with the matching network 1242, and the other end of the second feeder line 1241*b* is connected with the non-mm-wave antenna 123; and the non-mm-wave antenna 123 is connected with the feed source 1243 via the second feeder line 1241*b*, the matching network 1242, and the first feeder line 1241*a*. In some change embodiments, some other cables or electrical connection members can also be used to replace the feeder line 1241 to realize the electrical connection between the non-mm-wave antenna 123, the matching network 1242, and the feed source 1243.

The antenna stand 11 is an insulating stand. It may be made of an insulating material or formed by covering a non-insulating material with an insulating material, for example. The antenna stand 11 includes an inner surface and an outer surface, and the antenna structure 12 is arranged on the outer surface. In particular, the antenna structure 12 is arranged on the outer surface, which can improve the radiation effect of the antenna structure 12.

Specifically, the antenna stand 11 may include a first supporting part 111 and a second supporting part 112; the second supporting part 112 is connected with the circuit board 10; and the first supporting part 111 is connected to a side of the second supporting part 112 away from the circuit board 10 and is opposite to the circuit board 10. The first supporting part 111, the second supporting part 112, and the circuit board 10 are further encircled to form an accommodating space. The accommodating space can accommodate internal and external devices, and can particularly accommodate electronic devices located on the non-mm-wave antenna feed source assembly 124, the mm-wave antenna RFIC 125, and/or the circuit board 10, thus improving the space utilization rate of the antenna apparatus 100 and the compactness and extreme performance of the system design, which is conductive to avoiding increase of the device size and improving the overall competitiveness of the product. Further, the non-mm-wave antenna feed source assembly 124 and/or the mm-wave antenna RFIC 125 are arranged on the part of the circuit board 10 that is encircled to form the accommodating space, which is conductive to electrically connecting the antenna structure 12 to the non-mm-wave antenna feed source assembly 124 and/or the mm-wave antenna RFIC 125, reducing the loss of a transmission line, and improving the signal transmission effect.

In this embodiment, the flexible printed circuit board 121 includes a first part 121*a* and a second part 121*b* connected to the first part 121*a*; the first part 121*a* is arranged on the first supporting part 111; and at least part of the second part 121*b* is arranged on the second supporting part 112 and is connected to the circuit board 10. The mm-wave antenna 122 may be arranged on the first part 121*a*, and at least part of the non-mm-wave antenna 123 may be arranged on the first part 121*a* and the second part 121*b*. It can be understood that the antenna stand 11 having the first supporting part 111 and the second supporting part 112 can realize effective bearing for a three-dimensional antenna structure having the first part 121*a* and the second part 121*b* and increase the design flexibility of the antenna apparatus 100. In addition, the three-dimensional antenna structure is also favorable for improving the antenna performance and the wireless communication experience.

In this embodiment, the antenna stand 11 further includes a third supporting part 113; the third supporting part 113 is connected to the first supporting part 111, the second supporting part 112, and the circuit board 10; the flexible printed circuit board 121 includes a third part 121*c*; the third part 121*c* is connected to the first part 121*a* and the second part 121*b* and is arranged on the third supporting part 113; and at least part of the non-mm-wave antenna 123 is arranged on the third part 121*c*. By means of the third supporting part 113, the effective bearing for the three-dimensional antenna structure is further enhanced, and the design flexibility of the antenna apparatus 100 is increased.

The second part 121*b* includes a first sub-part 121*d* arranged on the second supporting part 112 and a second sub-part 121*e* connected to the first sub-part 121*d*; the second sub-part 121*e* and the first sub-part 121*d* are in bending connection; the second sub-part 121*e* is superposed with the circuit board 10 and is connected with the circuit board 10; the circuit board 10 is provided with a mm-wave RFIC 125; the second sub-part 121*e* is electrically connected with the mm-wave RFIC 125 so that the mm-wave antenna 122 is electrically connected to the mm-wave RFIC 125; and the second sub-part 121*e* is also electrically connected with the non-mm-wave antenna feed source assembly 124 so that the non-mm-wave antenna 123 is electrically connected to the non-mm-wave antenna feed source assembly 124. The bent second sub-part 121*e* is superposed with the circuit board 10 and is connected with the circuit board 10, which can facilitate the electrical connection between the second part 121*b* and an external device (such as the mm-wave RFIC 125) and improve the assembling efficiency.

In this embodiment, the second part 121*b* includes two second sub-parts 121*e*. One of the second sub-parts 121*e* is used to be electrically connected to the mm-wave RFIC 125 so that the mm-wave antenna 122 is electrically connected to the mm-wave RFIC 125, and the other second sub-part 121*e* is used to be electrically connected to the non-mm-wave antenna feed source assembly 124 and/or grounded.

Further, the second supporting part 112 may have a first opening part 112*a*. One of the second sub-part 121*e* may pass through the first opening part 112*a*, and one end of the second sub-part 121*e* away from the first sub-part 121*d* is electrically connected to the circuit board 10, such as the mm-wave RFIC 125 on the circuit board 10. The arrangement of the first opening part 112*a* can facilitate the bending of the second sub-part 121*e* relative to the first sub-part 121*dd*; after the bending, the bottom of the second sub-part 121*e* and the bottom of the first sub-part 121*d* can be substantially located on the same plane, thereby favorably improving the assembling flatness of the antenna structure 12.

Figure 4:
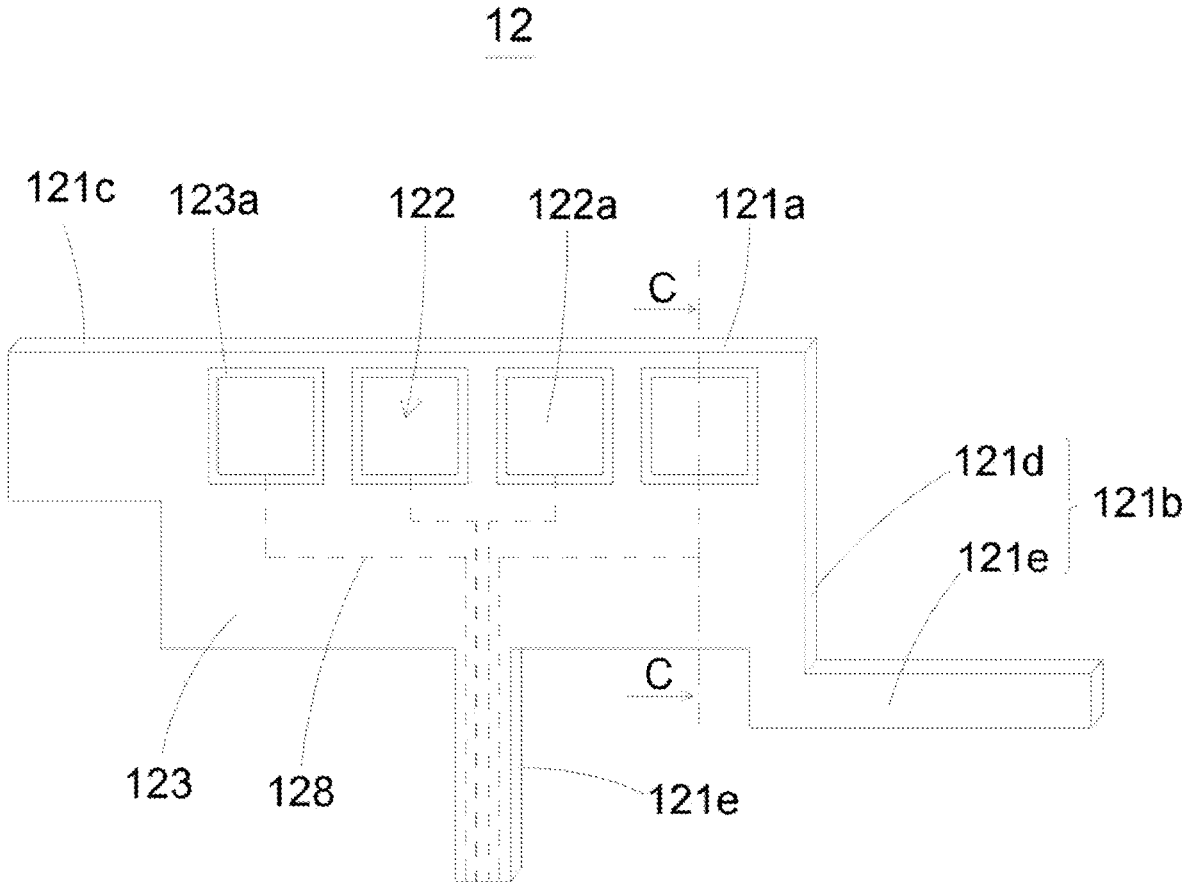
FIG. 4 is a schematic diagram illustrating that an antenna structure of the antenna apparatus shown in FIG. 1 is in a spread state.
Figure 5:
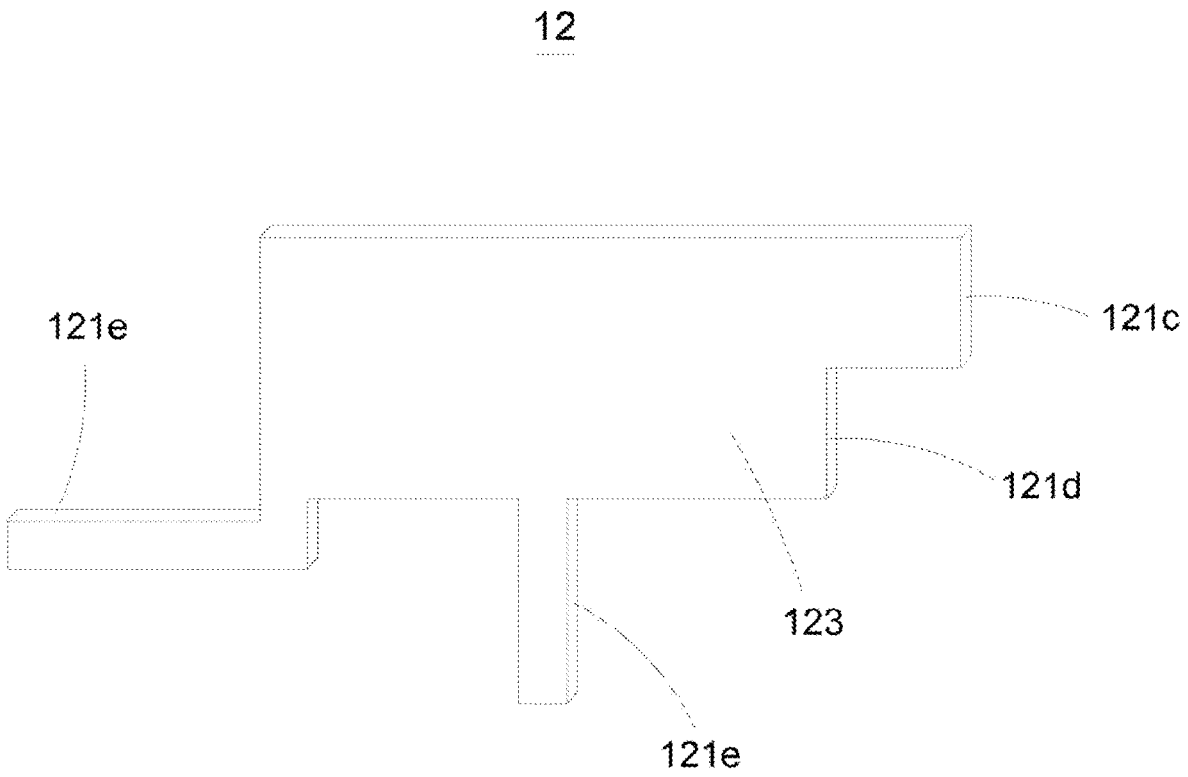
FIG. 5 is a schematic diagram illustrating that the antenna structure shown in FIG. 4 is in a spread state from another view.
Figure 6:
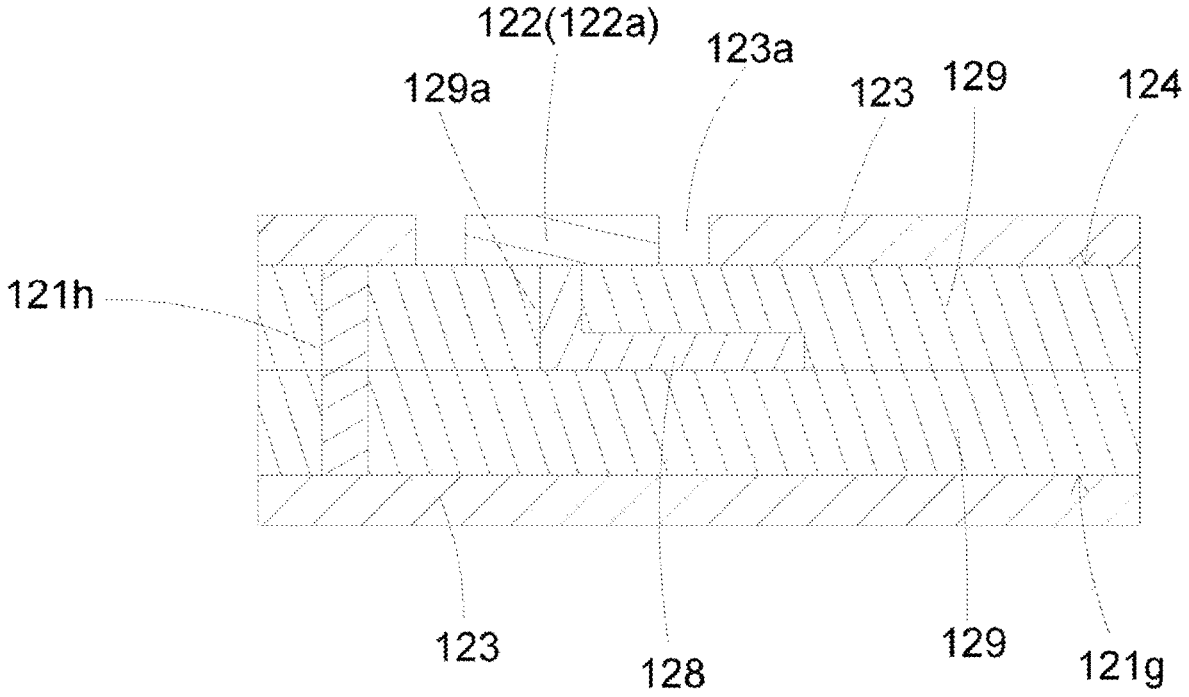
FIG. 6 is a schematic sectional diagram of the antenna structure shown in FIG. 4 along line C-C.

As shown in FIG. 4 to FIG. 6, the flexible printed circuit board 121 includes a first surface 121*f* and a second surface 121*g* located on a side opposite to the first surface 121; at least part of the mm-wave antenna 122 is arranged on the first surface 121*f*; and at least part of the non-mm-wave antenna 123 is arranged on the first surface 121*f*. The first surface 1211 may a surface away from one side of the outer surface of the antenna stand 11, and the second surface 121*g* is a surface close to one side of the outer surface of the antenna stand 11. In this embodiment, the second surface 121*g* is further provided with part of the non-mm-wave antenna 123, and the part of the non-mm-wave antenna 123 arranged on the first surface 121*f* and the part of the second surface 121*g* arranged on the non-mm-wave antenna 123 may be electrically connected by means of a first via hole 121*h* penetrating through the flexible printed circuit board 121.

In particular, at least part of the mm-wave antenna 122 and at least part of the non-mm-wave antenna 123 are arranged on the same surface, so that a compact design of the antenna apparatus 100 can be realized, and the requirement of the antenna apparatus 100 for the overall size of the electronic device is lowered; and furthermore, the design degree-of-freedom of the position and size of the break joint on the housing 13 may be higher (i.e., the appearance design of the product is better), so it is conductive to improving the overall competitiveness of the product. Further, when at least part of the mm-wave antenna 122 and at least part of the non-mm-wave antenna 123 are located on the first surface 121*f* and are close to an outer side of the electronic device, the antenna apparatus further has a technical effect of good radiation effect.

The non-mm-wave antenna 123 located on the first surface 121*f* includes a plurality of opening regions 123*a*; the mm-wave antenna 122 includes a plurality of mm-wave antenna units 122*a*; and the plurality of mm-wave antenna units 122*a* are respectively arranged in the plurality of opening regions 123*a*. By the above arrangement, the design of the antenna apparatus 100 may be more compact, and the space utilization rate is increased. The non-mm-wave antenna 123 can effectively improve the mutual signal coupling between the plurality of mm-wave antenna units 122*a* and improve the isolation between the mm-wave antenna units, so as to enhance the radiation effect of the mm-wave antenna 122. By the above arrangement, the antenna apparatus 100 can be designed to be more compact to increase the space utilization rate, which is favorable for reducing the mutual coupling between the mm-wave antenna 122 and the non-mm-wave antenna 123 and improving the wireless communication performance of the mm-wave antenna 122, thus improving the overall competitiveness of the product.

Further, the flexible printed circuit board 121 is further provided with a first conductive line 128; one end of the first conductive line 128 is electrically connected to the mm-wave antenna 122, and the other end of the first conductive line 128 is used to be electrically connected to the mm-wave RFIC 125. It can be understood that the first conductive line 128 may extend from the first part 121*a* to the second part 121*b*. Specifically, in this embodiment, the first conductive line 128 may extend from the first part 121*a* to the first sub-part 121*d* and to one of the second sub-parts 121*e*, so that one of the second sub-parts 121*e* is electrically connected to the mm-wave RFIC 125. It can be understood that the circuit board 10 may be provided with a feeder line, and the second sub-part 121*e* may be electrically connected to the mm-wave RFIC 125 through the feeder line.

In particular, as shown in FIG. 6, the flexible printed circuit board 121 may include at least two insulating layers 129 that are stacked; the first conductive line 128 may be located between the two insulating layers 129 and is electrically connected to the mm-wave antenna 122 by means of a second via hole 129*a* penetrating through one of the insulating layers 129.

Embodiment II

Figure 7:
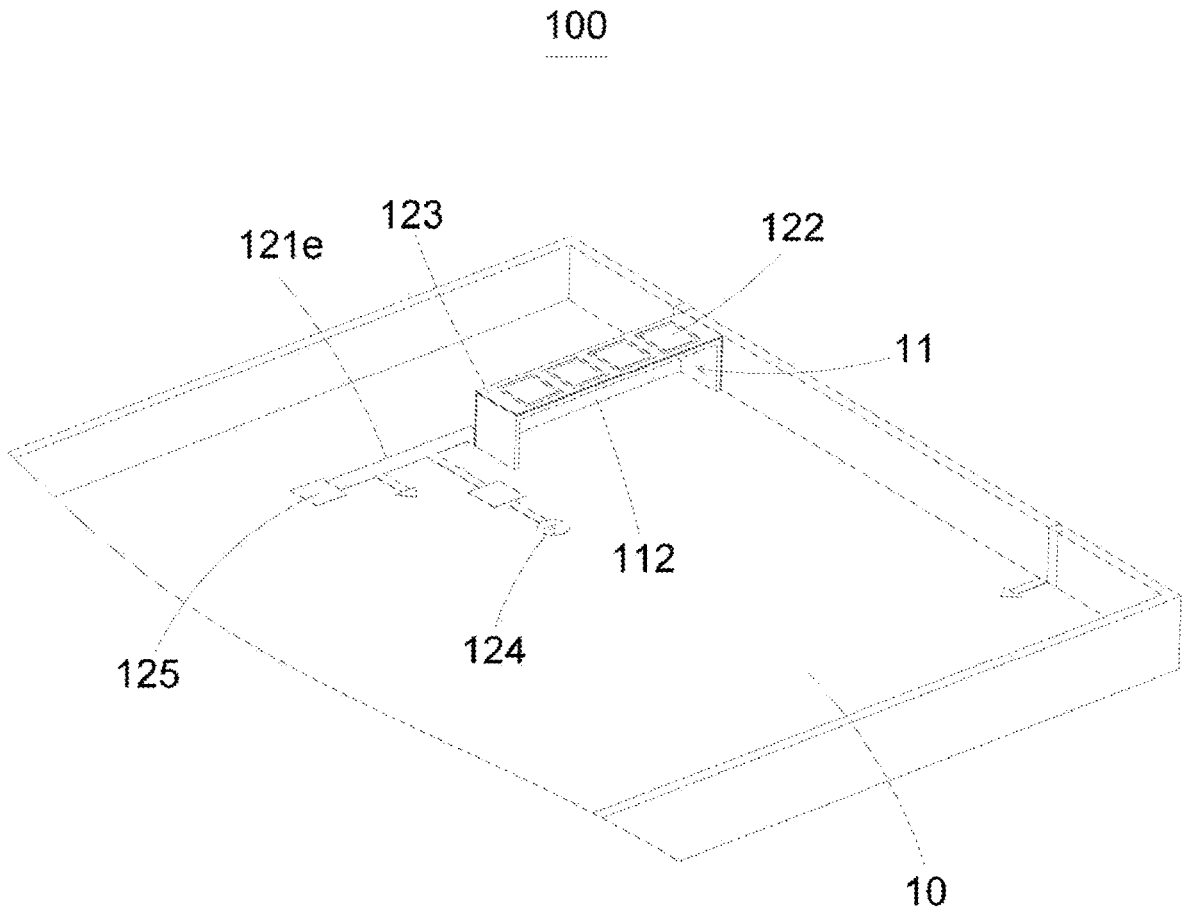
FIG. 7 is a three-dimensional diagram of an antenna apparatus disclosed in Embodiment II of the present disclosure.
Figure 8:
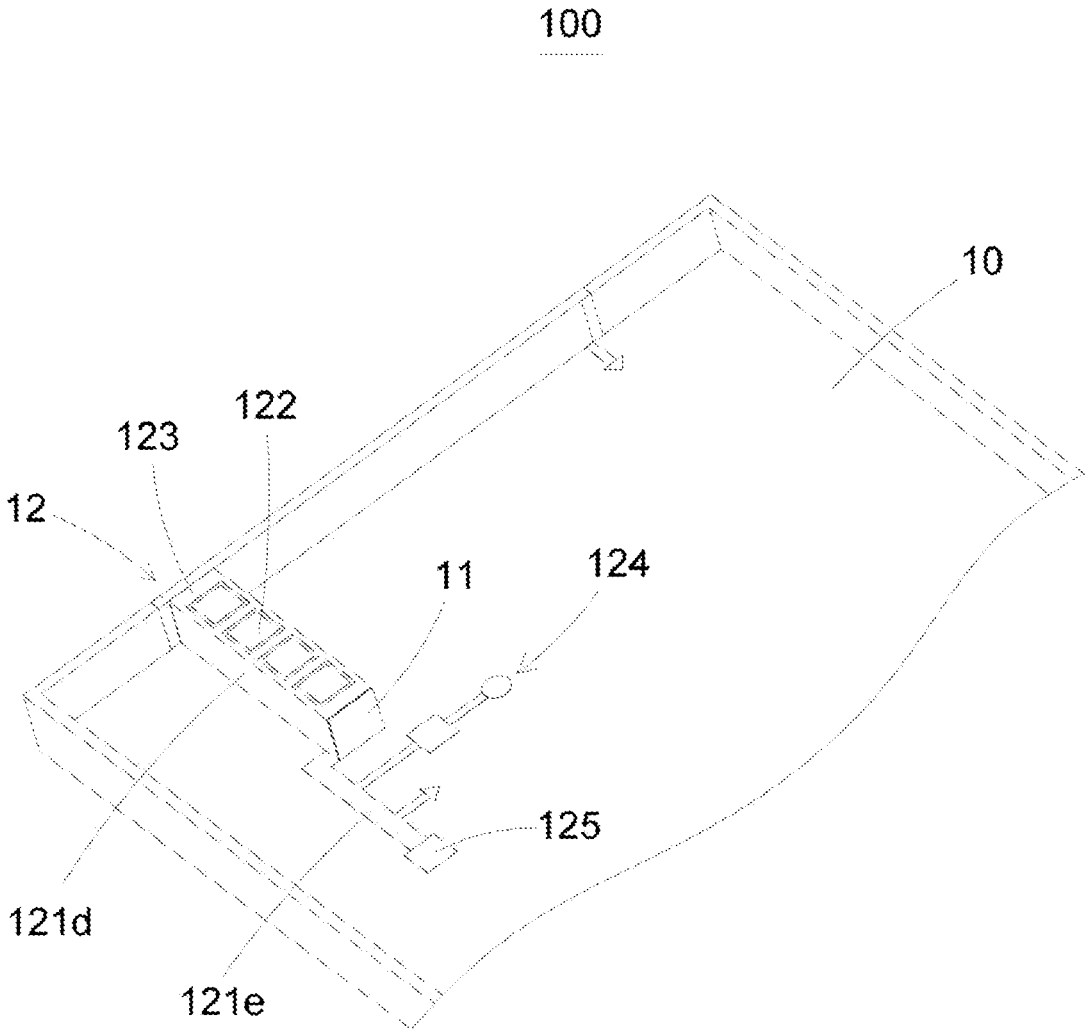
FIG. 8 is an exploded diagram of the antenna apparatus of FIG. 7.

As shown in FIG. 7 and FIG. 8, parts, which are the same as those in the solution of Embodiment I, of the solution of the antenna apparatus 100 in this embodiment are not repeatedly described, and descriptions of differences of the antenna apparatus 100 in this embodiment will be emphasized. In Embodiment II, the number of the second sub-part 121*e* may be one. The second sub-part 121*e* is in bending connection with the first sub-part 121*d* and extends towards the periphery away from the first sub-part 121. The second supporting part 112 may not be provided with the first opening part 112*a*. The second sub-part 121*e* is electrically connected to the mm-wave RFIC 125 and the non-mm-wave antenna feed source assembly 124 and grounded, so that the mm-wave antenna 122 is electrically connected to the mm-wave RFIC 125, and the non-mm-wave antenna 123 is electrically connected to the non-mm-wave antenna feed source assembly 124. It can be understood that by means of one of the second sub-parts 121*e*, the electrical connection between the mm-wave antenna 122 and the mm-wave RFIC 125, the electrical connection between the non-mm-wave antenna 123 and the non-mm-wave antenna feed source assembly 124, and the grounding of the antenna structure 12 can be completed, so that the antenna structure 12 is relatively simple, and assembling and electrical connection with the circuit board 10 are facilitated. In addition, full use of the accommodating space encircled by the antenna stand 11 and the circuit board 10 is also facilitated.

Embodiment III

Figure 9:
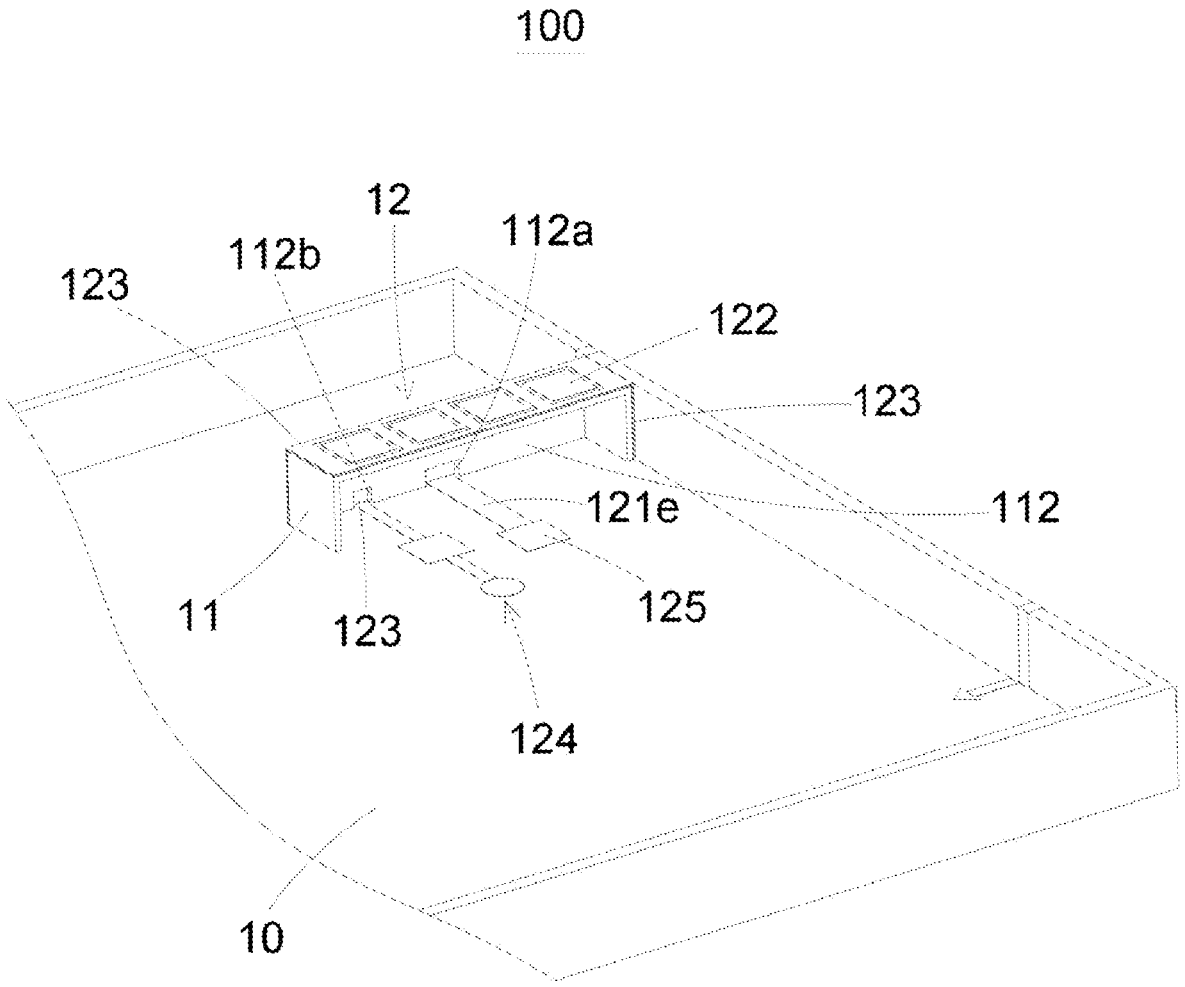
FIG. 9 is a three-dimensional diagram of an antenna apparatus disclosed in Embodiment III of the present disclosure.
Figure 10:
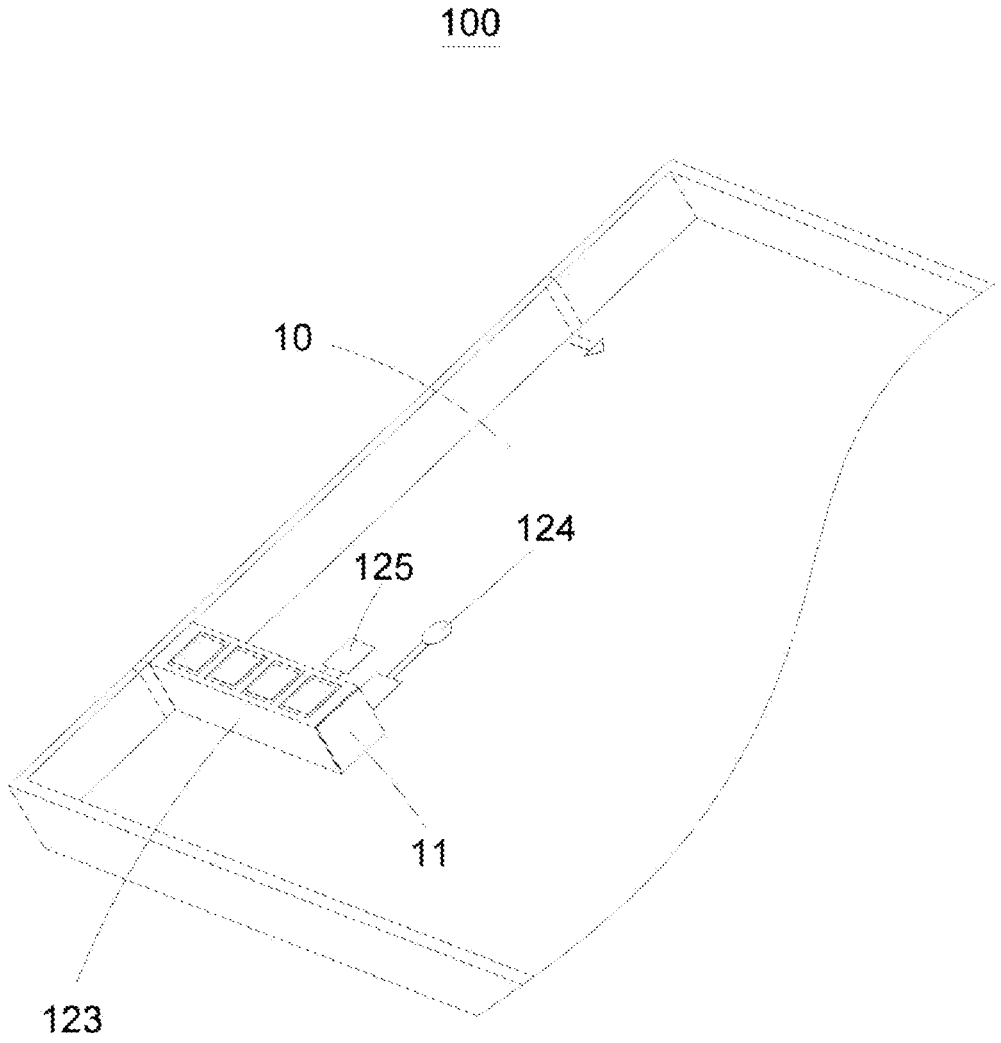
FIG. 10 is an exploded diagram of the antenna apparatus of FIG. 9.
Figure 11:
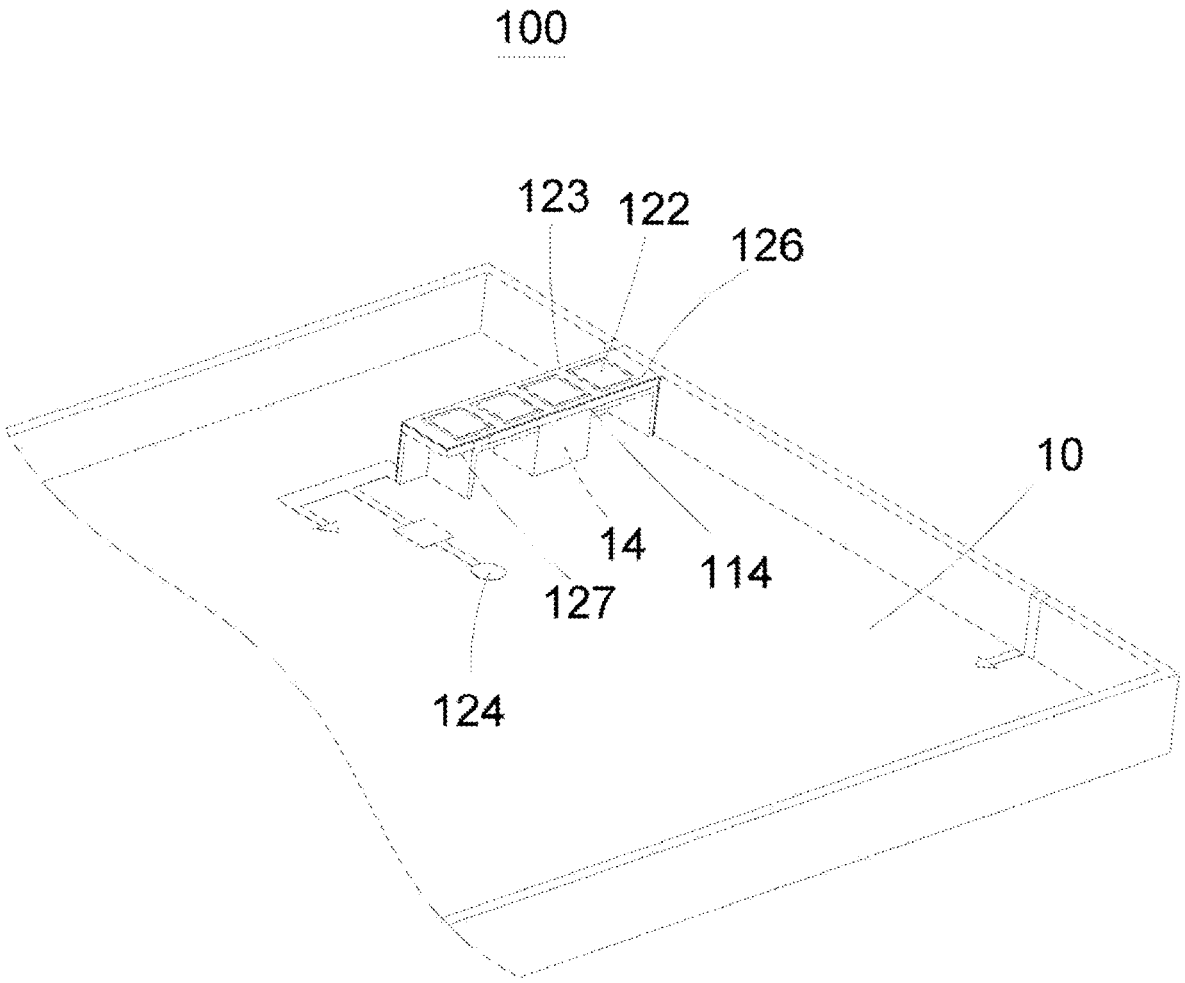
FIG. 11 is a three-dimensional diagram of an antenna apparatus disclosed in Embodiment IV of the present disclosure.
Figure 12:
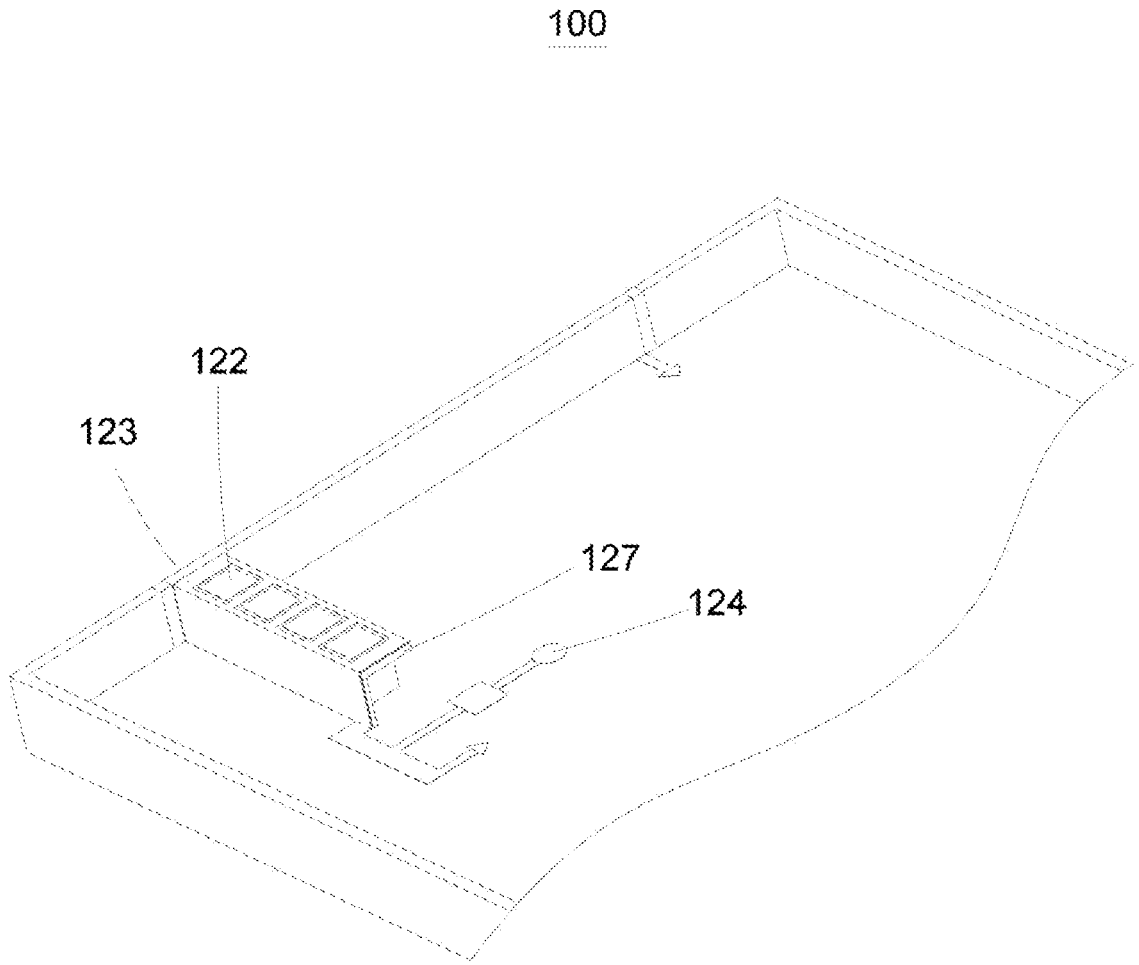
FIG. 12 is a three-dimensional diagram from another view of the antenna apparatus shown in FIG. 11.
Figure 13:
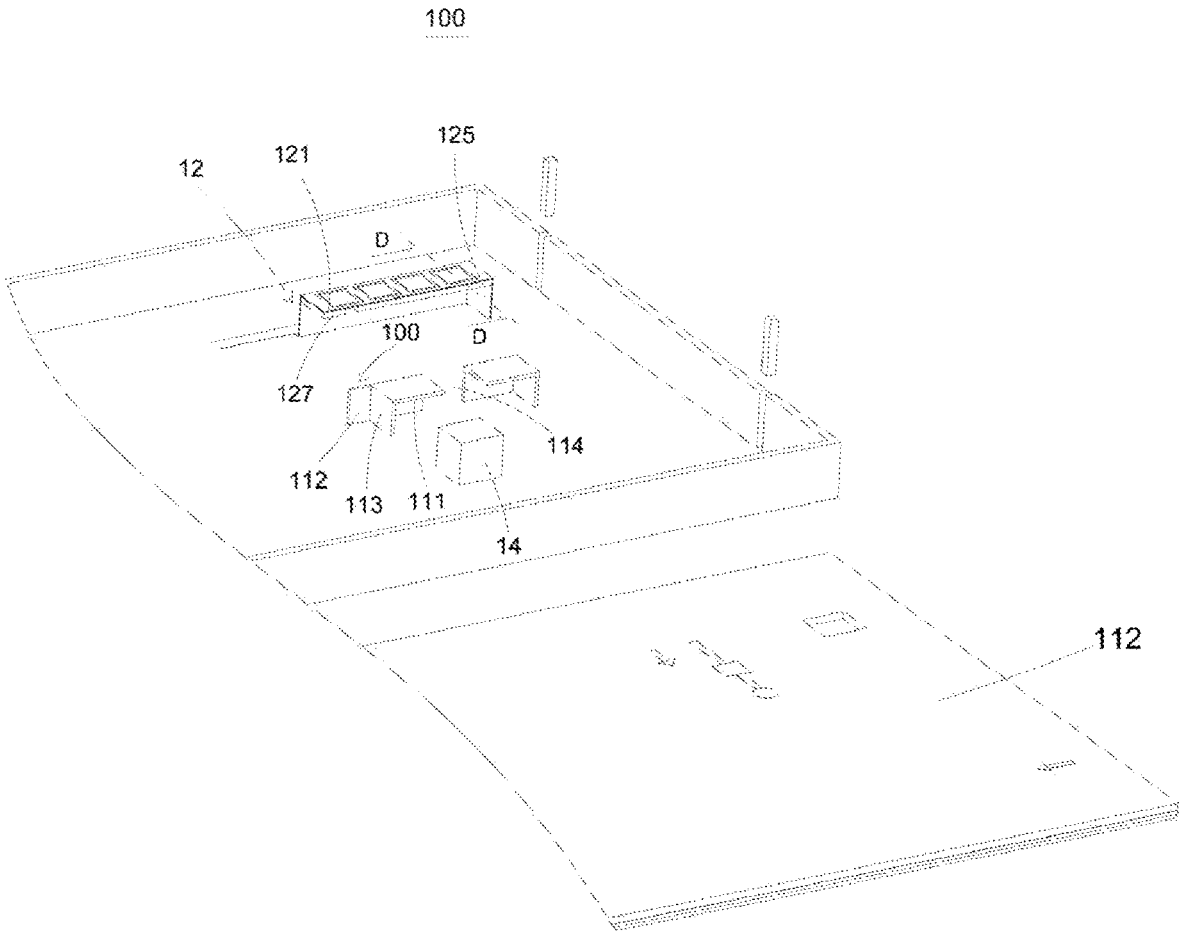
FIG. 13 is an exploded diagram of the antenna apparatus of FIG. 11.
Figure 14:
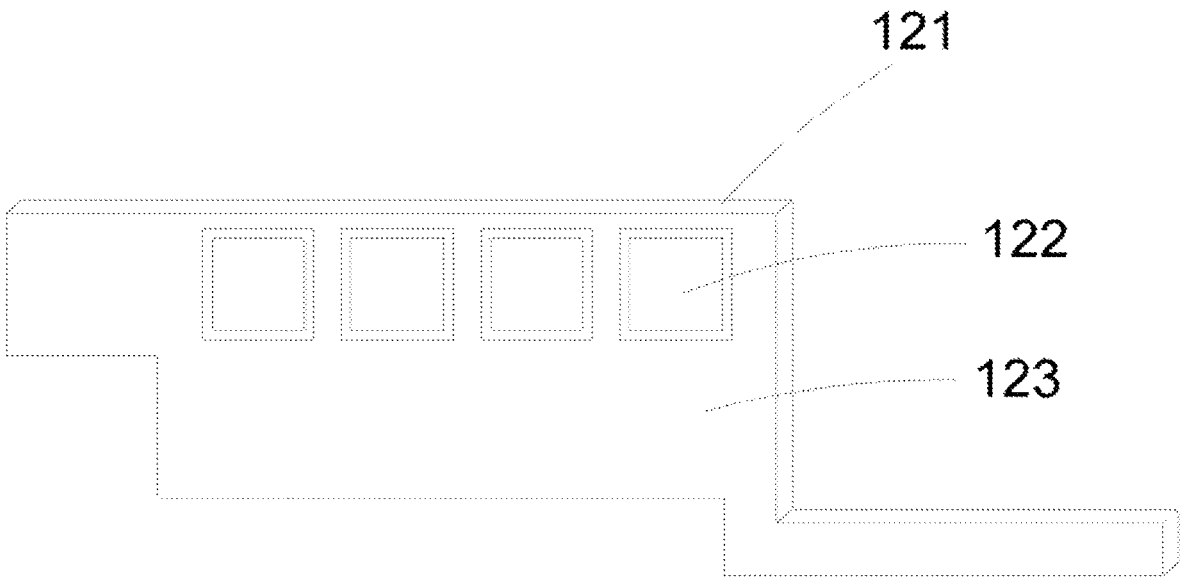
FIG. 14 is a schematic diagram illustrating that an antenna structure of the antenna apparatus shown in FIG. 11 is in a spread state.
Figure 15:
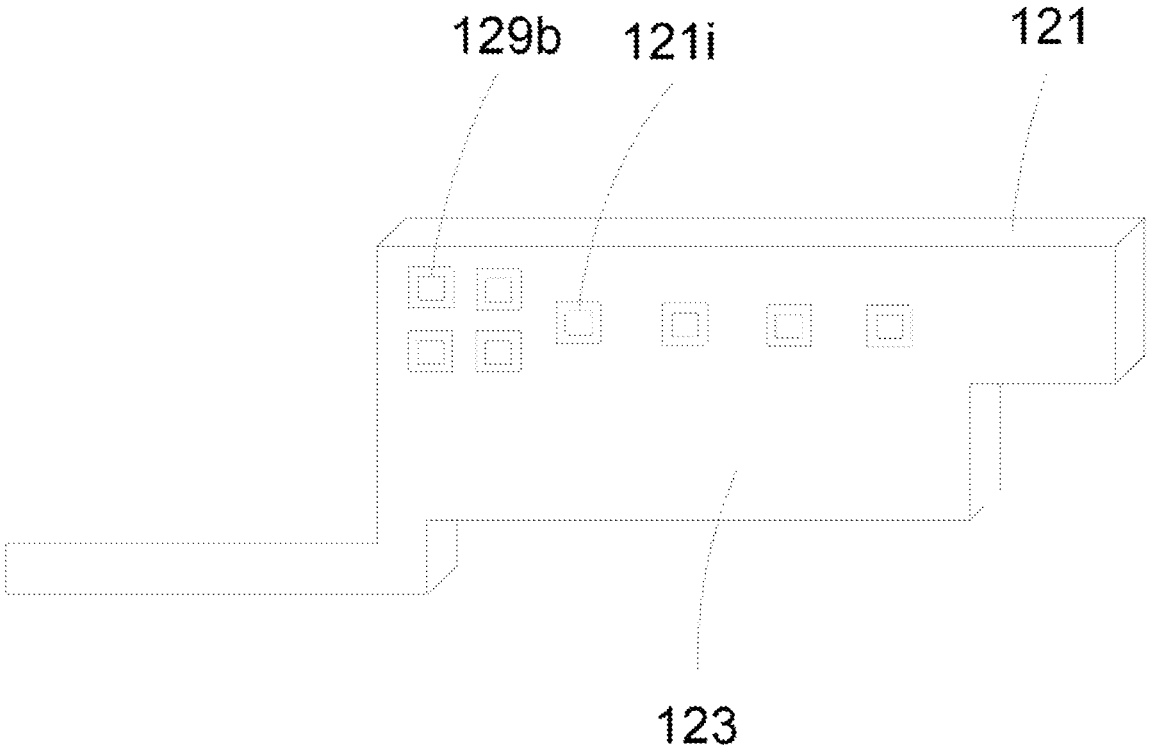
FIG. 15 is a schematic diagram illustrating that the antenna structure shown in FIG. 14 is in a spread state from another view.
Figure 16:
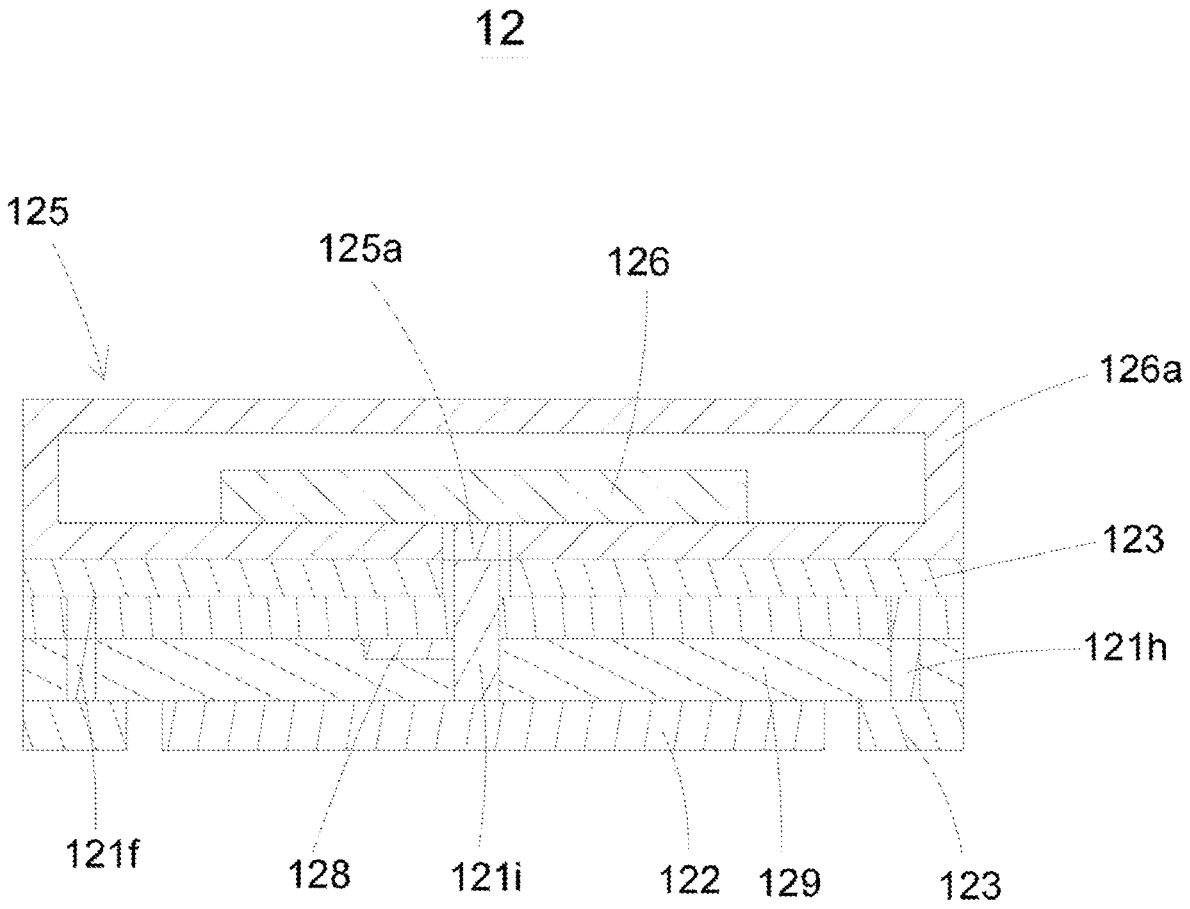
FIG. 16 is a schematic sectional diagram of the antenna structure shown in FIG. 14 along line D-D.

As shown in FIG. 9 to FIG. 10, parts, which are the same as those in the solution of Embodiment I, of the solution of the antenna apparatus 100 in this embodiment are not repeatedly described, and descriptions of differences of the antenna apparatus 100 in this embodiment will be emphasized. In Embodiment III, the number of the second sub-part 121*e* may be one. The second supporting part 112 is provided with a first opening part 112*a* and a second opening part 112*b*. A part of the accommodating space encircled by the antenna stand 11 and the circuit board 10 is provided with the non-mm-wave antenna feed source assembly 124; the second sub-part 121*e* passes through the first opening part 112*a* and is electrically connected to the mm-wave RFIC 125; and the non-mm-wave antenna 123 located on a side of the antenna structure 12 close to the antenna stand 11 is electrically connected to the non-mm-wave antenna feed source assembly 124 via the second opening part 112*b*. By means of the above design, a planar space occupied by the entire antenna structure 12, antenna stand 11, and non-mm-wave antenna feed source assembly 124 is smaller, which is conductive to improving the product competitiveness.

Embodiment IV

As shown in FIG. 11 to FIG. 16, parts, which are the same as those in the solution of Embodiment I, of the solution of the antenna apparatus 100 in this embodiment are not repeatedly described, and descriptions of differences of the antenna apparatus 100 in this embodiment will be emphasized. In Embodiment IV, the antenna structure 12 further includes a mm-wave RFIC 125; the mm-wave RFIC 125 is arranged on the flexible printed circuit board 121 and is located between the antenna structure 12 and the antenna stand 11; and the mm-wave RFIC 125 is electrically connected to the mm-wave antenna 122. The mm-wave RFIC 125 is arranged on the flexible printed circuit board 121, the space utilization rate can be increased, and the antenna performance can be enhanced by use of the height of the antenna stand 11.

The antenna apparatus 100 further includes a first conductive member 14; the antenna stand 11 has an opening 114; the antenna structure 12 covers the opening 114; one end of the first conductive member 14 is arranged on the circuit board 10, and the other end of the first conductive member 14 passes through the opening 114 and is connected to the mm-wave RFIC 125; the mm-wave RFIC 125 includes a mm-wave RFIC main body 126 electrically connected to the mm-wave antenna 122 and a shielding case 126*a* arranged at a periphery of the mm-wave RFIC main body 126; the shielding case 126*a* is electrically connected to the non-mm-wave antenna 123; the mm-wave RFIC main body 126 is electrically connected to the mm-wave antenna 122; the shielding case 126*a* is further grounded via the first conductive member 14; and the first conductive member 14 includes a first metal block. By means of the shielding case 126*a*, the mm-wave RFIC main body 126 can be protected from signal crosstalk, so the reliability is improved, and a relatively good radiation effect is achieved. The first conductive member 14 may further play an isolation role, and can also discharge heat to the outside while it is grounded, so as to reduce the temperature of the antenna apparatus 100 (the mm-wave RFIC main body 126) and maintain the stability of a wireless communication function, thus improving the product performance and the grip comfort of a user.

In this embodiment, the opening 114 may be located on the first supporting part 111 and/or the second supporting part 112. In this embodiment, the shielding case 126*a* directly contacts the non-mm-wave antenna 123 on one side close to the antenna stand 11, so as to be electrically connected to the non-mm-wave antenna 123. A pin 125*a* of the mm-wave RFIC main body 126 may penetrate through the shielding case 126*a* and is electrically connected to the mm-wave antenna 122 via a third via hole 121*i* penetrating through the flexible printed circuit board 121.

The antenna structure 12 further includes a mm-wave antenna connector 127; and the mm-wave antenna connector 127 is arranged on the flexible printed circuit hoard 121 and may be electrically connected to the mm-wave RFIC main body 126 via a line inside the flexible printed circuit board 121. In addition, it may also be convenient for the mm-wave antenna connector 127 to electrically connect the mm-wave antenna 122 and the mm-wave RFIC main body 126 to the circuit board 10, thus achieving the technical effects of convenient assembling, reliable signal transmission, improved placement degree-of-freedom of the mm-wave antenna, and the like.

The mm-wave antenna connector 127 and the mm-wave RFIC 125 may be spaced apart from each other; the antenna stand 11 has a first gap part 110; and at least part of the mm-wave antenna connector 127 is exposed through the first gap part 110 and is used to be connected to another connector. In this embodiment, one side of the second supporting part 112 of the antenna stand 11 may protrude from the first supporting part 111 and the third supporting part 113 so that a side of the second supporting part 112 close to the third supporting part 113 and a side of the first supporting part 111 close to the third supporting part 113 are encircled to form the first gap part 110; and at least part of the mm-wave antenna connector 127 is arranged at the first gap part 110, so as to facilitate connection with another external connector.

The antenna stand 11 has the first gap part 110, and at least part of the mm-wave antenna connector 127 is exposed through the first gap part 110, so as to be used to be connected to another connector. It can be understood that the mm-wave RFIC 125 is arranged on the flexible printed circuit board 121, which can increase the space utilization rate, and the antenna performance can be improved by use of the height of the stand. Furthermore, a path between the mm-wave RFIC 125 and the mm-wave antenna 122 is relatively short, so the power loss on the path may be relatively low, which can improve the radiation performance of the mm-wave antenna 122. In addition, it may also be convenient for the mm-wave antenna connector 127 to electrically connect the mm-wave RFIC 125 and/or the min-wave antenna 122 to the circuit hoard 10 and the like, thus achieving the technical effects of convenient assembling, reliable signal transmission, improved placement degree-of-freedom of the mm-wave antenna, and the like. The design of the first gap part 110 is also conductive to connection of the mm-wave antenna connector 127 to another connector, thus achieving the technical effects of convenient assembling and reliable signal transmission, and the like.

Specifically, a pin of the mm-wave antenna connector 127 may be electrically connected to the mm-wave RFIC main body 126 via a fourth via hole 129*b* penetrating through one of the insulating layers 129, the first conductive line 128, and the like.

In addition, the non-mm-wave antenna 123 located on two sides of the flexible printed circuit board 121 may be electrically connected with each other through the second via hole 129*a*; the non-mm-wave antenna 123 located on the side close to the antenna stand 11 further has a plurality of avoiding regions; the third via hole 121*i* and the fourth via hole 129*b* correspond to the avoiding regions, so as to avoid short-circuit connection between the mm-wave RFIC main body 126 and the mm-wave antenna connector 127.

Embodiment V

Figure 17:
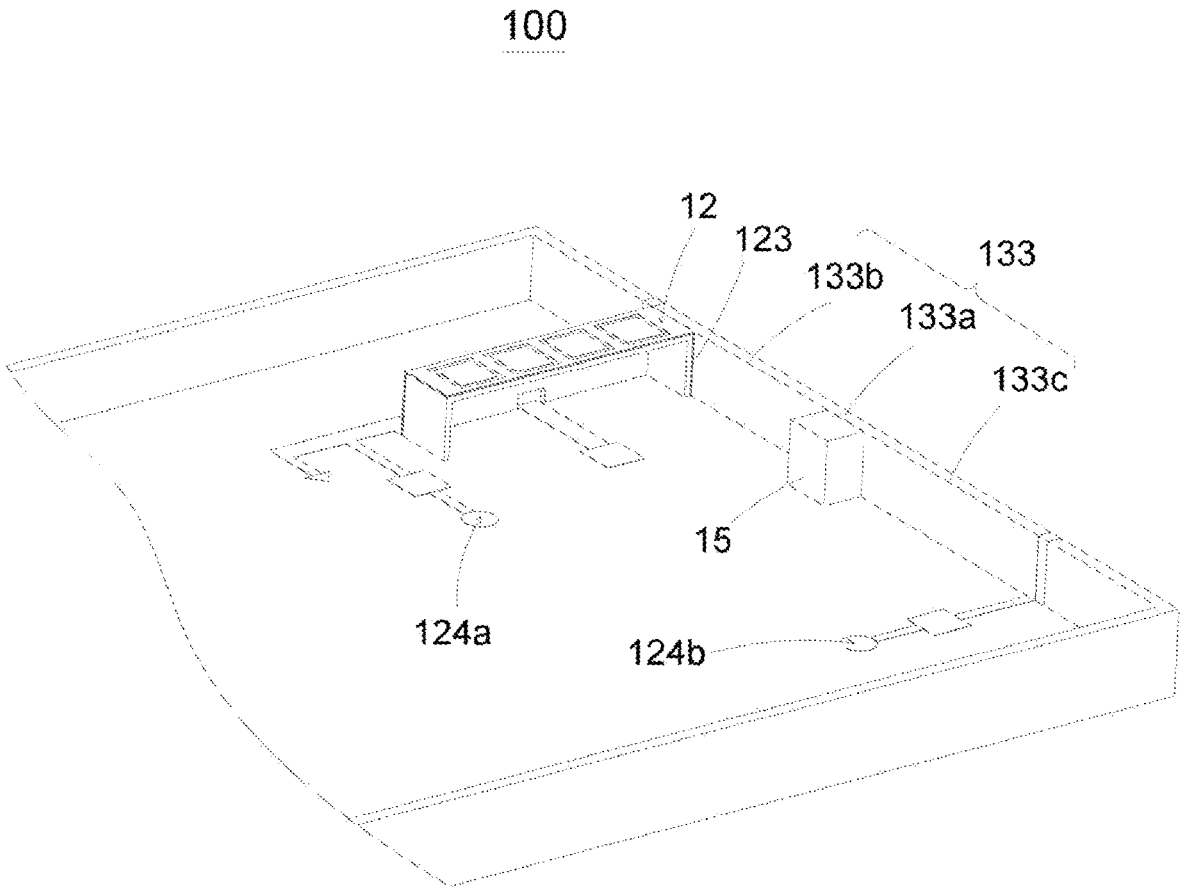
FIG. 17 is a three-dimensional diagram of an antenna apparatus disclosed in Embodiment V of the present disclosure.
Figure 18:
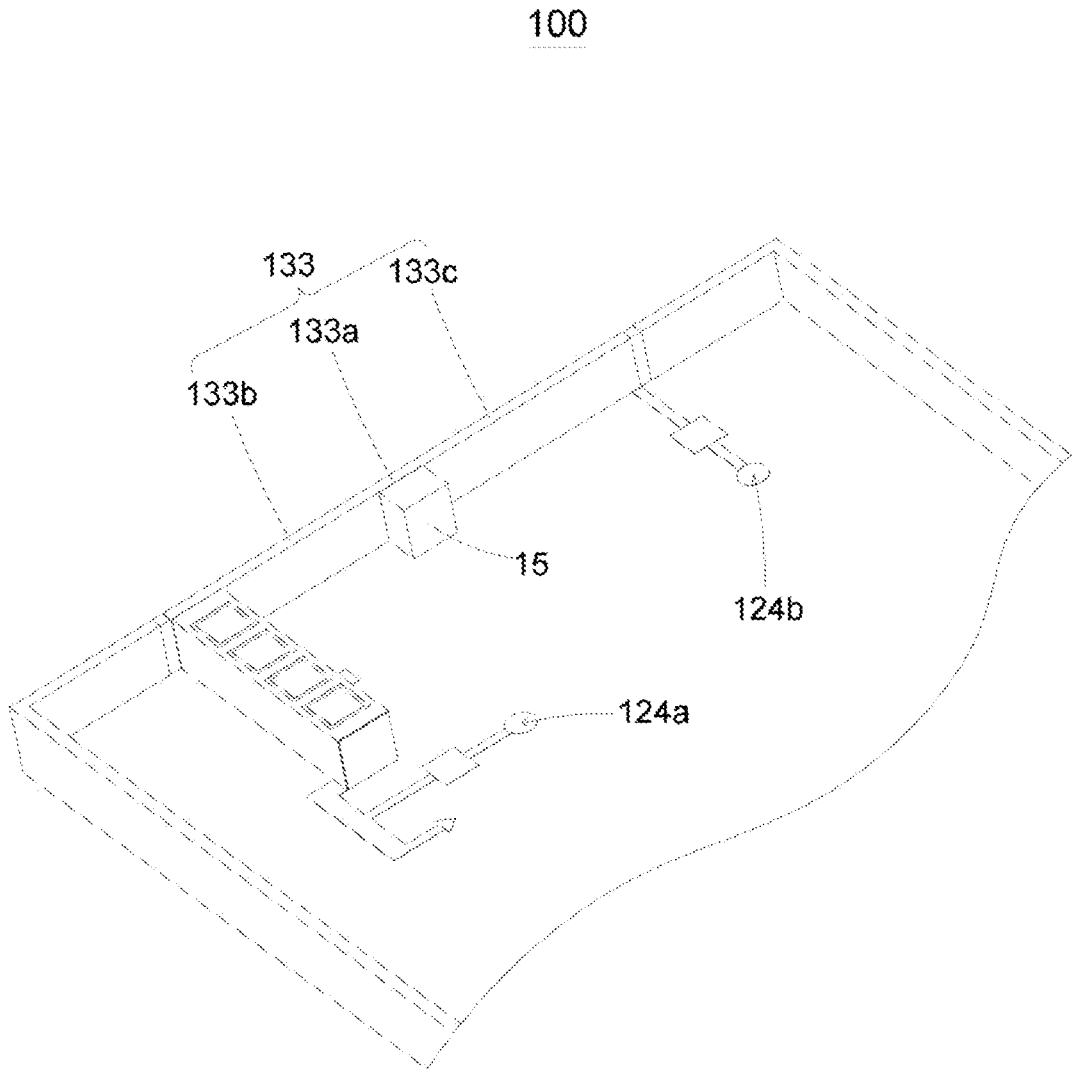
FIG. 18 is an exploded diagram of the antenna apparatus of FIG. 17.

As shown in FIG. 17 to FIG. 18, parts, which are the same as those in the solution of Embodiment I, of the solution of the antenna apparatus 100 in this embodiment are not repeatedly described, and descriptions of differences of the antenna apparatus 100 in this embodiment will be emphasized. In Embodiment V, the antenna part 133 includes a first intermediate part 133*a*, a first antenna part 133*b* connected between the intermediate part 133*a* and the antenna structure 12, and a second antenna part 133*c* connected to an end of the first intermediate part 133*a* away from the first antenna part 133*b*; and the second antenna part 133*c* is grounded or the first intermediate part 133*a* is grounded through the second conductive member 15. The above structure makes the antenna part 133 have various different grounding ways. The antenna design and placement are more flexible, and the structure is simple, easy to realize, and higher in reliability. Specifically, the first antenna part 133*b* is electrically connected with the non-mm-wave antenna 123 of the antenna structure 12. For example, they can directly contact each other to realize electrical connection, so that the antenna part 133 may be used as an extending part of the non-mm-wave antenna 123.

The second conductive member 15 includes a second metal block; the second metal block is arranged on the circuit board 10 and contacts the first intermediate part 133*a*, so as to be electrically connected to the first intermediate part 133*a*; the antenna apparatus 100 includes a first non-mm-wave antenna feed source assembly 124*a* and a second non-mm-wave antenna feed source assembly 124*b*; the first non-mm-wave antenna feed source assembly 124*a* is electrically connected to the non-mm-wave antenna 123; and the second non-mm-wave antenna feed source assembly 124*b* is electrically connected to the second antenna part 133*c*. The first intermediate part 133*a* is grounded through the second conductive member 15, so that a radiation effect of two non-mm-wave antennas can be achieved at the same time, and even a multiple-input and multiple-output (MIMO) effect can be achieved, without increasing the size of the antenna apparatus 100. Therefore, the user experience of the antenna apparatus 100 is relatively high, and the overall competitiveness of the product is relatively high. The second conductive member 15 includes a second metal block so that the second conductive member 15 can further play a role of isolation and electrical connection (such as grounding) to maintain the stability of the wireless communication function, thus improving the product performance.

Embodiment VI

Figure 19:
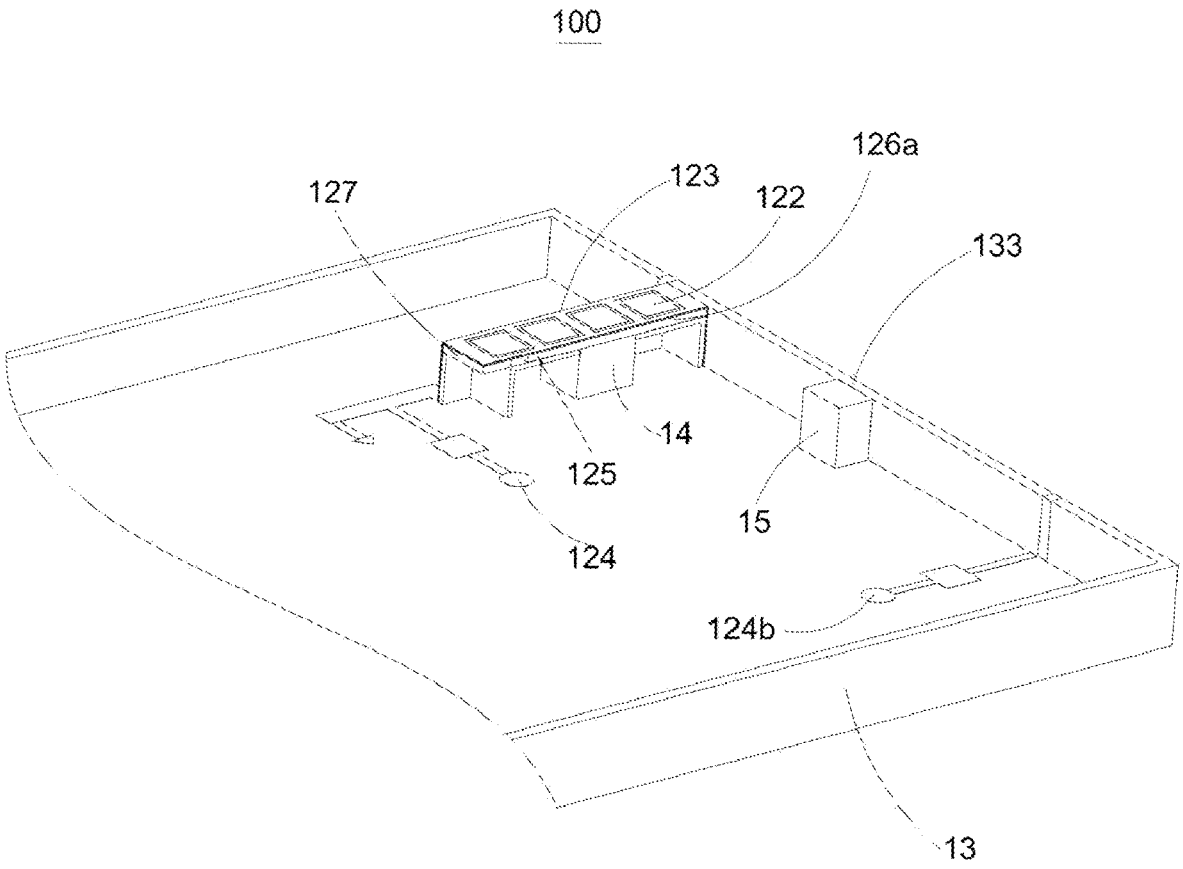
FIG. 19 is a three-dimensional diagram of an antenna apparatus disclosed in Embodiment VI of the present disclosure.
Figure 20:
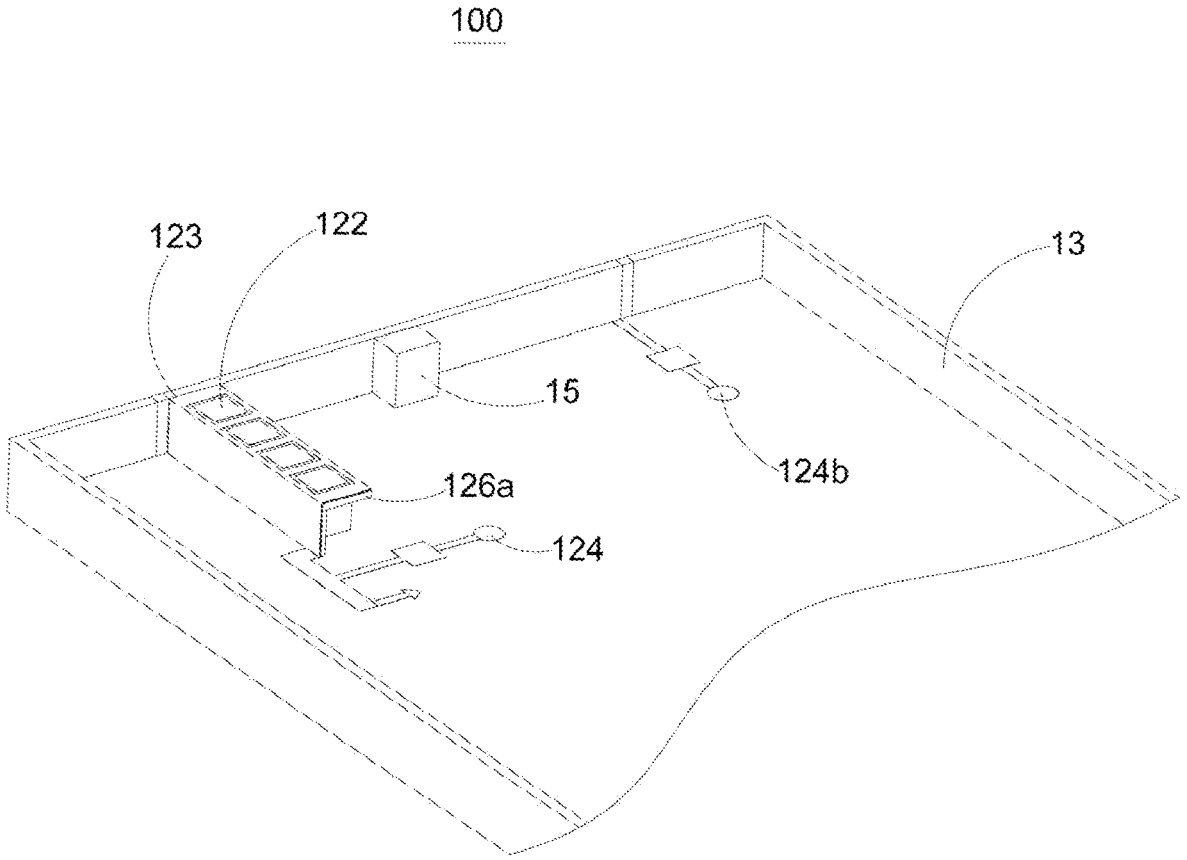
FIG. 20 is a three-dimensional diagram from another view of the antenna apparatus shown in FIG. 19.

As shown in FIG. 19 to FIG. 20, the solution of the antenna apparatus 100 in this embodiment is a combination of Embodiment IV and Embodiment V. In this embodiment, the antenna apparatus 100 includes two non-mm-wave antenna feed source assemblies 124 and a second conductive member 15, so as to achieve a radiation effect of two non-mm-wave antennas. The non-mm-wave antenna feed source assembly 124*b* may also be fed to the antenna part 133 of the housing 13 through a transmission mechanism such as an RF cable, so that the antenna part 133 can be used as an extending part of the non-mm-wave antenna 123. Meanwhile, the antenna structure 12 further includes a mm-wave RFIC 125 and a mm-wave antenna connector 127. At this time, the mm-wave RFIC 125 and the mm-wave antenna 122 are integrated, and a path between them is shorter, so that the power loss on the path is lower, and the radiation performance of the mm-wave antenna 122 can be improved. Meanwhile, the antenna part 133 is grounded through the second conductive member 15, and the shielding case 126*a* is also grounded via the first conductive member 14.

Embodiment VII

Figure 21:
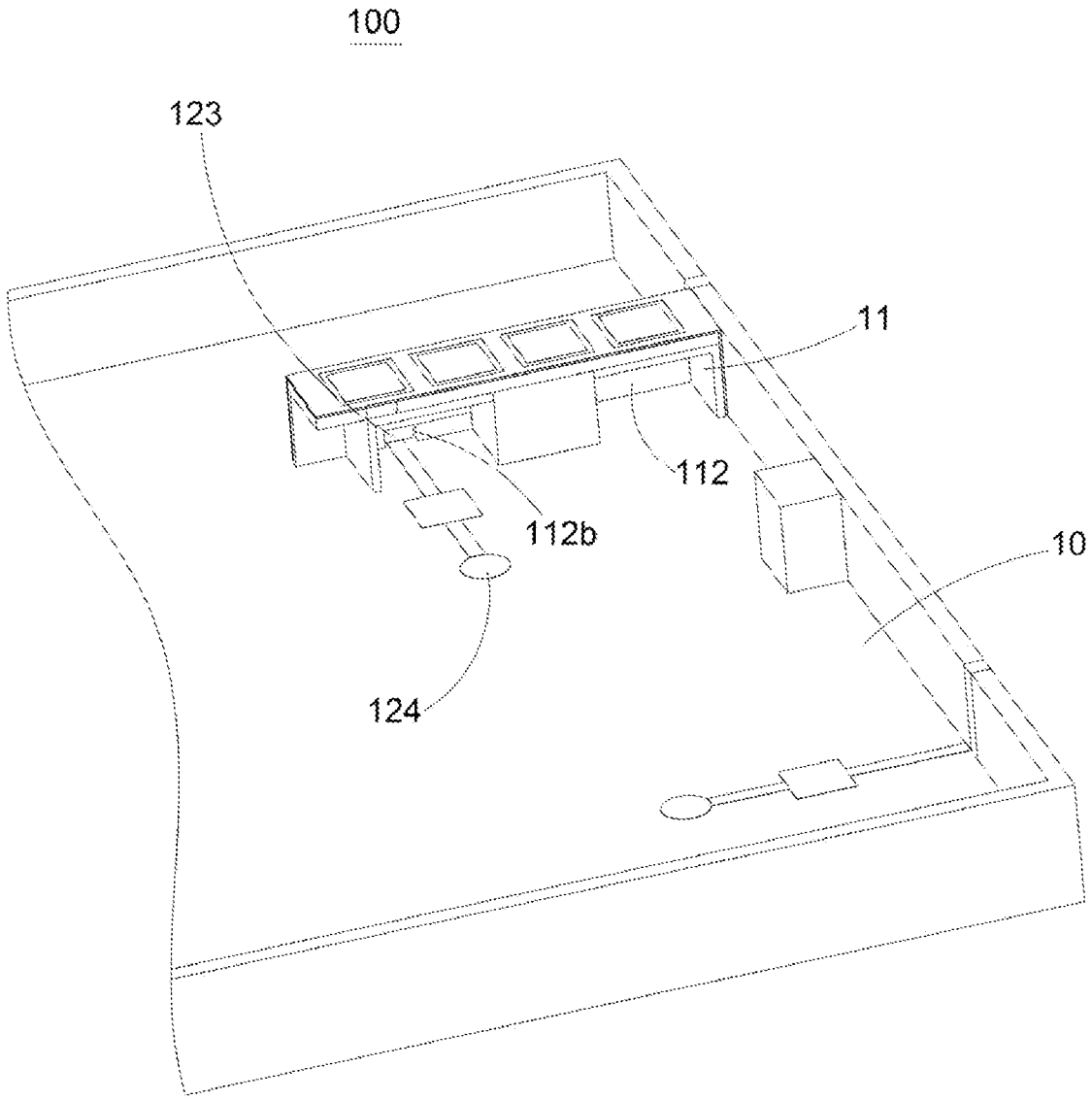
FIG. 21 is a three-dimensional diagram of an antenna apparatus disclosed in Embodiment VII of the present disclosure.
Figure 22:
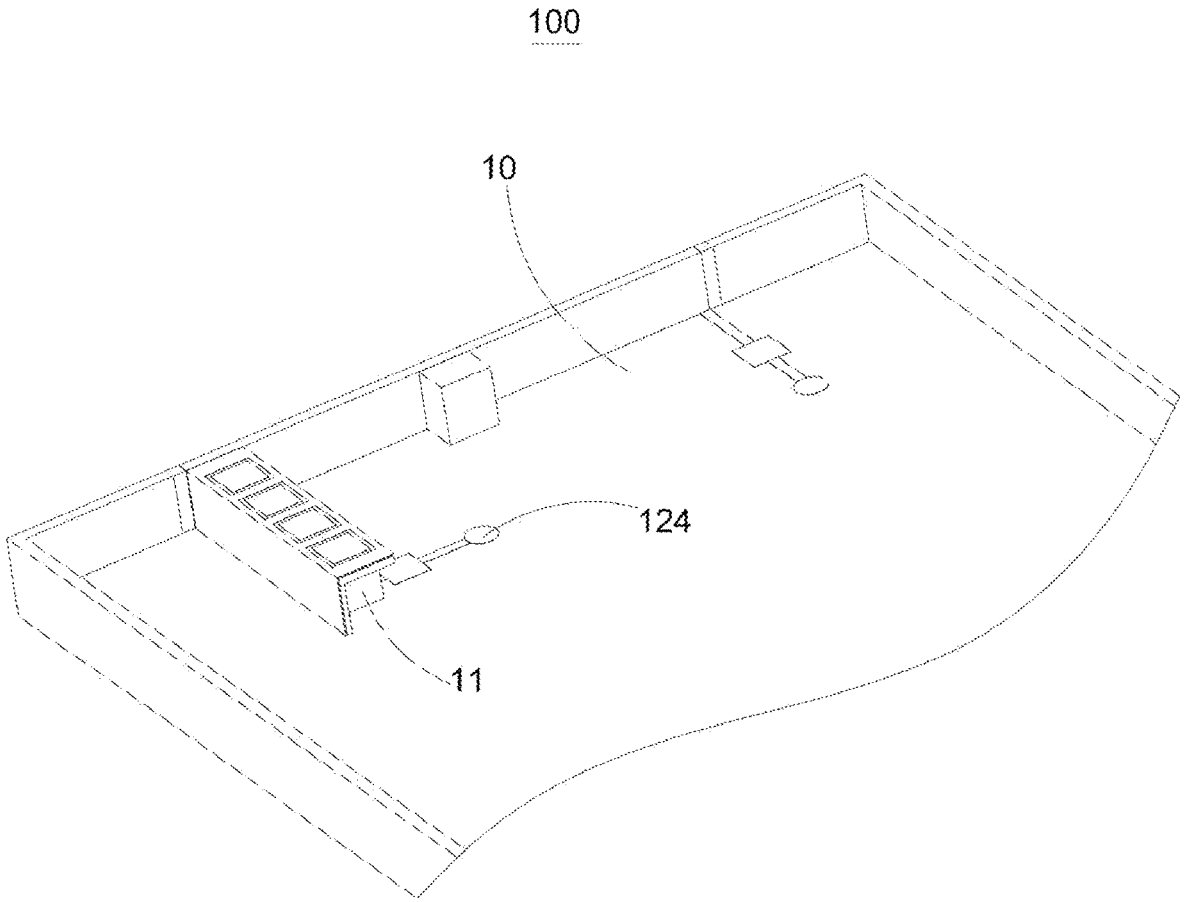
FIG. 22 is a three-dimensional diagram from another view of the antenna apparatus shown in FIG. 21.

As shown in FIG. 21 to FIG. 22, parts, which are the same as those in the solution of Embodiment VI, of the solution of the antenna apparatus 100 in this embodiment are not repeatedly described, and descriptions of differences of the antenna apparatus 100 in this embodiment will be emphasized. In Embodiment VII, the second supporting part 112 is provided with a second opening part 112*b*; at least part of the non-mm-wave antenna feed source assembly 124 is accommodated in the accommodating space encircled by the antenna stand 11 and the circuit board 10; the non-mm-wave antenna 123 is electrically connected to the non-mm-wave antenna feed source assembly 124 via the second opening part 112*b*, which is conductive to making the relevant layout of the non-mm-wave antenna 123 more compact.

Embodiment VIII

Figure 23:
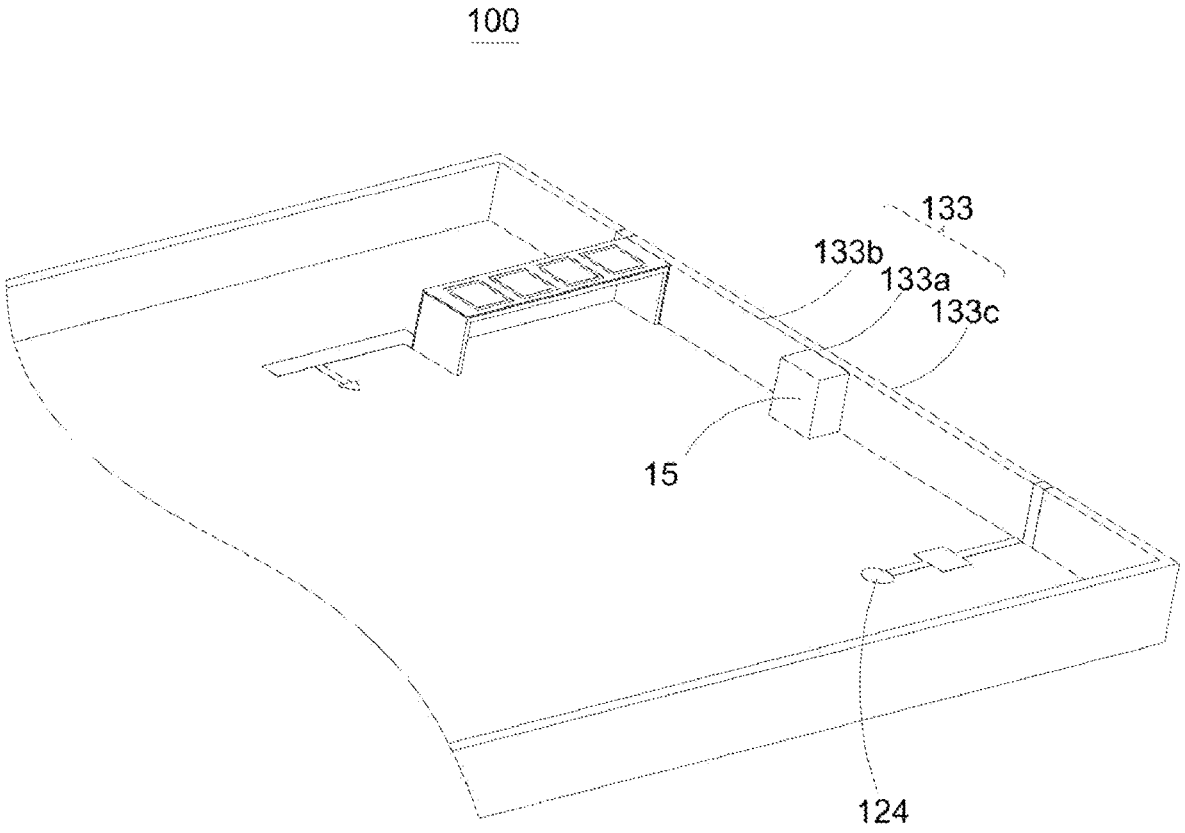
FIG. 23 is a three-dimensional diagram of an antenna apparatus disclosed in Embodiment VIII of the present disclosure.
Figure 24:
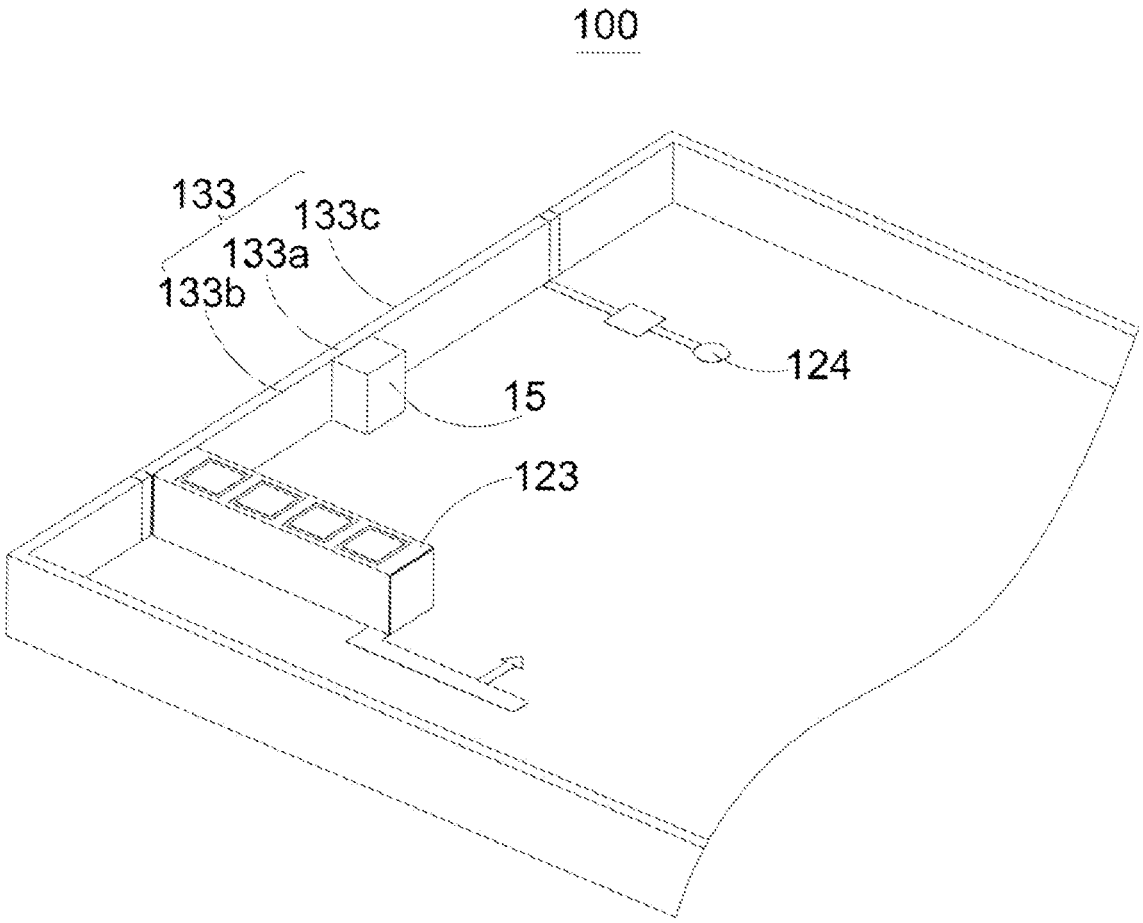
FIG. 24 is a three-dimensional diagram from another view of the antenna apparatus shown in FIG. 23.

As shown in FIG. 23 to FIG. 24, parts, which are the same as those in the solution of Embodiment II, of the solution of the antenna apparatus 100 in this embodiment are not repeatedly described, and descriptions of differences of the antenna apparatus 100 in this embodiment will be emphasized. In Embodiment VIII, the antenna part 133 includes a first intermediate part 133*a*, a first antenna part 133*b* connected between the intermediate part 133*a* and the antenna structure 12, and a second antenna part 133*c* connected to an end of the first intermediate part 133*a* away from the first antenna part 133*b*; and the first intermediate part 133*a* is grounded through the second conductive member 15. One non-mm-wave antenna feed source assembly 124 is provided.

The non-mm-wave antenna feed source assembly 124 is not directly connected to the non-mm-wave antenna 123, but is electrically connected to the second antenna part 133*c*.

Embodiment IX

Figure 25:
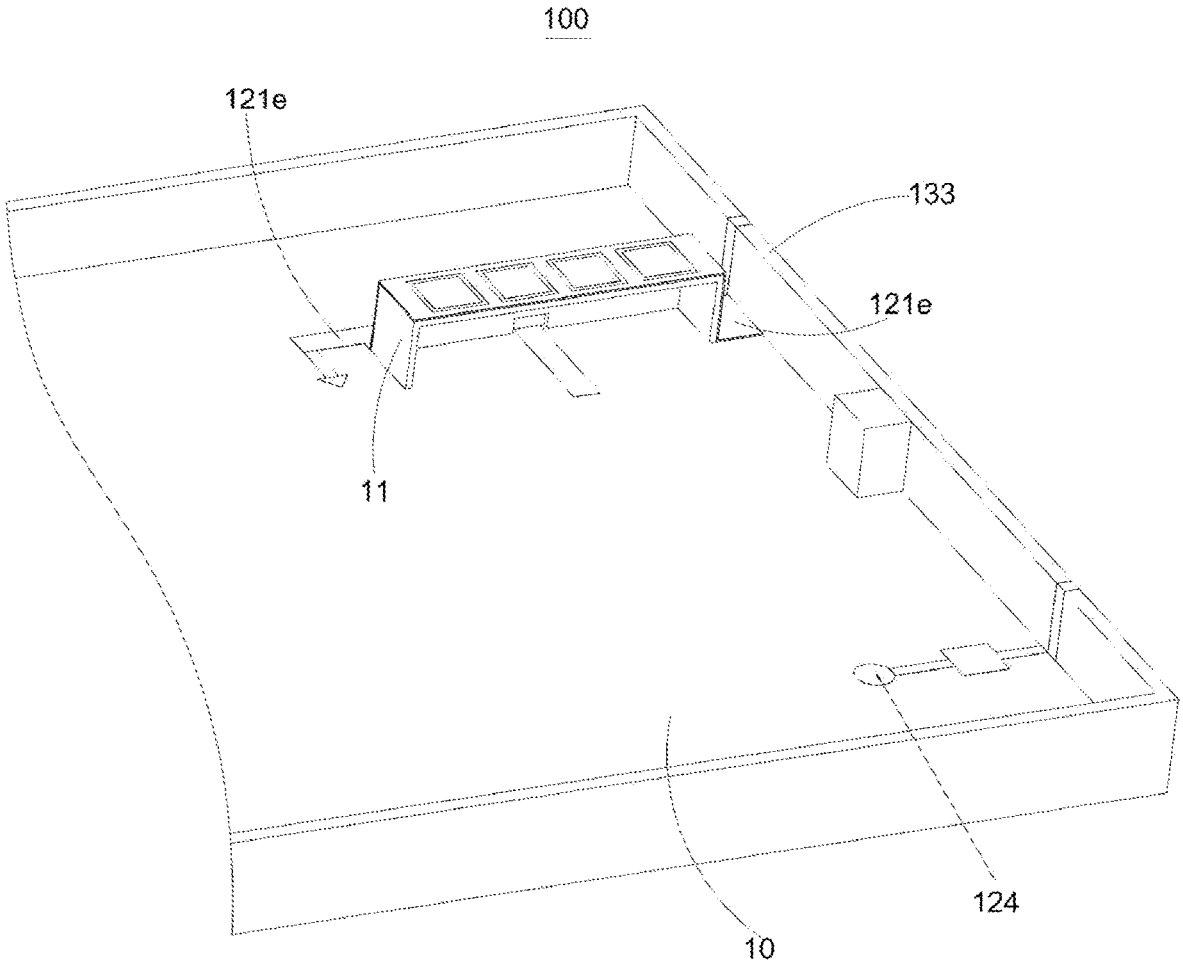
FIG. 25 is a three-dimensional diagram of an antenna apparatus disclosed in Embodiment IX of the present disclosure.
Figure 26:
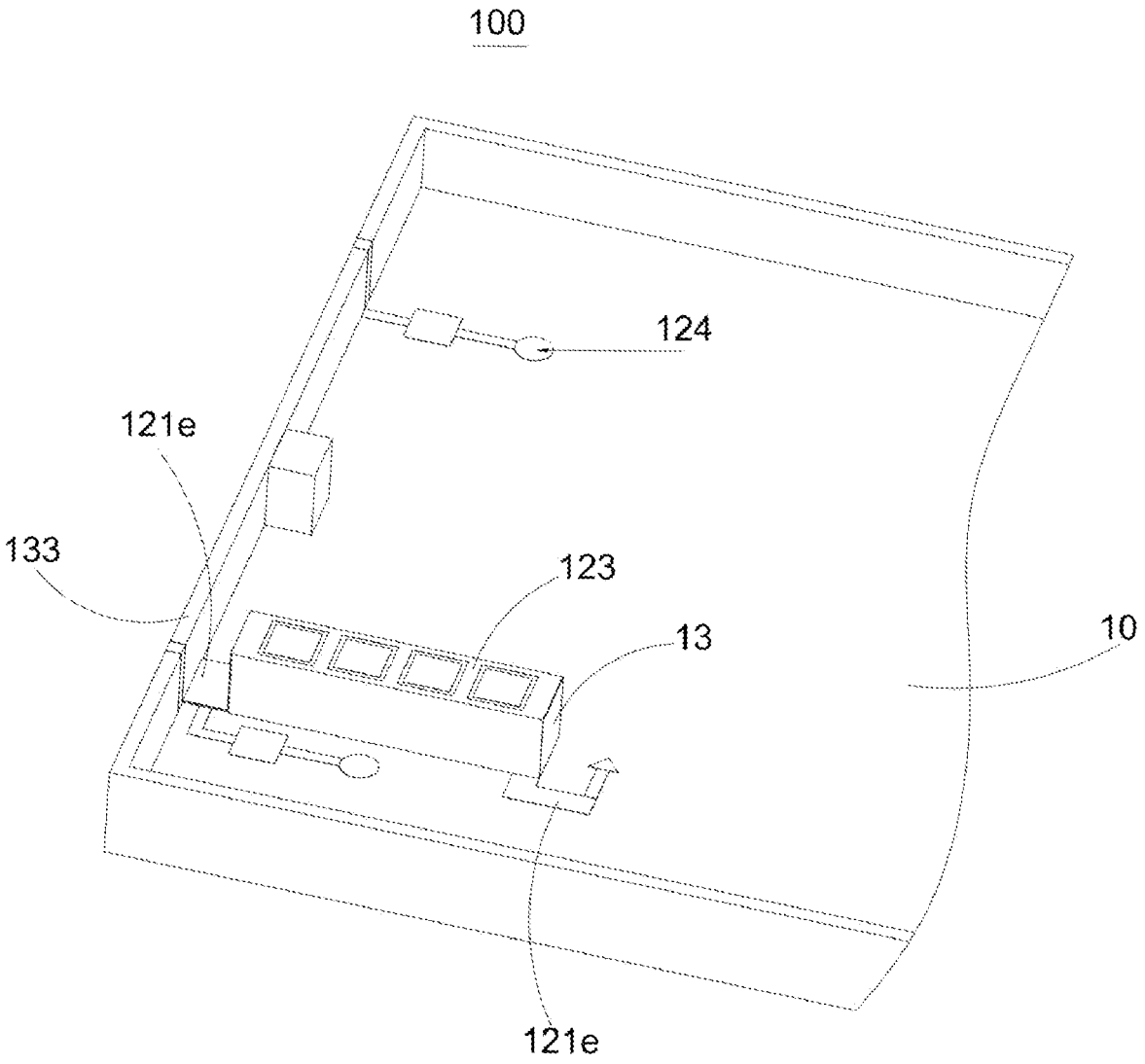
FIG. 26 is a three-dimensional diagram from another view of the antenna apparatus shown in FIG. 25.
Figure 27:
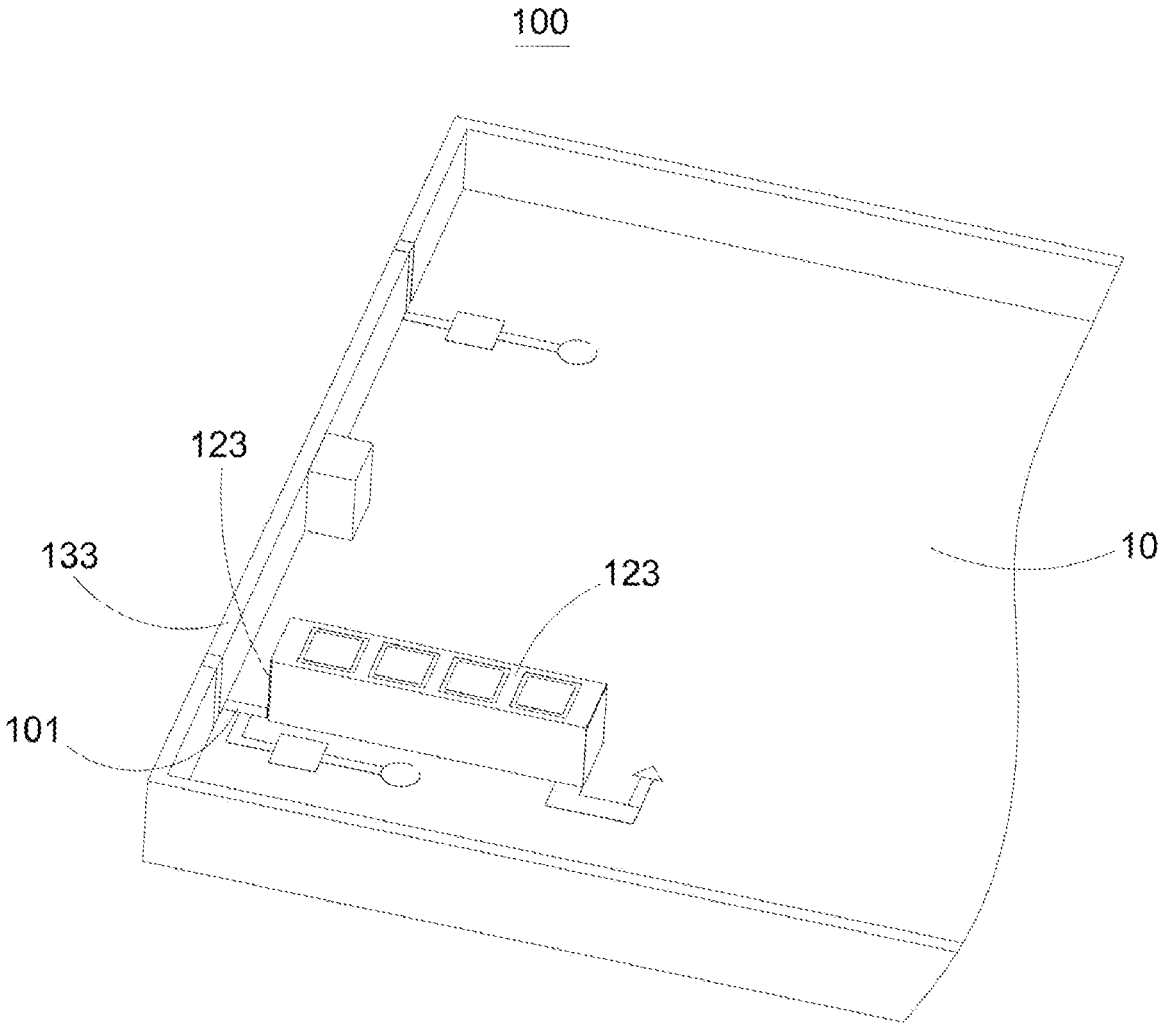
FIG. 27 is a three-dimensional diagram of a change embodiment of the antenna apparatus shown in FIG. 25.

As shown in FIG. 25 to FIG. 26, parts, which are the same as those in the solution of Embodiment V, of the solution of the antenna apparatus 100 in this embodiment are not repeatedly described, and descriptions of differences of the antenna apparatus 100 in this embodiment will be emphasized. In Embodiment IX, a gap is reserved between the antenna stand 11 and the antenna part 133; the non-mm-wave antenna 123 is electrically connected to the antenna part 133 through one second sub-part 121*e* superposed with the circuit board 10; the second sub-part 121*e* is further electrically connected to one non-mm-wave antenna feed source assembly 124; and the non-mm-wave antenna 123 is further grounded via the other second sub-part 121*e* superposed with the circuit board 10. It can be understood that the second sub-part 121*e* may be provided with a transmission line, so that the non-mm-wave antenna 123 is electrically connected to the antenna part 133 and the non-mm-wave antenna feed source assembly 124. The design of this embodiment can increase the design degree-of-freedom of the antenna apparatus 100 and can increase the degree-of-freedom of system stacking and improve the product competitiveness. In addition, as shown in FIG. 27, in one change embodiment, the non-mm-wave antenna 123 may also be electrically connected with an inner side of the antenna part 133 through the transmission line 101 on the circuit board 10, thus increasing the degree-of-freedom of stacking of the apparatus and improving the product competitiveness.

Embodiment X

Figure 28:
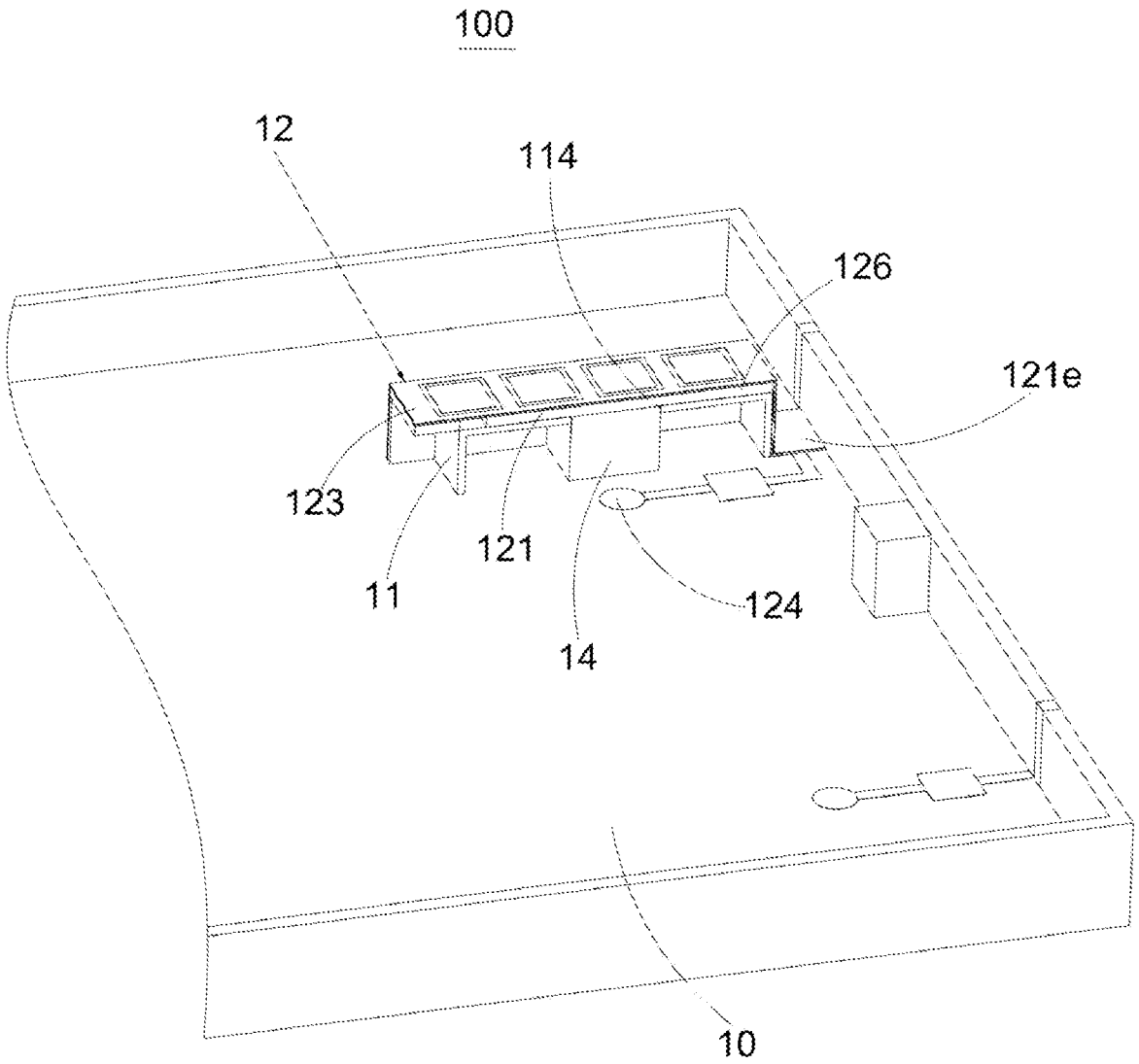
FIG. 28 is a three-dimensional diagram of an antenna apparatus disclosed in Embodiment X of the present disclosure.
Figure 29:
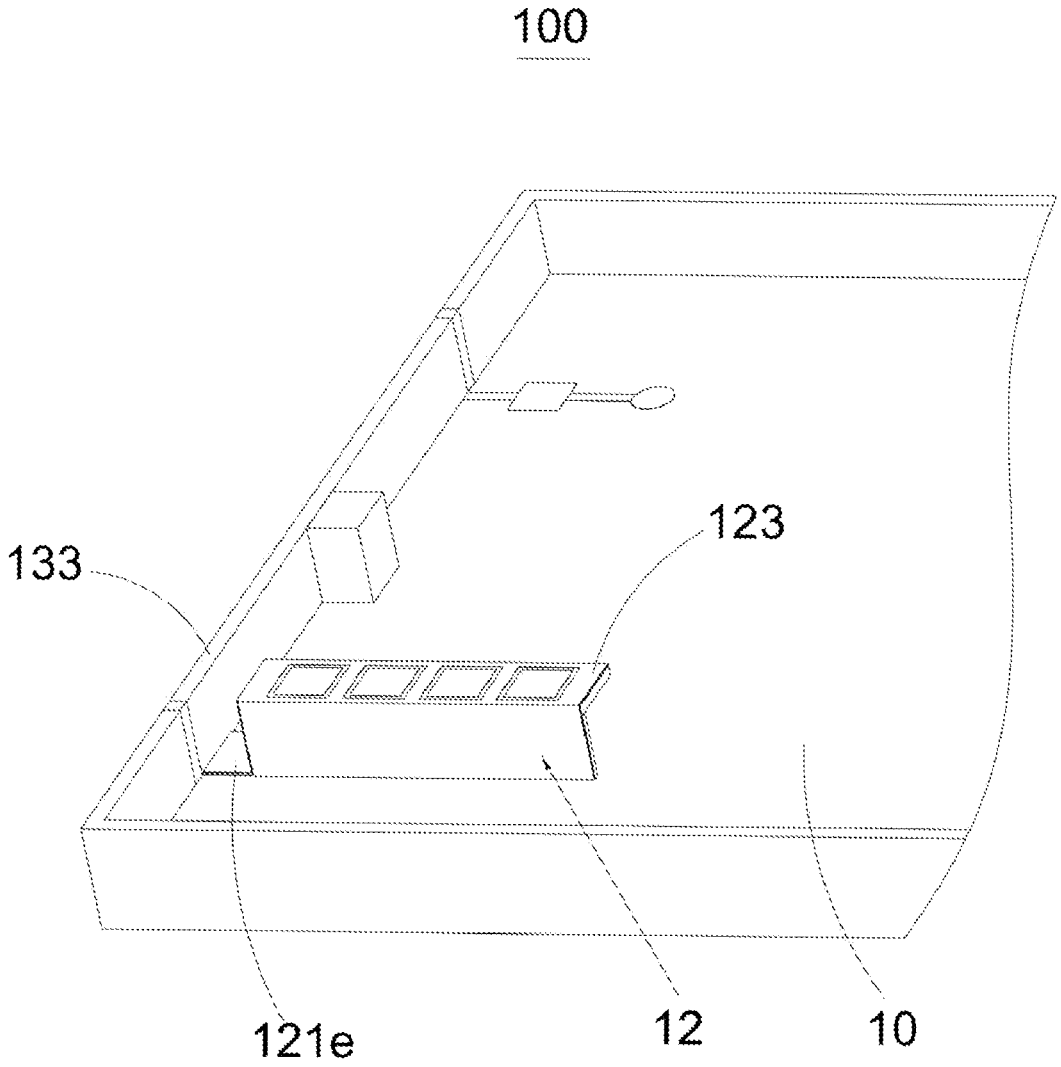
FIG. 29 is a three-dimensional diagram from another view of the antenna apparatus shown in FIG. 28.

As shown in FIG. 28 to FIG. 29, parts, which are the same as those in the solution of Embodiment IX, of the solution of the antenna apparatus 100 in this embodiment are not repeatedly described, and descriptions of differences of the antenna apparatus 100 in this embodiment will be emphasized. In Embodiment X, the antenna structure 12 further includes a mm-wave RFIC 125. The mm-wave RFIC 125 is arranged on the flexible printed circuit board 121 and is located between the antenna structure 12 and the antenna stand 11. The antenna apparatus 100 further includes a first conductive member 14; the antenna stand 11 has an opening 114; the antenna structure 12 covers the opening 114; one end of the first conductive member 14 is arranged on the circuit board 10, and the other end of the first conductive member 14 passes through the opening 114 and is connected with the shielding case 126*a* of the mm-wave RFIC 125, so as to be electrically connected to the non-mm-wave antenna 123. The specific structure of the mm-wave RFIC 125 is as described in Embodiment IV, and descriptions thereof are omitted. The non-mm-wave antenna 123 is electrically connected with the antenna part 133 and the non-mm-wave antenna feed source assembly 124 via one second sub-part 121*e* superposed with the circuit board 10. In addition, the non-mm-wave antenna 123 may also be electrically connected to an inner side of the antenna part 133 though a transmission line on the circuit board 10, thus increasing the degree-of-freedom of stacking of the apparatus.

Embodiment XI

Figure 30:
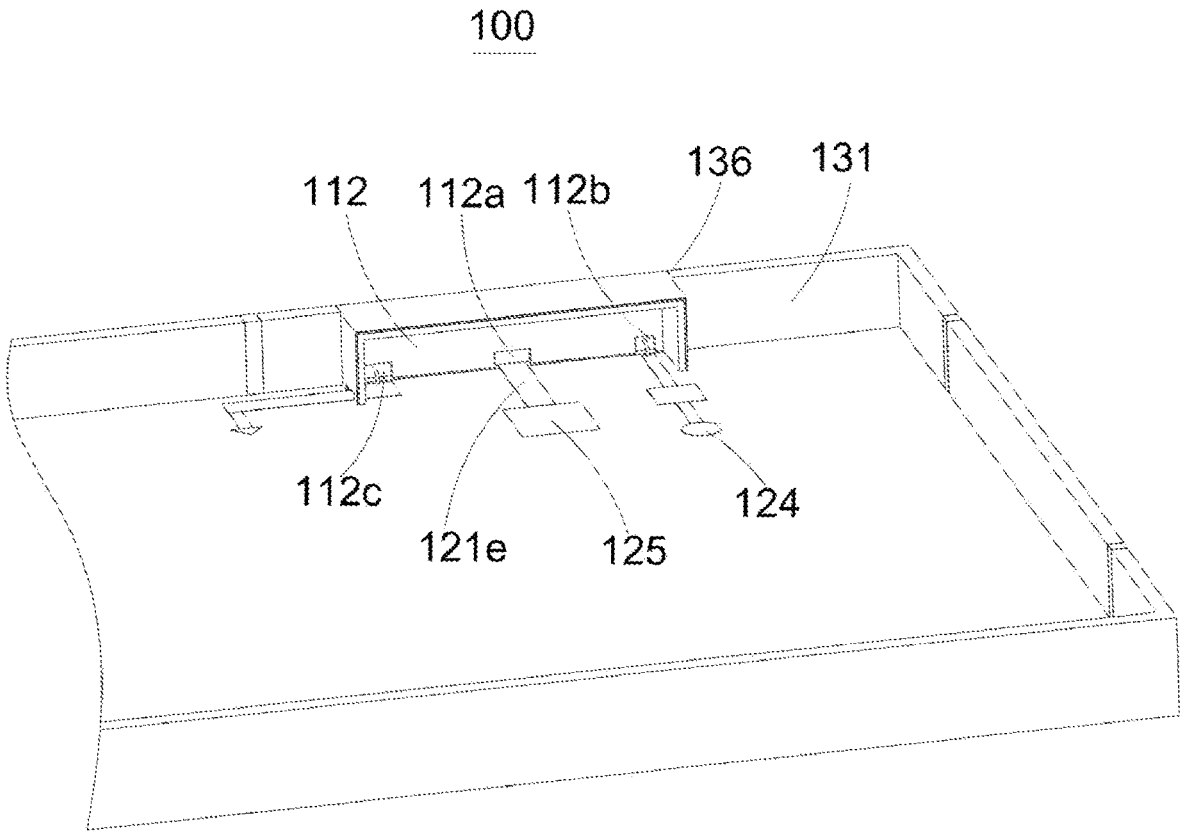
FIG. 30 is a three-dimensional diagram of an antenna apparatus disclosed in Embodiment XI of the present disclosure.
Figure 31:
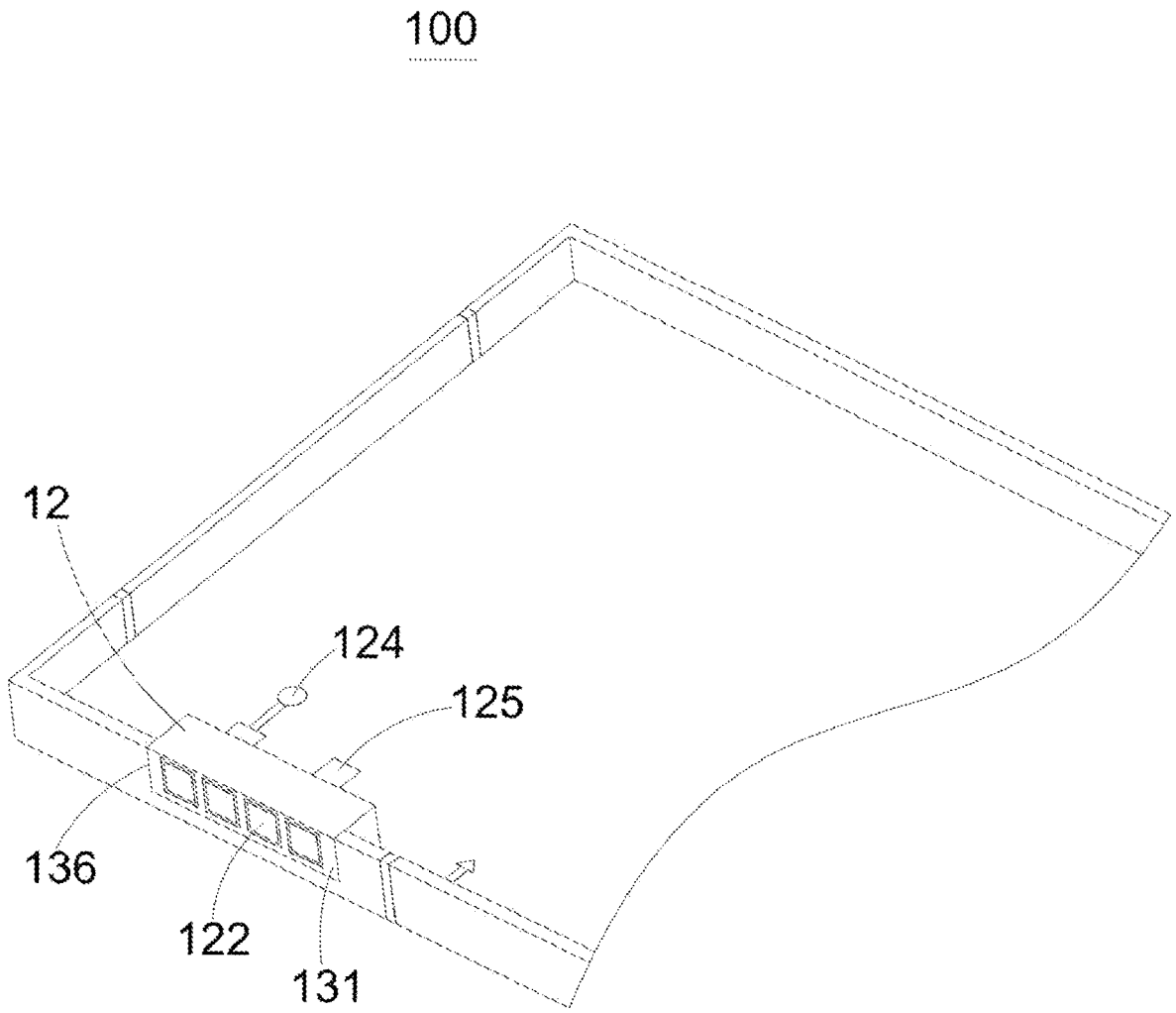
FIG. 31 is a three-dimensional diagram from another view of the antenna apparatus shown in FIG. 30.

As shown in FIG. 30 to FIG. 31, parts, which are the same as those in the solution of Embodiment I, of the solution of the antenna apparatus 100 in this embodiment are not repeatedly described, and descriptions of differences of the antenna apparatus 100 in this embodiment will be emphasized. In Embodiment XI, the side wall structure 131 includes a gap 136 penetrating through the side wall structure 131, and at least part of the antenna structure 12 is located in the gap 136.

Figure 32:
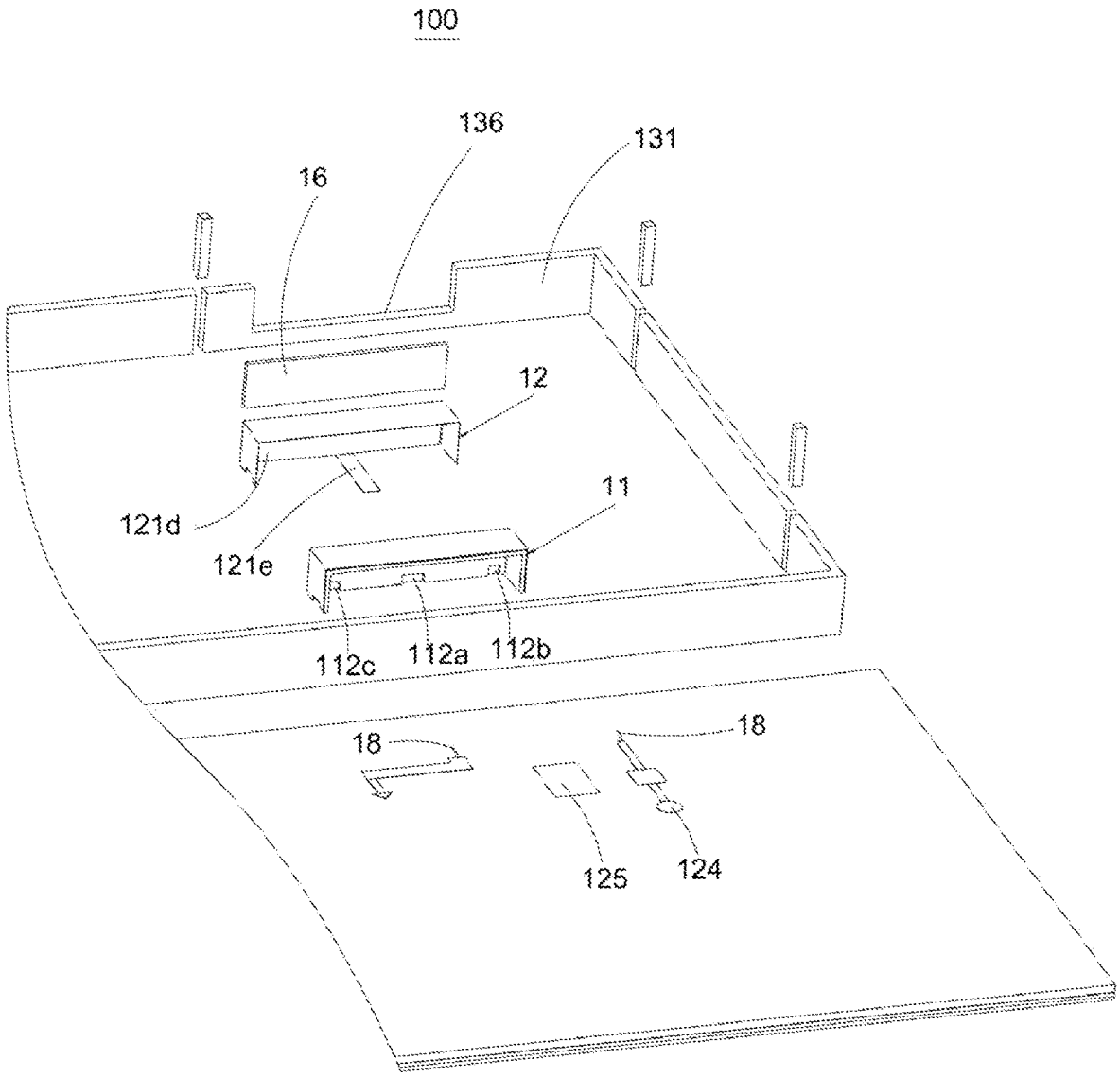
FIG. 32 is an exploded diagram of a change embodiment of the antenna apparatus shown in FIG. 30.

Further, as shown in FIG. 32, in one embodiment, the antenna apparatus 100 further includes a decorative member 16. At least part of the mm-wave antenna 122 and/or the non-mm-wave antenna 123 corresponds to the gap 136; and the decorative member 16 is located in the gap 136 and covers at least part of the mm-wave antenna 122 and/or the non-mm-wave antenna 123. Since at least part of the antenna structure 12 is arranged in the gap 136, stable and reliable assembling of the antenna structure 136 and the housing 13 can be realized, and the gap 136 can also avoid an antenna signal from being shielded, which enhances the wireless communication experience. Further, the decorative member 16 can not only protect the antenna structure 12, avoid damage, and improve the reliability, but also improve the appearance beauty of the electronic device using the antenna apparatus 100 and improve the product competitiveness. The decorative member 16 may be glass, plastic, and the like, as long as it does not shield transmission and receiving of the antenna signal. In addition, it can be understood that the decorative member 16 may also be omitted according to an actual need.

Further, the second supporting part 112 of the antenna stand 11 is provided with a first opening part 112*a*, a second opening part 112*b*, and a third opening part 112*c*; the second sub-part 121*e* of the flexible printed circuit board 121 passes through the first opening part 112*a* and is electrically connected to the mm-wave RFIC 125; the first sub-part 121*d* is electrically connected to the non-mm-wave antenna feed source assembly 124 via the second opening part 112*b*, so that the non-mm-wave antenna 123 is electrically connected to the non-mm-wave antenna feed source assembly 124; the first sub-part 121*d* is further connected with a ground line via the third opening part 112*c*, so that the non-mm-wave antenna 123 is grounded; and the mm-wave RFIC 125 is located between the non-mm-wave antenna feed source assembly 124 and the ground line.

Much further, the first sub-part 121*d* may also be electrically connected to the non-mm-wave antenna feed source assembly 124 via the second opening part 112*b* and through an electrical connection member 18 (such as in a manner of clip butting); and the first sub-part 121*d* is further connected with the ground line via the third opening part 112*c* and through another electrical connection member 18 (in a manner of clip butting). The first sub-part 121*d* and the non-mm-wave antenna feed source assembly 124 are electrically connected through the electrical connection member 18, which can increase the design degree-of-freedom of the antenna apparatus 100 and improve the product competitiveness.

Figure 33:
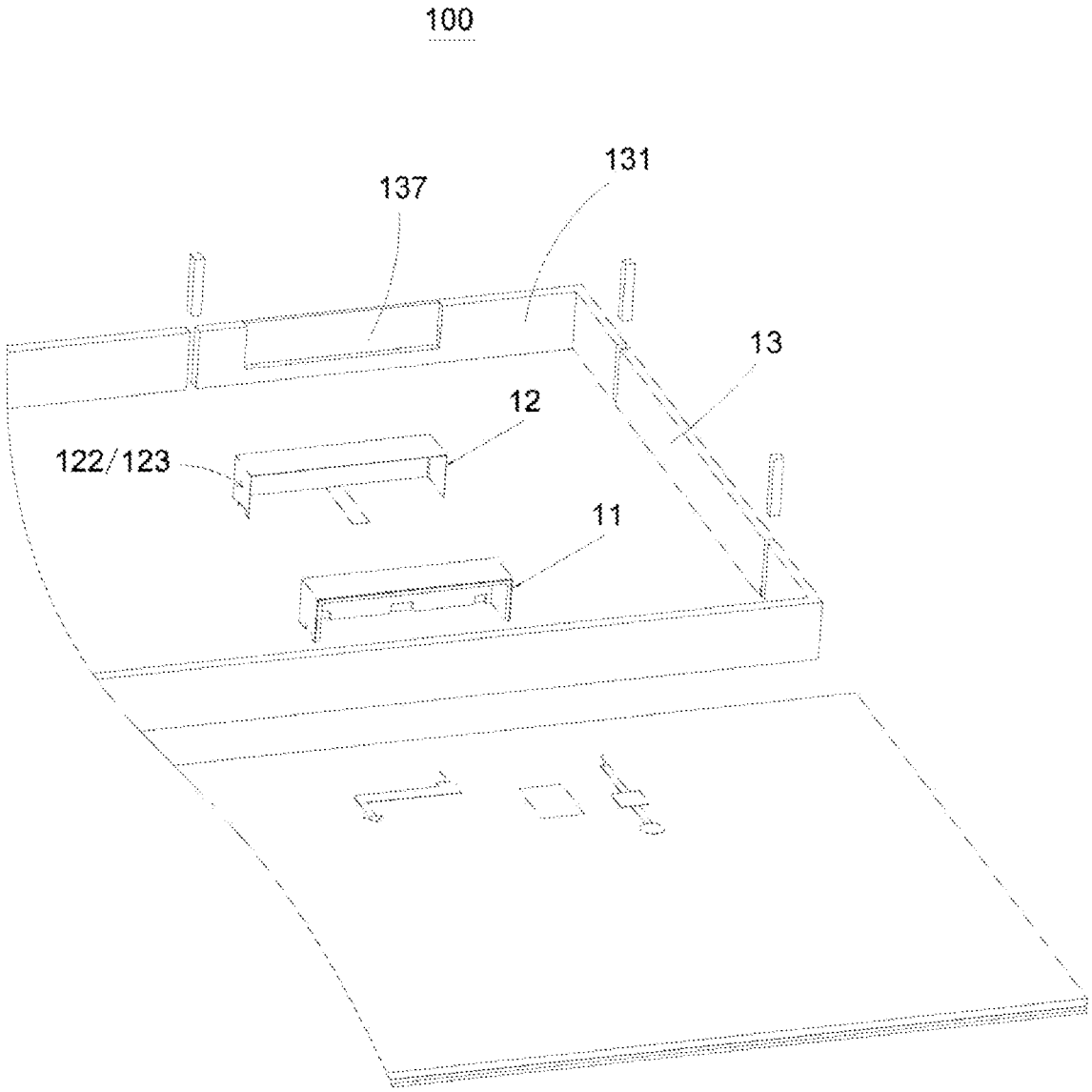
FIG. 33 is an exploded diagram of another change embodiment of the antenna apparatus shown in FIG. 30.

In this embodiment, the side wall structure 131 includes a run-through gap 136. However, as shown in FIG. 33, in the change embodiment, the side wall structure 131 may also be provided with a groove 137 on the inner side; and at least part of the mm-wave antenna 122 and at least part of the non-mm-wave antenna 123 correspond to the groove 137. At least part of the antenna structure 12 is arranged in the groove 137, which can realize stable and reliable assembling of the antenna structure 12 and the housing 13; furthermore, the groove 137 can also reduce shielding of an antenna signal, which enhances the wireless communication experience; the groove 137 can also protect the antenna structure 12, avoid damage, and improve the reliability and can also improve the appearance beauty of the electronic device using the antenna apparatus 100 and improve the product competitiveness.

Embodiment XII

Figure 34:
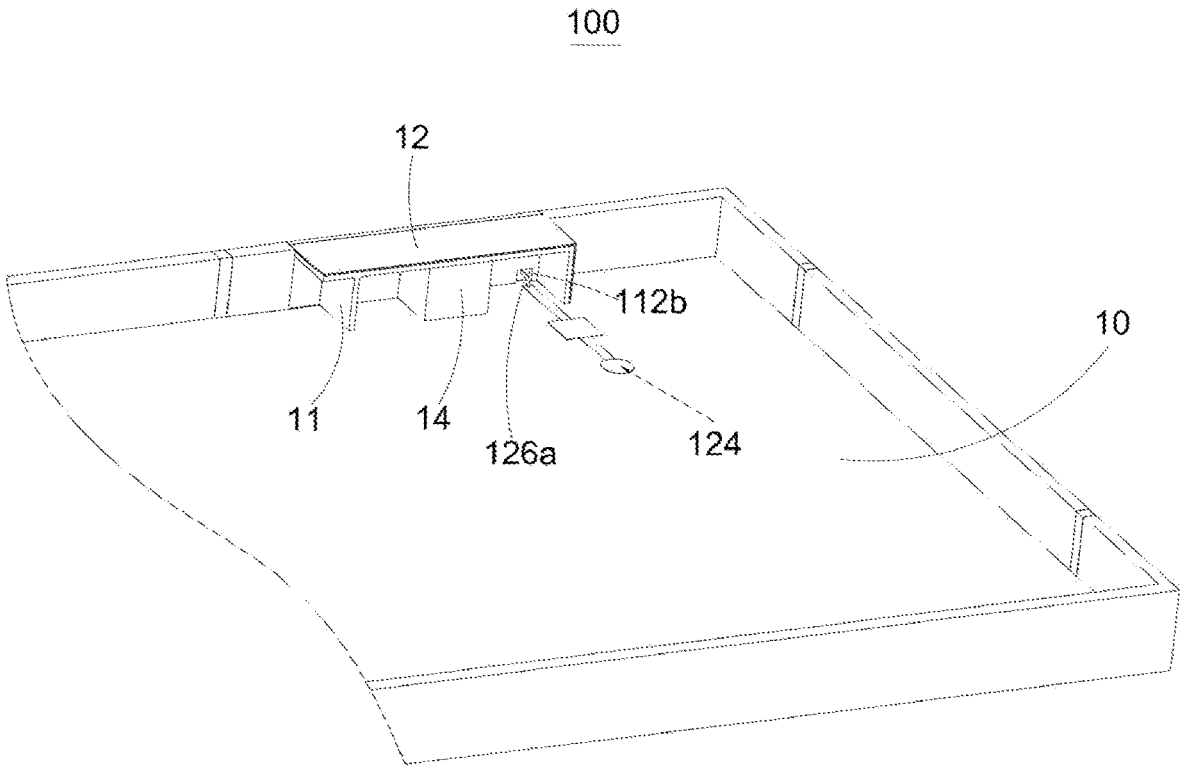
FIG. 34 is a three-dimensional diagram of an antenna apparatus disclosed in Embodiment XII of the present disclosure.
Figure 35:
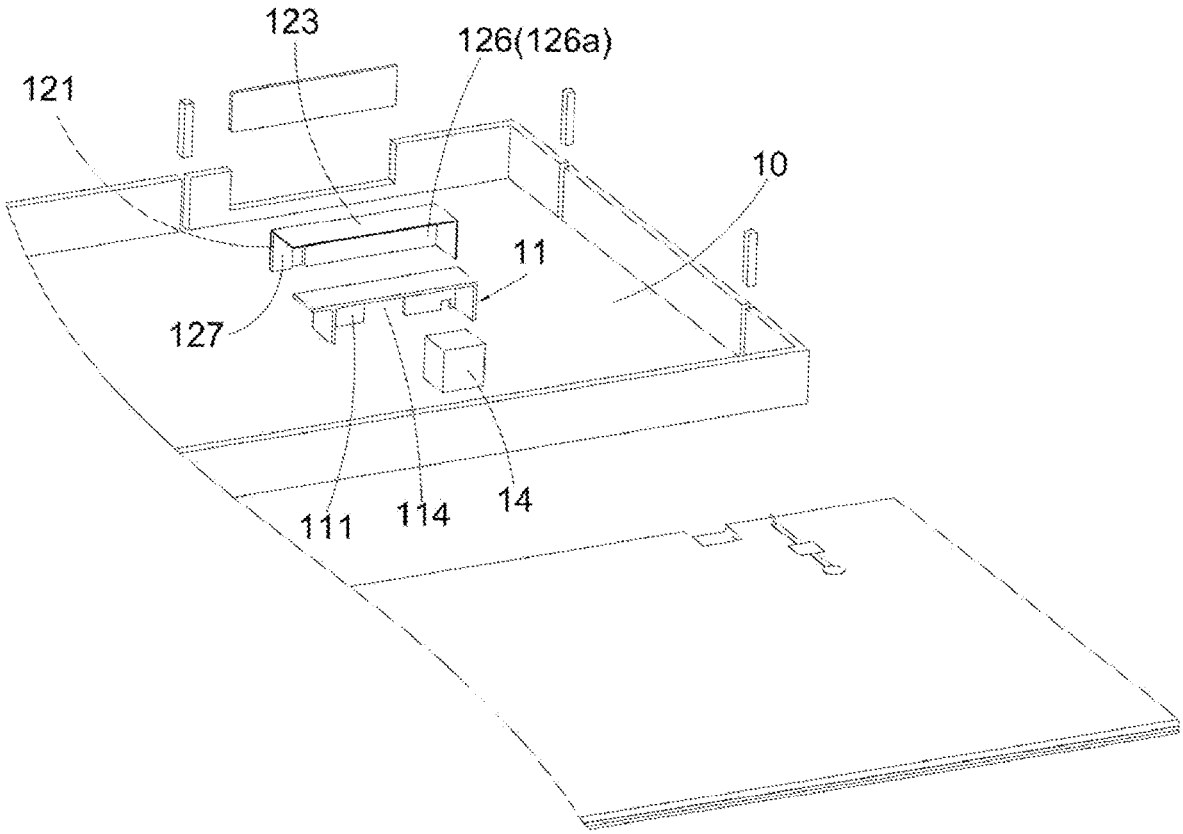
FIG. 35 is a three-dimensional diagram from another view of the antenna apparatus shown in FIG. 34.

As shown in FIG. 34 to FIG. 35, the solution of the antenna apparatus 100 in this embodiment combines the solution in Embodiment XI and the solution in Embodiment IV. The same parts will not be repeatedly described. Key points of the antenna apparatus 100 in this embodiment will be emphasized. In Embodiment XII, the antenna structure 12 includes a mm-wave RFIC 125 and a mm-wave antenna connector 127; the mm-wave RFIC 125 and the mm-wave antenna connector 127 are disposed on the flexible printed circuit board 121 at an interval, and the mm-wave RFIC 125 is located between the flexible printed circuit board 121 and the antenna stand 11; and the antenna apparatus 100 further includes a first conductive member 14 which is arranged on the circuit board 10 and is connected to the shielding case 126*a* of the mm-wave RFIC 125 via the opening 114 of the antenna stand 11, so as to be electrically connected to the non-mm-wave antenna 123 on the flexible printed circuit board 121 via the shielding case 126*a*. The specific structures and effects of the mm-wave RFIC 125 and the first conductive member 14 are as described in Embodiment IV, and descriptions thereof are omitted.

The antenna stand 11 is further provided with a second opening part 112*b*; the shielding case 126*a* is electrically connected to the non-mm-wave antenna feed source assembly 124 via the second opening 112*b*, so that the non-mm-wave antenna 123 is electrically connected to the non-mm-wave antenna feed source assembly 124 via the shielding case 126*a* and the second opening part 112*b*.

Embodiment XIII

Figure 36:
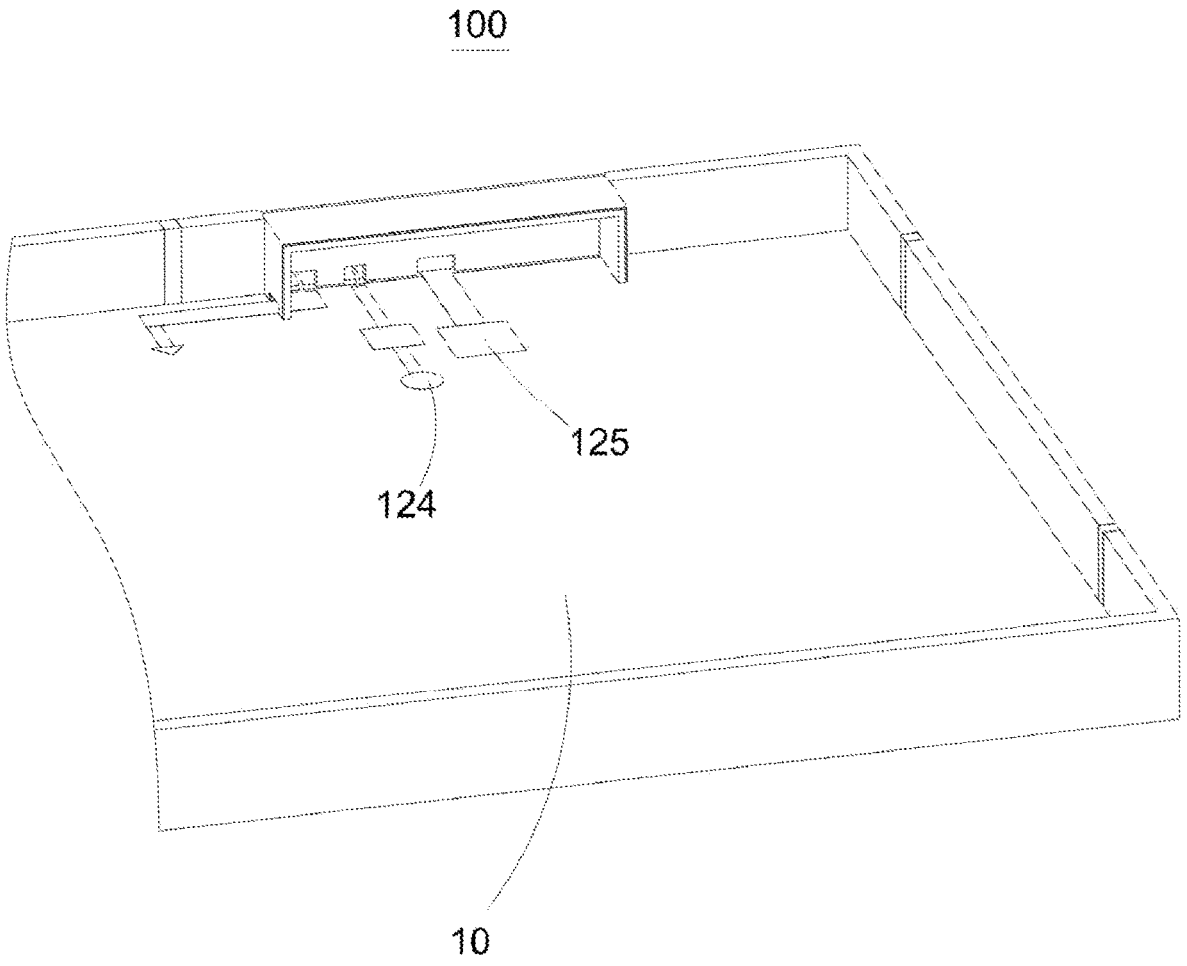
FIG. 36 is a three-dimensional diagram of an antenna apparatus disclosed in Embodiment XIII of the present disclosure.

As shown in FIG. 36, parts, which are the same as those in the solution of Embodiment XI, of the solution of the antenna apparatus 100 in this embodiment are not repeatedly described, and descriptions of differences of the antenna apparatus 100 in this embodiment will be emphasized. A difference between Embodiment XIII and Embodiment XI mainly lies in: the mm-wave RFIC 125, the non-mm-wave antenna feed source assembly 124, and the ground line of the circuit board 10 are adjacent to one another; the non-mm-wave antenna feed source assembly 124 is located between the mm-wave RFIC 125 and the circuit board 10. The above design can embody the degree-of-freedom of the design of the antenna apparatus 100 and the flexibility of placement of elements of the apparatus.

Embodiment XIV

Figure 37:
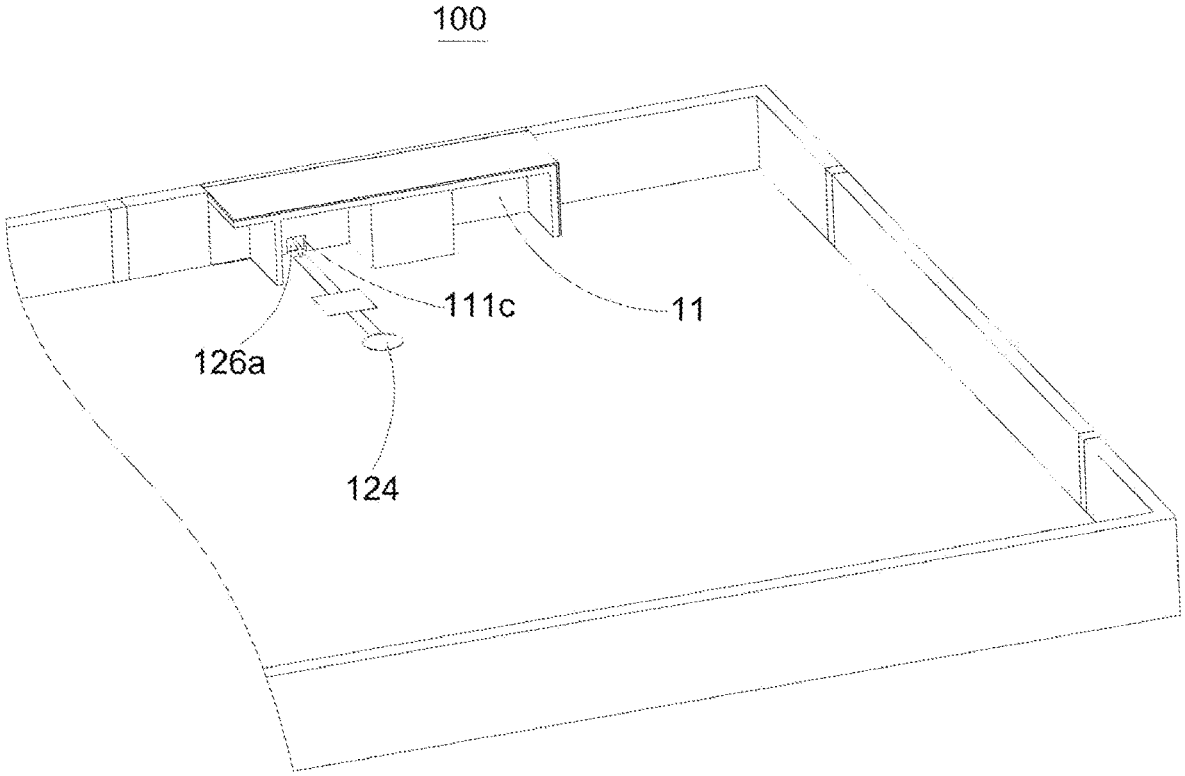
FIG. 37 is a three-dimensional diagram of an antenna apparatus disclosed in Embodiment XIV of the present disclosure.

As shown in FIG. 37, the solution of the antenna apparatus 100 in this embodiment combines Embodiment XIII and Embodiment XII. Parts, which are the same as those in Embodiment XII, of the solution of the antenna apparatus 100 in this embodiment are not repeatedly described, and descriptions of differences of the antenna apparatus 100 in this embodiment will be emphasized. A difference between Embodiment XIV and Embodiment XII mainly lies in: the antenna stand 11 is provided with a third opening part 112*c*, and the shielding case 126*a* is electrically connected to the non-mm-wave antenna feed source assembly 124 via the third opening part 112*c*.

Embodiment XV

Figure 38:
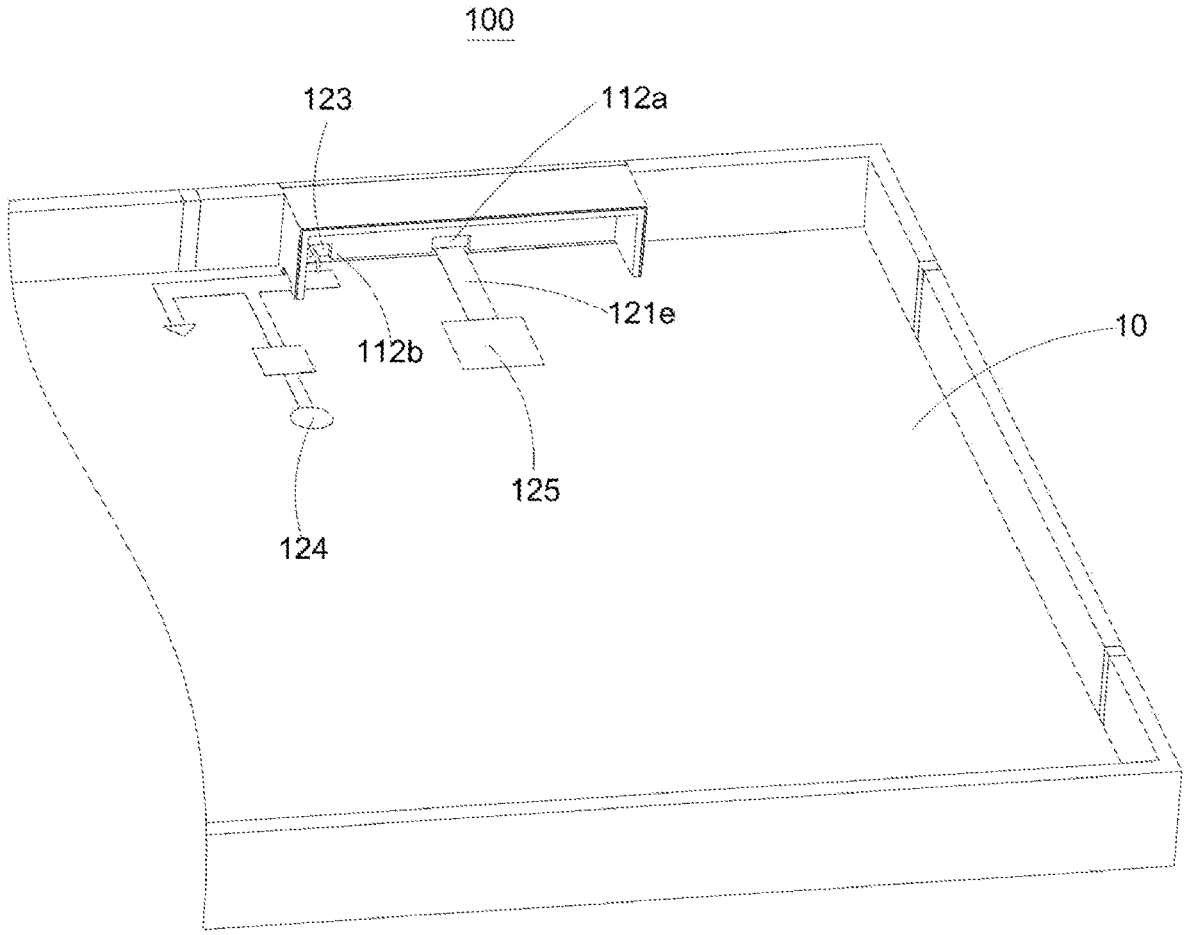
FIG. 38 is a three-dimensional diagram of an antenna apparatus disclosed in Embodiment XV of the present disclosure.

As shown in FIG. 38, parts, which are the same as those in the solution of Embodiment XIII, of the solution of the antenna apparatus 100 in this embodiment are not repeatedly described, and descriptions of differences of the antenna apparatus 100 in this embodiment will be emphasized. A difference between this embodiment and Embodiment XIII lies in: the antenna stand 11 is provided with at least two opening parts; the second sub-part 121*e* passes through the first opening part 112*a* and is electrically connected to the mm-wave RFIC 125; and the non-mm-wave antenna 123 is connected to the ground line of the circuit board 10 and the non-mm-wave antenna feed source assembly 124 via the second opening part 112*b*.

Embodiment XVI

Figure 39:
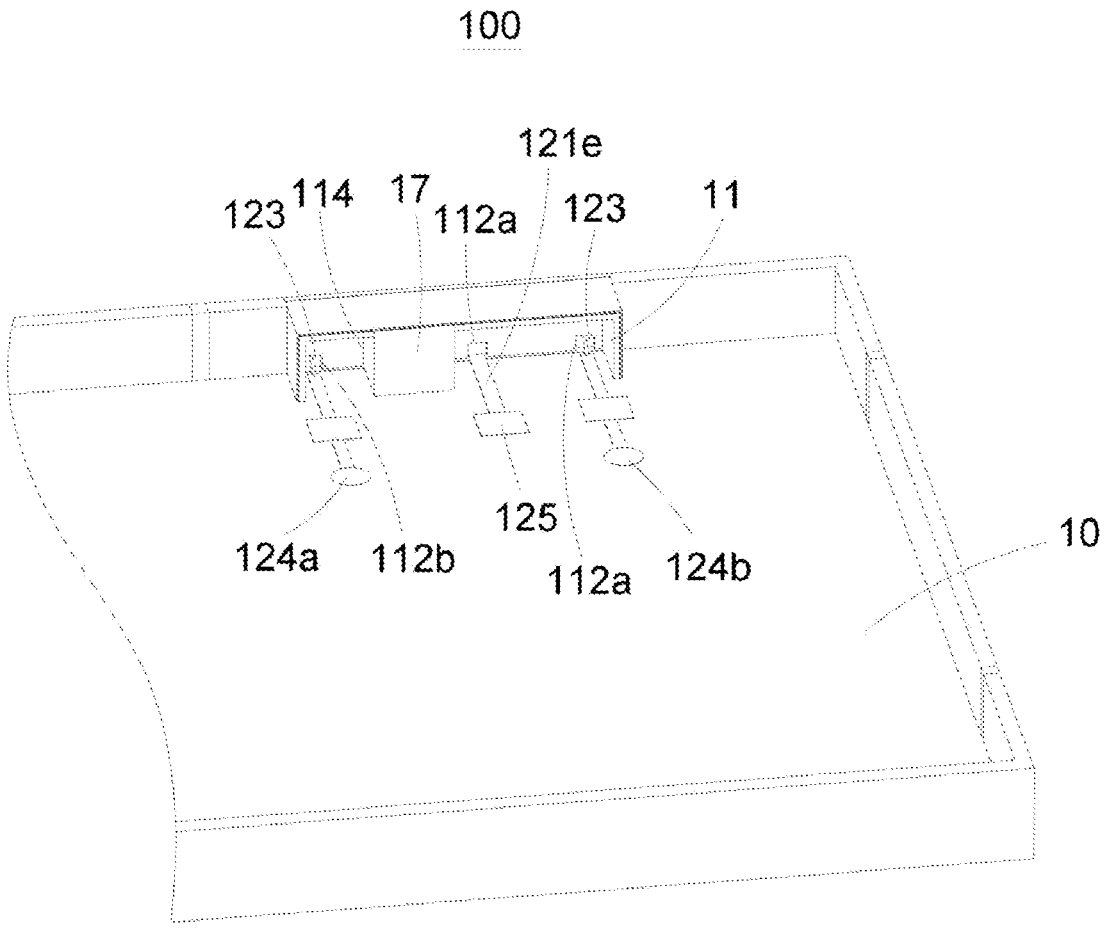
FIG. 39 is a three-dimensional diagram of an antenna apparatus disclosed in Embodiment XVI of the present disclosure.
Figure 40:
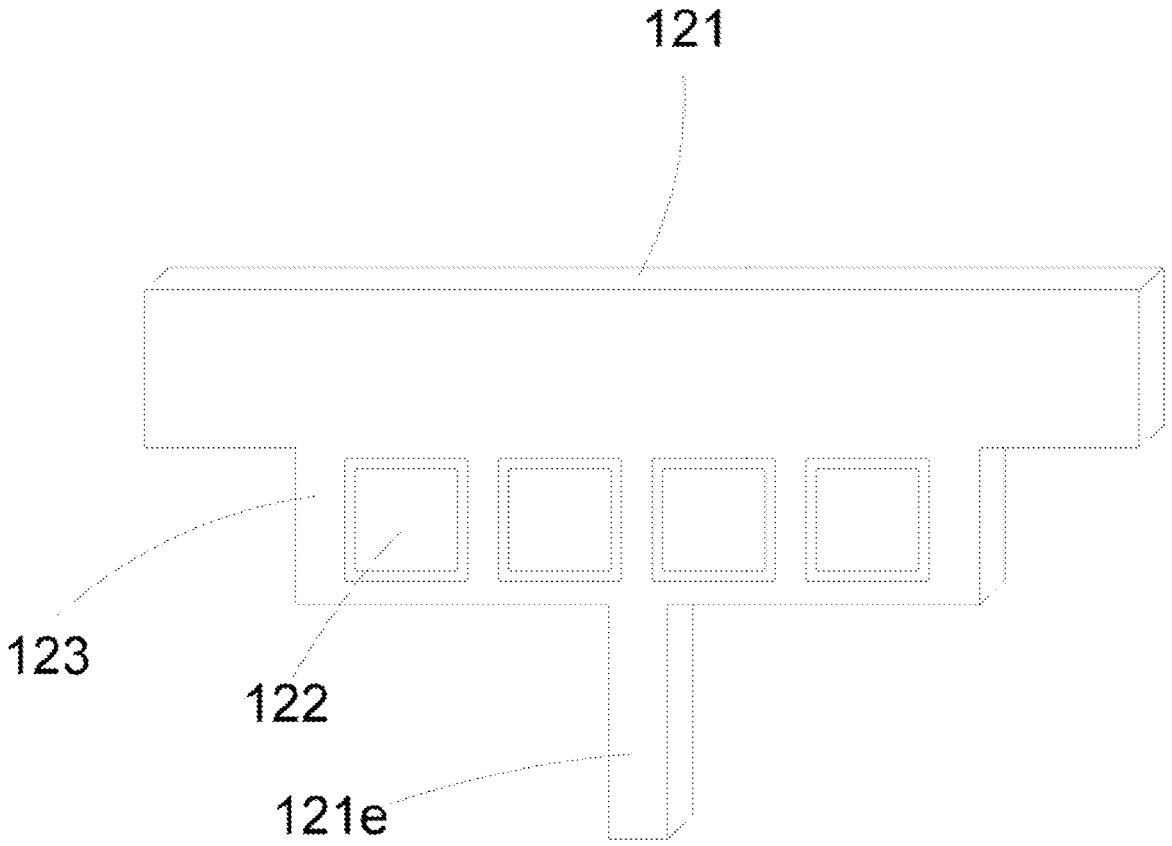
FIG. 40 is a three-dimensional diagram of an antenna structure of the antenna apparatus shown in FIG. 37.
Figure 41:
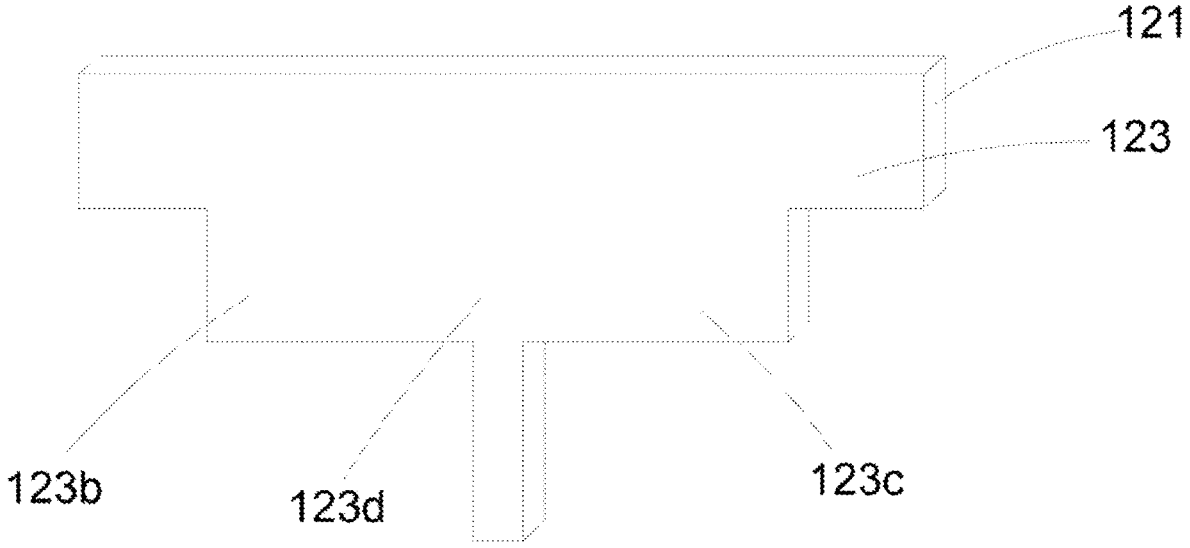
FIG. 41 is a three-dimensional diagram from another view of the antenna structure of the antenna apparatus shown in FIG. 37.

As shown in FIG. 39, FIG. 40, and FIG. 41, parts, which are the same as those in the solution of Embodiment XI, of the solution of the antenna apparatus 100 in this embodiment are not repeatedly described, and descriptions of differences of the antenna apparatus 100 in this embodiment will be emphasized. In Embodiment XVI, one part of the non-mm-wave antenna 123 is arranged on a surface of the flexible printed circuit hoard 121 close to the antenna stand 11, and the other part of the non-mm-wave antenna 123 is arranged on a surface of the flexible printed circuit board 121 far away from the antenna stand 11; the antenna stand 11 includes an opening 114 corresponding to the other part of the non-mm-wave antenna 123; the antenna apparatus 100 includes a third conductive member 17; the third conductive member 17 is arranged on the circuit board 10 and contacts the other part of the non-mm-wave antenna 123 through the opening 114, so as to ground the other part of the non-mm-wave antenna 123; the third conductive member 17 includes a third metal block; the other part of the non-mm-wave antenna 123 includes a second intermediate part 123*d*, a third antenna part 123*b*, and a fourth antenna part 123*c*; the third antenna part 123*b* and the fourth antenna part 123*c* are respectively connected to two ends of the second intermediate part 123*d*; and each of the third antenna part 123*b* and the fourth antenna part 123*c* is electrically connected to one non-mm-wave antenna feed source assembly 124 located on the circuit board 10. The antenna stand 11 is provided with a first opening part 112*a*, the second opening part 112*b*, and the third opening part 112*c*; the second sub-part 121*e* of the flexible printed circuit board 121 passes through the first opening part 112*a* and is electrically connected to the mm-wave RFIC 125; the third antenna part 123*b* passes through the second opening part 112*b* and is electrically connected to the first non-mm-wave antenna feed source assembly 124*a*; the fourth antenna part 123*c* passes through the third opening part 112*c* and is electrically connected to the second non-mm-wave antenna feed source assembly 124*b*, which can avoid the path loss increased by the flexible printed circuit board 121 bypassing the third metal block, so it is conductive to improving the wireless communication performance.

It can be understood that the third conductive member 17 can achieve the technical effects of isolation, supporting, electrical connection, heat dissipation, and the like. The third conductive member 17 includes a third metal block, so that the third conductive member 17 may further play an isolation role, and can also discharge heat to the outside while it is grounded, so as to reduce the temperature of the antenna apparatus 100 (the mm-wave RFIC) and maintain the stability of a wireless communication function, thus improving the product performance and the grip comfort of the user. The second intermediate part 123*d* is grounded through the third conductive member 17, achieving an isolation effect, so that each of two ends of the non-mm-wave antenna 123 formed by the antenna part 133 can be electrically connected to one non-mm-wave antenna feed source assembly 124, thus a radiation effect of two non-mm-wave antennas can be achieved at the same time, and even a MIMO effect can be achieved, without increasing the size of the antenna apparatus 100. Therefore, the user experience of the antenna apparatus 100 is relatively high, and the overall competitiveness of the product is relatively high.

Embodiment XVII

Figure 42:
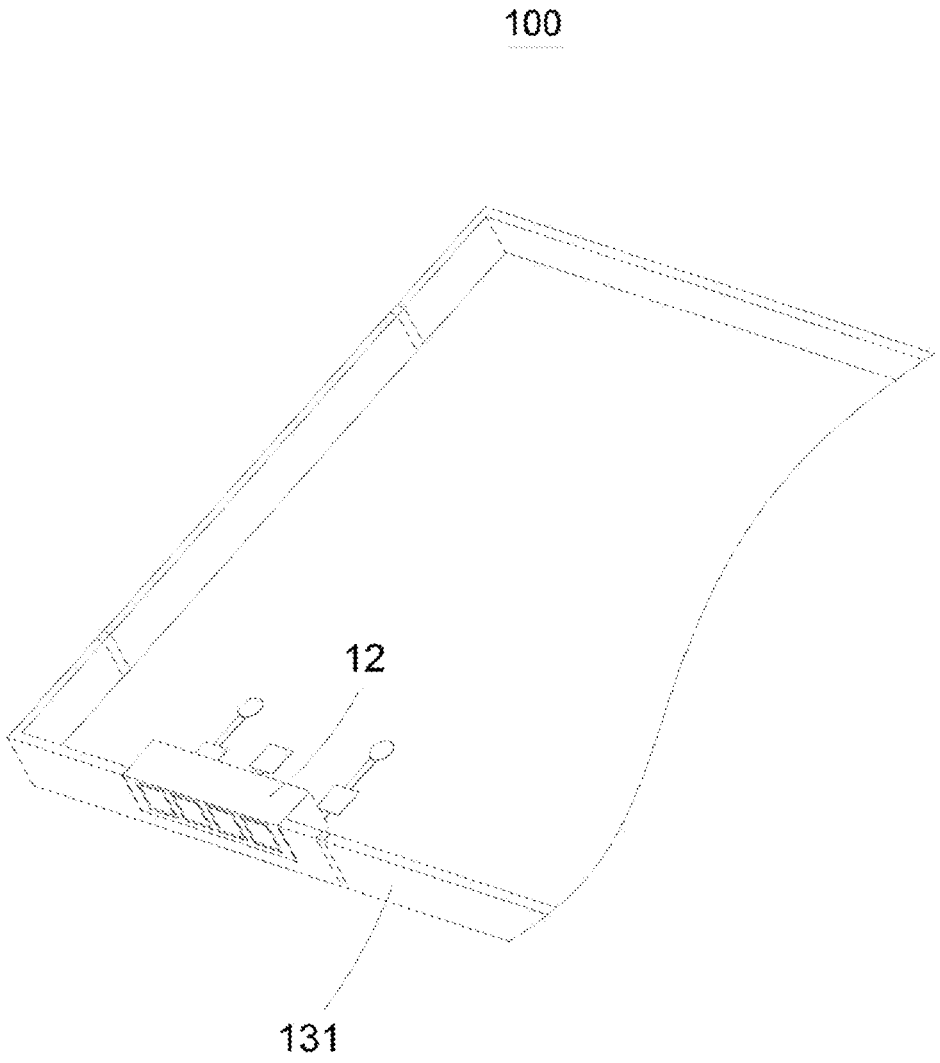
FIG. 42 is a three-dimensional diagram of an antenna apparatus disclosed in Embodiment XVII of the present disclosure.
Figure 43:
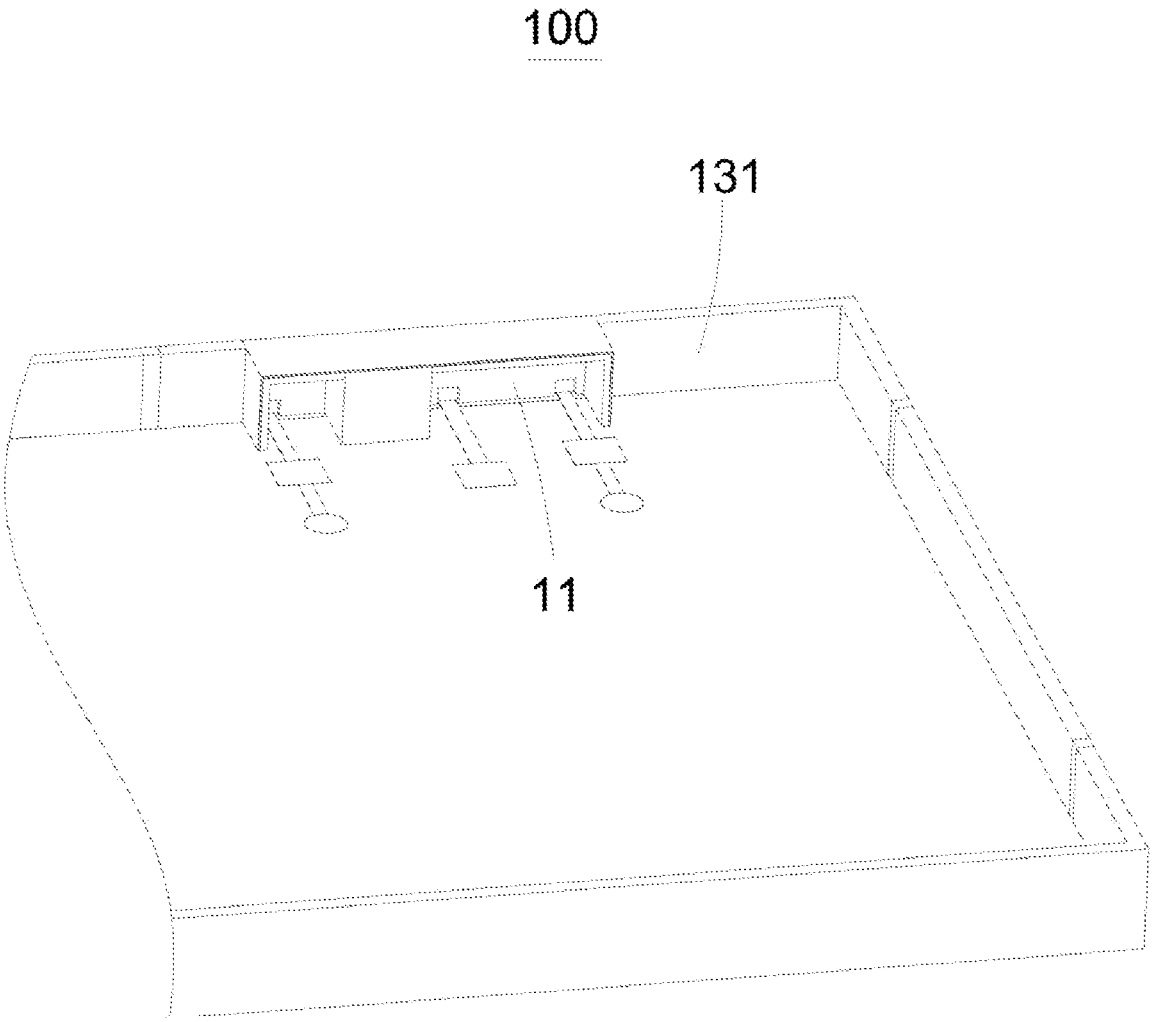
FIG. 43 is a three-dimensional diagram from another view of the antenna apparatus shown in FIG. 42.

As shown in FIG. 42 to FIG. 43, parts, which are the same as those in the solution of Embodiment XVI, of the solution of the antenna apparatus 100 in this embodiment are not repeatedly described, and descriptions of differences of the antenna apparatus 100 in this embodiment will be emphasized. A difference between Embodiment XVII and Embodiment XVI mainly lies in: compared to Embodiment XVI, Embodiment XVII may omit a decorative cover. At this time, the surface of the antenna structure 12 away from the antenna stand 11 may be flush with the outer surface of the side wall structure 131. The above design can reduce shield, which is conductive to improving the radiation performance of the antenna apparatus 100.

Embodiment XVIII

Figure 44:
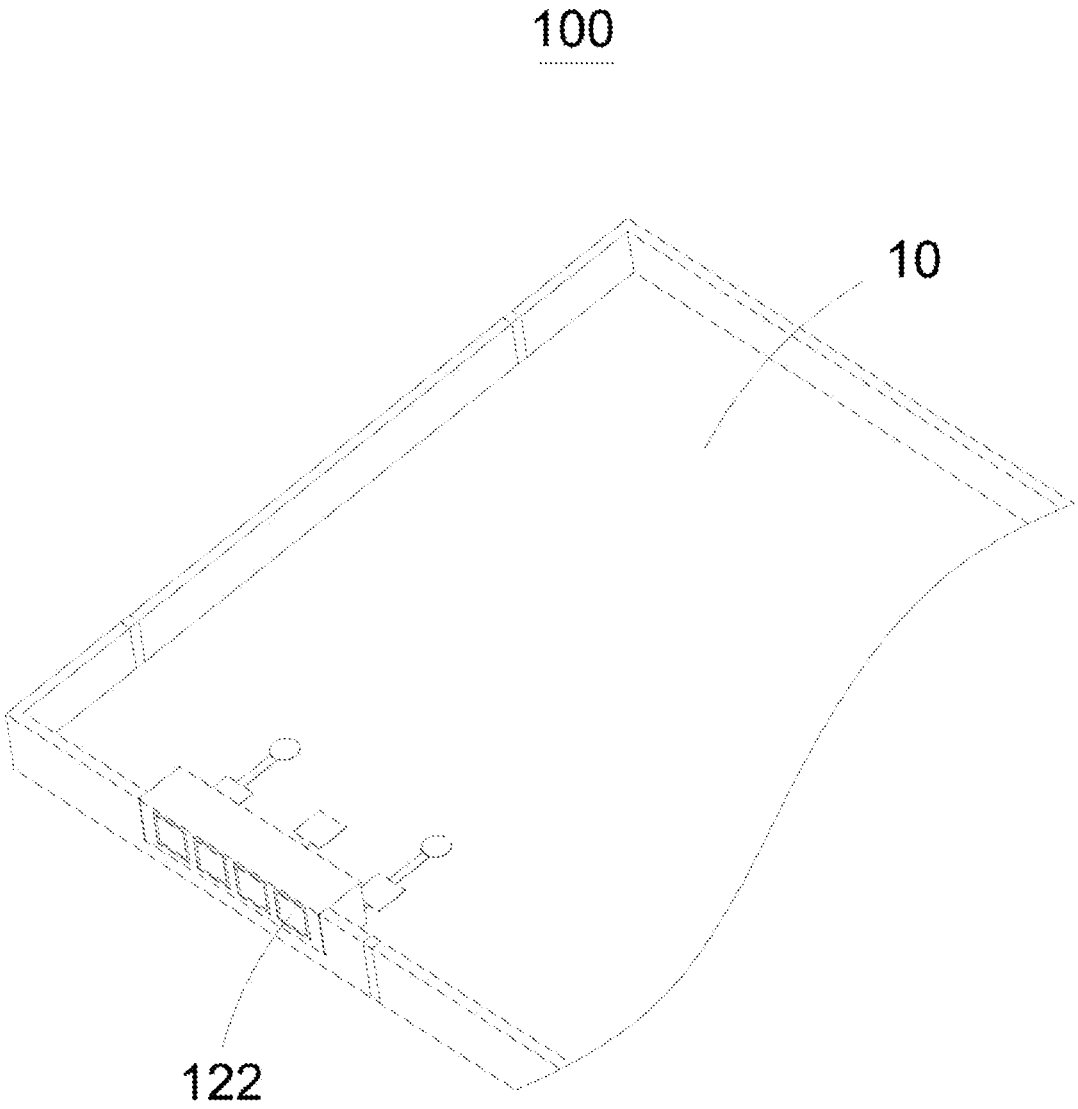
FIG. 44 is a three-dimensional diagram of an antenna apparatus disclosed in Embodiment XVIII of the present disclosure.
Figure 45:
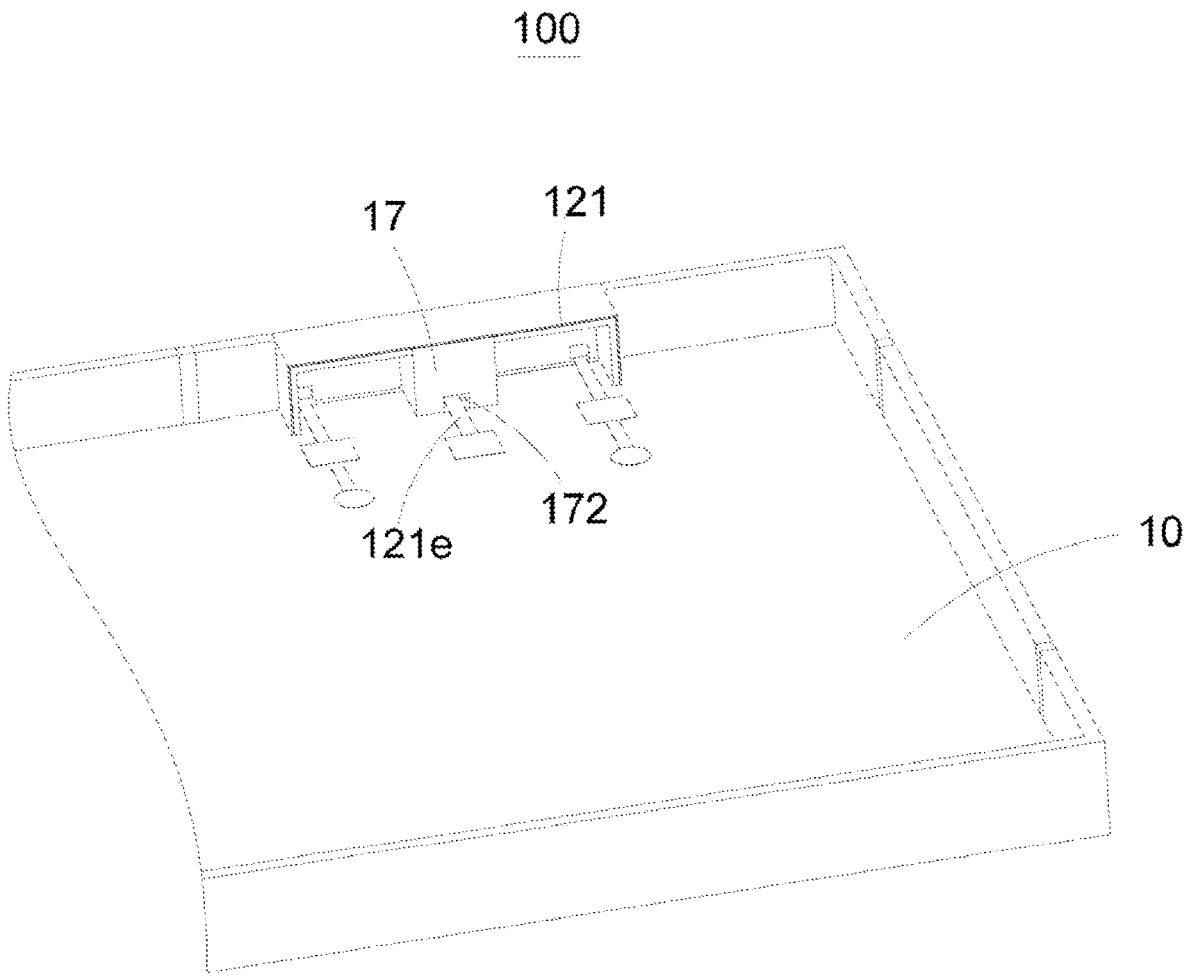
FIG. 45 is a three-dimensional diagram from another view of the antenna apparatus shown in FIG. 44.

As shown in FIG. 44 to FIG. 45, parts, which are the same as those in the solution of Embodiment XVII, of the solution of the antenna apparatus 100 in this embodiment are not repeatedly described, and descriptions of differences of the antenna apparatus 100 in this embodiment will be emphasized.

A difference between Embodiment XVIII and Embodiment XVII mainly lies in: the third metal block of the third conductive member 17 has a second gap part 172; the second sub-part 121*e* of the flexible printed circuit board 121 passes through the second gap part 172 and is superposed with the circuit board 10 and electrically connected to mm-wave RFIC 125. By the arrangement of the second gap part 172, the bending of the second sub-part 121*e* of the flexible printed circuit board 121 can be facilitated, which is thus conductive to improving the assembling flatness of the antenna structure 12 and maintain relatively symmetric feed-in of the mm-wave antenna 122, so as to reduce the complexity of design of the mm-wave antenna 122.

Embodiment XIX

Figure 46:
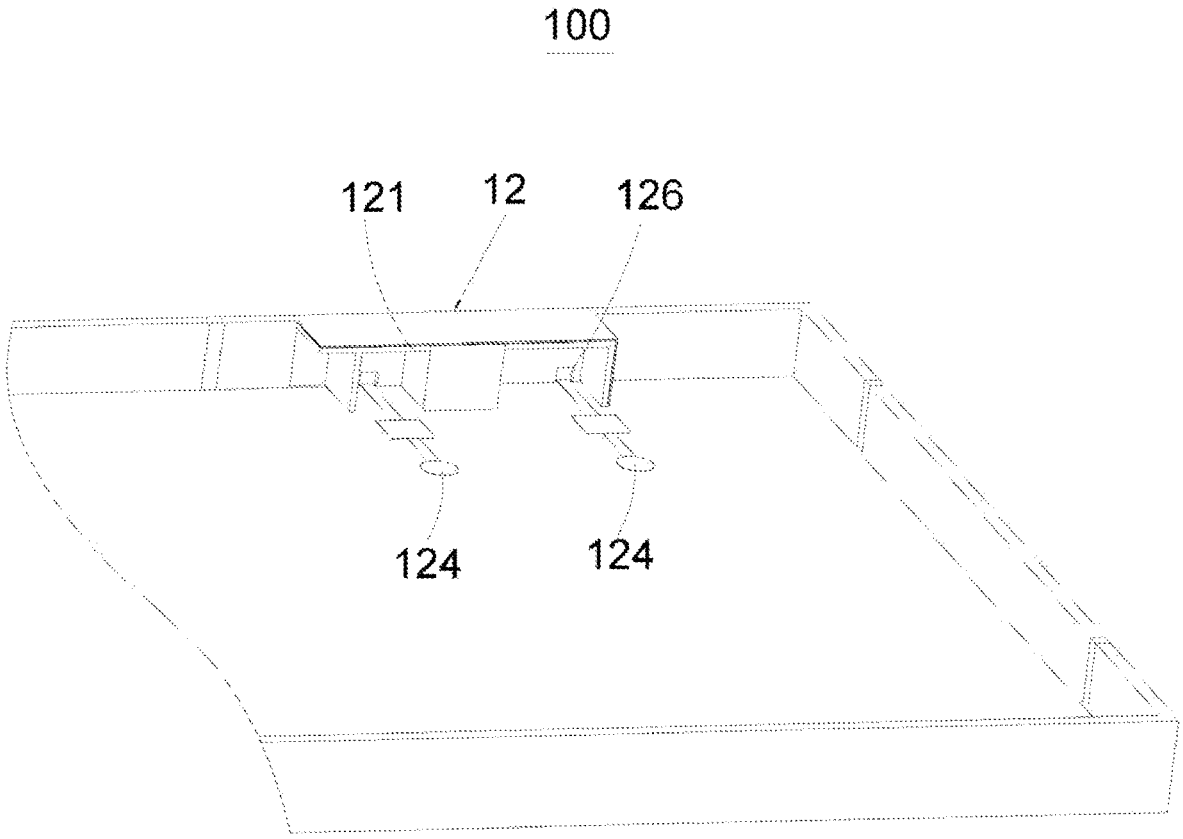
FIG. 46 is a three-dimensional diagram of an antenna apparatus disclosed in Embodiment XXI of the present disclosure.
Figure 47:
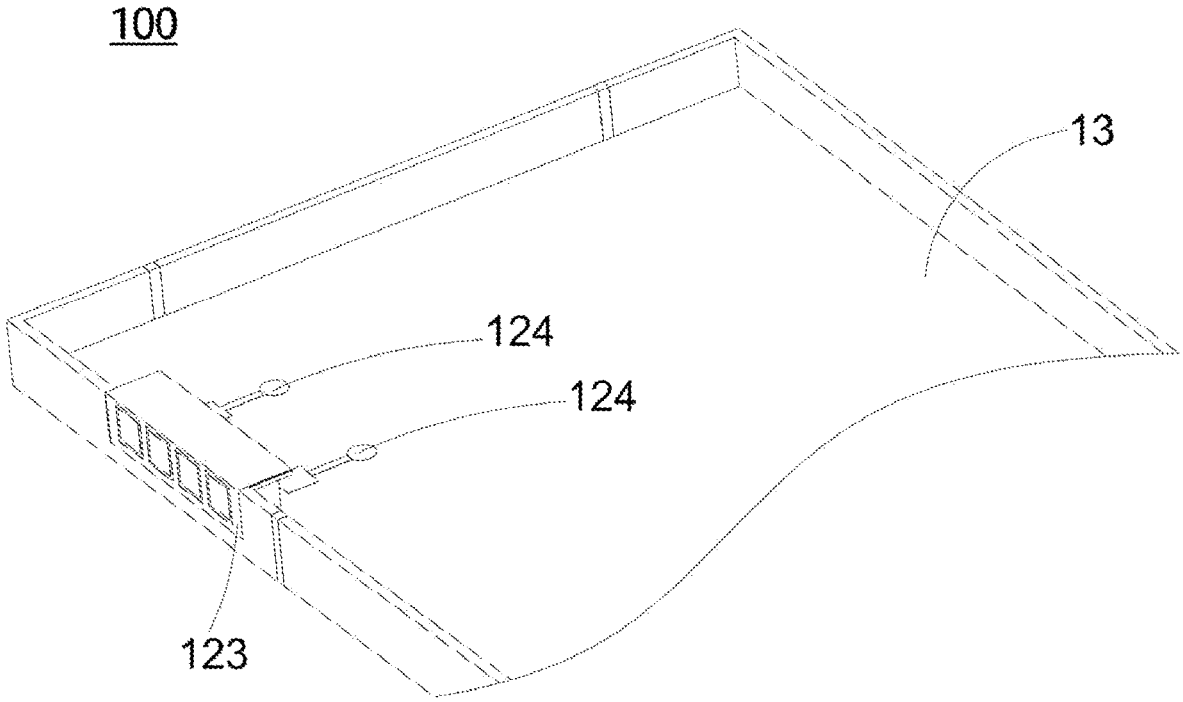
FIG. 47 is a three-dimensional diagram from another view of the antenna apparatus shown in FIG. 46.

As shown in FIG. 46 to FIG. 47, the solution of the antenna apparatus 100 in this embodiment combines Embodiment IV, Embodiment XII, and Embodiment XVII. Parts, which are the same as those in Embodiment XII, of the solution of the antenna apparatus 100 in this embodiment are not repeatedly described, and descriptions of differences of the antenna apparatus 100 in this embodiment will be emphasized. A difference between this embodiment and Embodiment XII mainly lies in: the antenna structure 12 further includes a mm-wave RFIC 125; the mm-wave RFIC 125 is arranged on the flexible circuit board 121 and is located between the flexible printed circuit board 121 and the antenna stand 11; and the mm-wave RFIC 125 is electrically connected to the non-mm-wave antenna 123. At this time, the non-mm-wave antenna feed source assembly 124 is fed to the mm-wave RFIC 125 to realize a function of two non-mm-wave antennas. In this embodiment, at least part of the two non-mm-wave antenna feed source assemblies 124 is located in the accommodating space encircled by the antenna stand 11 and the circuit board 10.

Embodiment XX

Figure 48:
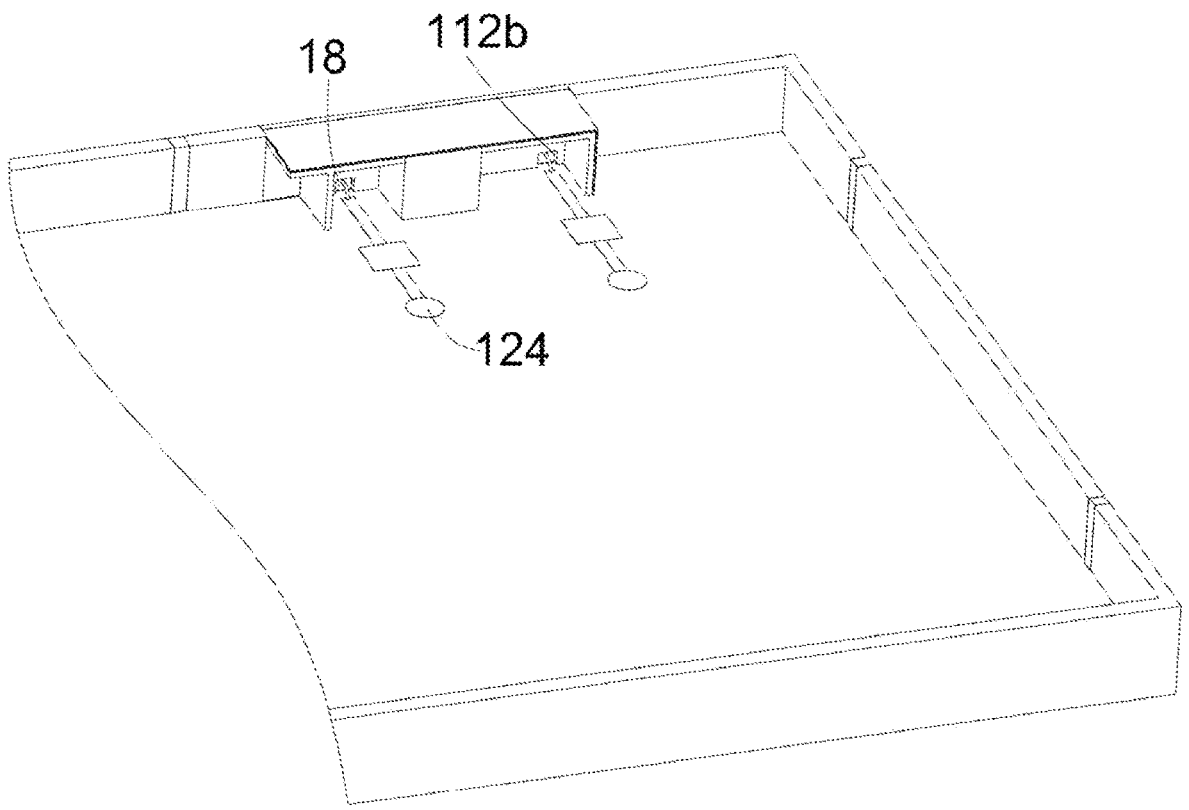
FIG. 48 is a three-dimensional diagram of an antenna apparatus disclosed in Embodiment XX of the present disclosure.
Figure 49:
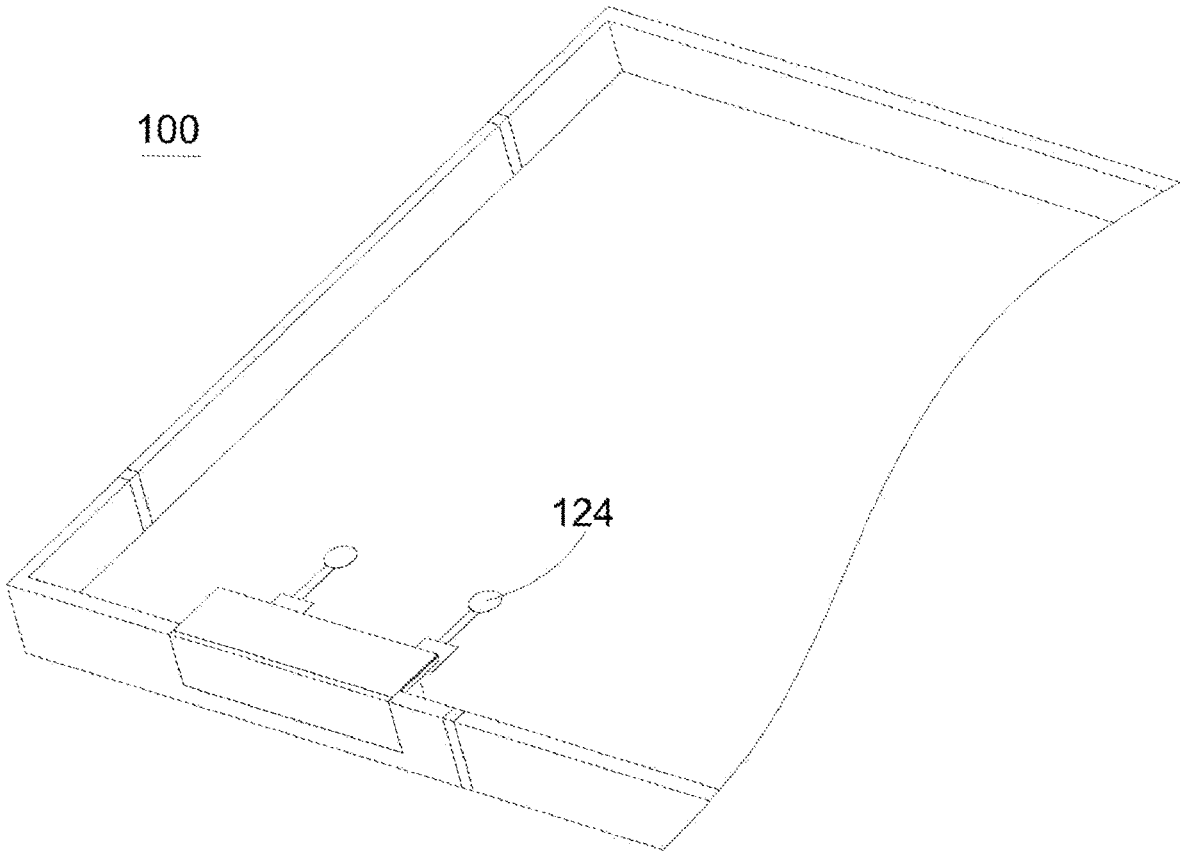
FIG. 49 is a three-dimensional diagram from another view of the antenna apparatus shown in FIG. 48.

As shown in FIG. 48 to FIG. 49, parts, which are the same as those in the solution of Embodiment XIX, of the solution of the antenna apparatus 100 in this embodiment are not repeatedly described, and descriptions of differences of the antenna apparatus 100 in this embodiment will be emphasized. In this embodiment, the first sub-part 121*d* may also be electrically connected to the non-mm-wave antenna feed source assembly 124 via the second opening part 112*b* through an electrical connection member 18 (such as in a manner of clip butting).

Embodiment XXI

Figure 50:
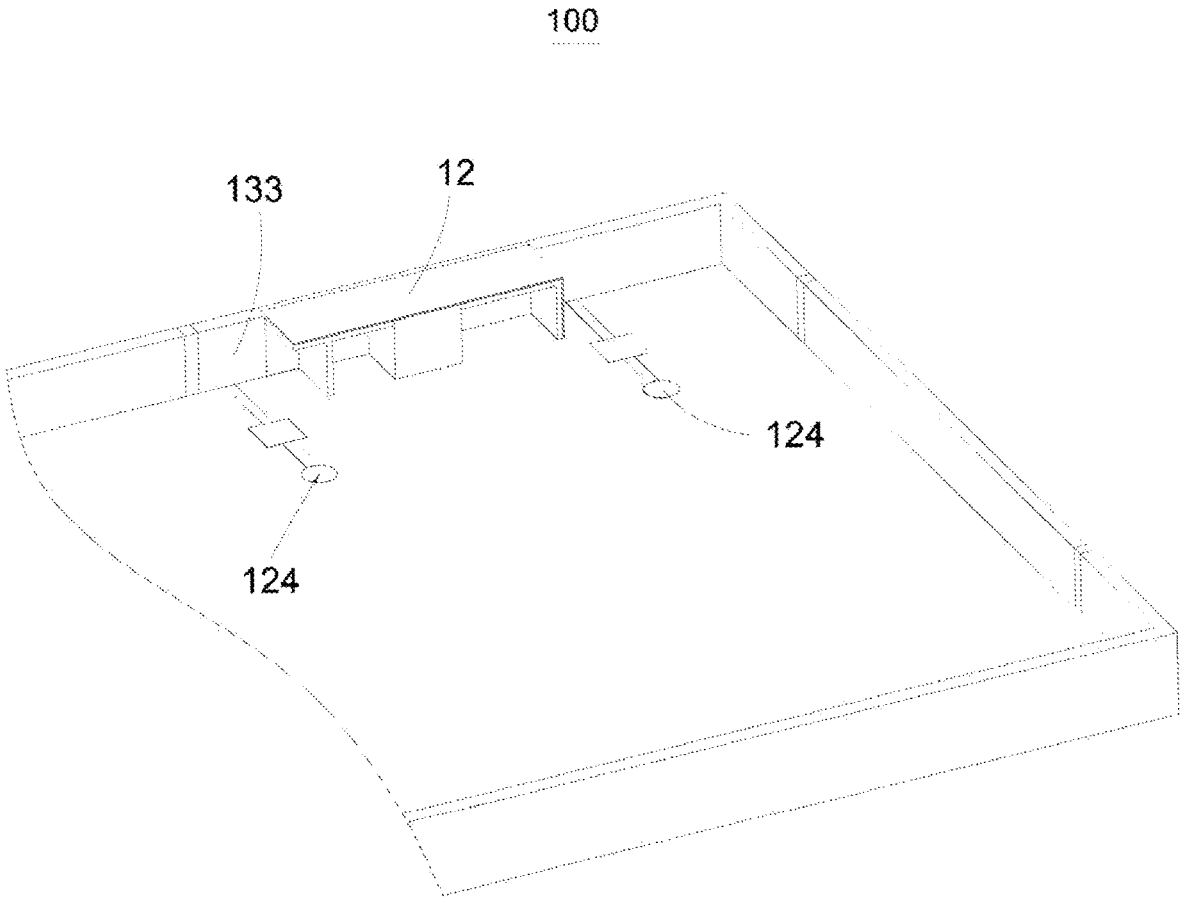
FIG. 50 is a three-dimensional diagram of an antenna apparatus disclosed in Embodiment XXI of the present disclosure.

As shown in FIG. 50, parts, which are the same as those in the solution of Embodiment XX, of the solution of the antenna apparatus 100 in this embodiment are not repeatedly described, and descriptions of differences of the antenna apparatus 100 in this embodiment will be emphasized. In this embodiment, the position of the non-mm-wave antenna feed source assembly 124 is different from that in Embodiment XX, and the two non-mm-wave antenna feed source assemblies 124 are electrically connected to two ends of the antenna part 133, respectively. The antenna part 133 contacts and is electrically connected with the non-mm-wave antenna of the antenna structure 12.

Figure 51:
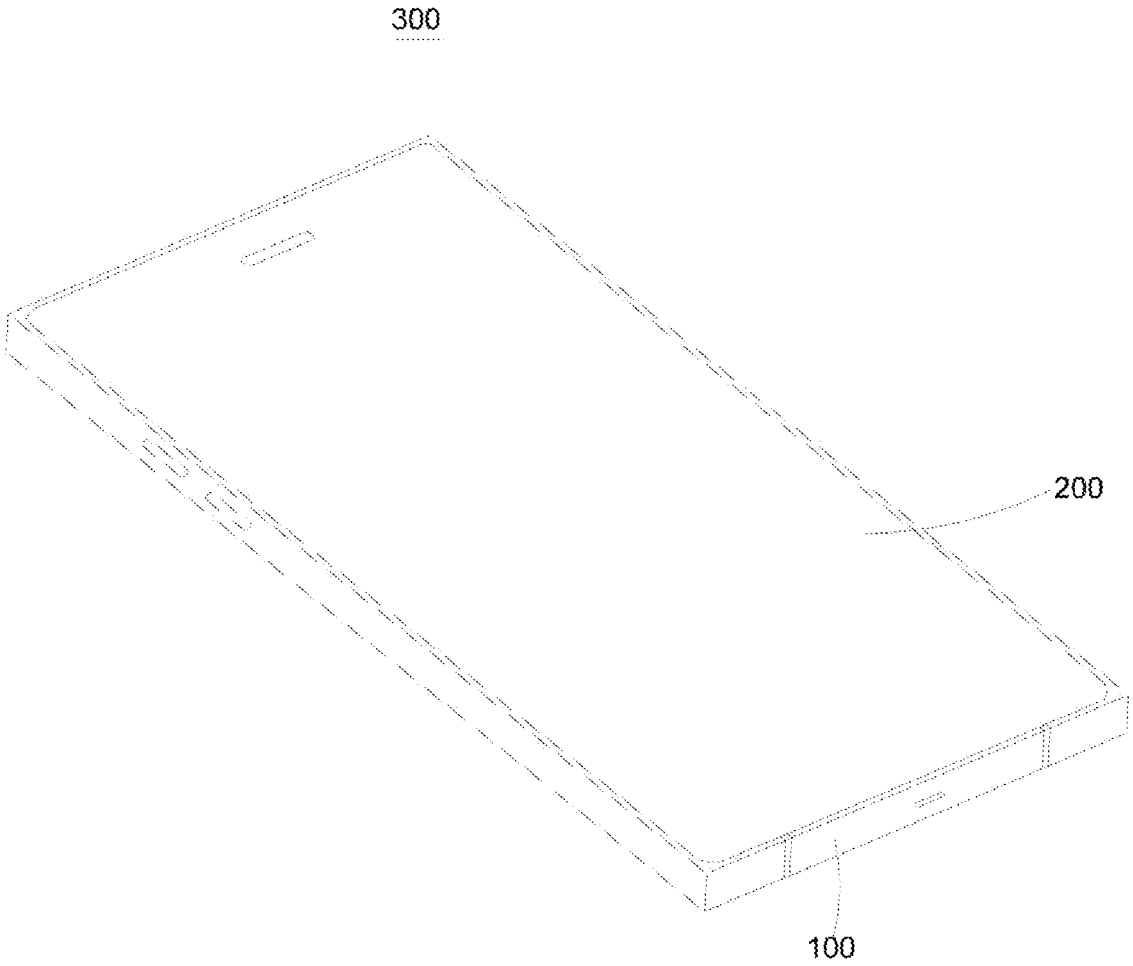
FIG. 51 is a three-dimensional diagram of an electronic device provided by the embodiments of the present disclosure.

As shown in FIG. 51, the present disclosure further discloses an electronic device 300. The electronic device 300 includes the antenna apparatus 100 of any one of the above embodiments, and a display screen 200. In addition, the electronic device 300 uses the antenna apparatus 100 in the foregoing embodiments, so that it also has other further features and advantages of the antenna apparatus 100, and descriptions thereof are omitted here.

The electronic devices disclosed in the embodiments of the present disclosure are described in detail above. Specific examples are used here to illustrate the principle and implementation mode of the present disclosure. The descriptions of the above embodiments are only used to help understand the electronic device and its key thoughts of the present disclosure. Moreover, for those of ordinary skill in the art, according to the ideas of the present disclosure, there will be changes in the specific implementation modes and the scope of application. In summary, the content of the present specification should not be construed as limiting the present disclosure.

What is claimed is:

1. An antenna apparatus, the antenna apparatus comprising:

a circuit board;

an antenna stand arranged on the circuit board;

an antenna structure arranged on the antenna stand, the antenna structure comprising a flexible printed circuit board, a millimeter wave (mm-wave) antenna arranged on the flexible printed circuit board, and a non-mm-wave antenna arranged on the flexible printed circuit board, wherein the antenna stand comprises a first supporting part and a second supporting part; the second supporting part is connected with the circuit board; the first supporting part is connected to a side of the second supporting part away from the circuit board and is opposite to the circuit board; the flexible printed circuit board comprises a first part and a second part connected to the first part; the first part is arranged on the first supporting part; and at least part of the second part is arranged on the second supporting part and is connected to the circuit board.

2. The antenna apparatus according to claim 1, wherein the antenna apparatus further comprises a housing which is arranged at a periphery of the circuit board; and at least part of the housing is electrically connected to the non-mm-wave antenna.

3. The antenna apparatus according to claim 2, wherein the housing comprises a side wall structure annularly arranged at the periphery of the circuit board; the side wall structure comprises a side wall part and an antenna part connected to the side wall part; the antenna part is electrically connected to the non-mm-wave antenna; the side wall part and the antenna part are connected in sequence along an annular arrangement direction; both the side wall part and the antenna part are metal conductive materials; break joints are respectively formed between two ends of the antenna part and the side wall part; insulating packing media are arranged in the break joints; the antenna part is grounded and/or the antenna part is also electrically connected to a non-mm-wave antenna feed source assembly; and the non-mm-wave antenna feed source assembly is arranged on the circuit board.

4. The antenna apparatus according to claim 3, wherein the non-mm-wave antenna directly contacts the antenna part, so as to be electrically connected to the antenna part, or a gap is reserved between the antenna stand and the antenna part; the non-mm-wave antenna is electrically connected to the antenna part through a transmission line on the circuit board; and the transmission line is also electrically connected to the non-mm-wave antenna feed source assembly.

5. The antenna apparatus according to claim 3, wherein the antenna part is grounded and is also electrically connected to the non-mm-wave antenna feed source assembly; a number of the non-mm-wave antenna feed source assemblies is at least two; and each of two ends of the antenna part is electrically connected to one non-mm-wave antenna feed source assembly.

6. The antenna apparatus according to claim 3, wherein the antenna part comprises a first intermediate part, a first antenna part connected between the intermediate part and the antenna structure, and a second antenna part connected to an end of the first intermediate part away from the first antenna part; the first intermediate part is provided with a second conductive member; the second antenna part is grounded or the first intermediate part is grounded through the second conductive member; the second conductive member comprises a second metal block; the second metal block is arranged on the circuit board and contacts the first intermediate part, so as to be electrically connected to the first intermediate part; a number of the non-mm-wave antenna feed source assemblies is at least two; and each of the first antenna part and the second antenna part is electrically connected to one non-mm-wave antenna feed source assembly.

7. The antenna apparatus according to claim 3, wherein the side wall structure comprises a gap penetrating through the side wall structure; at least part of the antenna structure is located in the gap; the antenna apparatus further comprises a decorative member; at least part of the mm-wave antenna and/or the non-mm-wave antenna corresponds to the gap; the decorative member is located in the gap and covers at least part of the mm-wave antenna and/or the non-mm-wave antenna; or, the housing has a groove on an inner side; at least part of the antenna structure is located in the groove; and at least part of the mm-wave antenna and the non-mm-wave antenna corresponds to the groove.

8. The antenna apparatus according to claim 1, wherein the first supporting part, the second supporting part, and the circuit board are further encircled to form an accommodating space; the non-mm-wave antenna is electrically connected to a mm-wave antenna feed source assembly; the non-mm-wave antenna feed source assembly is arranged on the circuit board; the antenna stand further comprises a third supporting part; the third supporting part is connected to the first supporting part, the second supporting part, and the circuit board; the flexible printed circuit board comprises a third part; the third part is connected to the first part and the second part and is arranged on the third supporting part; and at least part of the non-mm-wave antenna is arranged on the third part.

9. The antenna apparatus according to claim 8, wherein the second supporting part has an opening part; and at least part of the second part is electrically connected to the non-mm-wave antenna feed source assembly via an electrical connection member passing through the opening part.

10. The antenna apparatus according to claim 8, wherein the antenna structure comprises a first conductive line, and the first conductive line is at least arranged to the second part and electrically connected between the mm-wave antenna and the circuit board.

11. The antenna apparatus according to claim 10, wherein the second part comprises a first sub-part arranged on the second supporting part and at least one second sub-part connected to the first sub-part; the second sub-part and the first sub-part are in bending connection; the second sub-part is superposed with the circuit board and is connected with the circuit board; the circuit board is provided with a mm-wave RFIC; the at least one second sub-part is electrically connected with the mm-wave RFIC so that the mm-wave antenna is electrically connected to the mm-wave RFIC; and the at least one second sub-part is also electrically connected with the non-mm-wave antenna feed source assembly so that the non-mm-wave antenna is electrically connected to the non-mm-wave antenna feed source assembly.

12. The antenna apparatus according to claim 11, wherein an end of the first conductive line away from the mm-wave antenna and at least part of the non-mm-wave antenna are arranged on the same second sub-part, so as to be electrically connected to the circuit board, or a number of the at least one second sub-parts is two, an end of the first conductive line away from the mm-wave antenna and at least part of the non-mm-wave antenna are arranged on the two second sub-parts respectively, so as to be electrically connected to the circuit board; and the two second sub-parts are in bending connection to the same side of the first sub-part.

13. The antenna apparatus according to claim 11, wherein the second supporting part has an opening part; the second sub-part passes through the opening part; and an end of the second sub-part away from the first sub-part is electrically connected to the circuit board.

14. The antenna apparatus according to claim 1, wherein the antenna stand comprises an inner surface and an outer surface, and the antenna structure is arranged on the outer surface; the flexible printed circuit board comprises a first surface and a second surface located on a side opposite to the first surface; at least part of the mm-wave antenna is arranged on the first surface; at least part of the non-mm-wave antenna is arranged on the first surface; the non-mm-wave antenna comprises a plurality of opening regions; the mm-wave antenna comprises a plurality of mm-wave antenna units; the plurality of mm-wave antenna units are respectively arranged in the plurality of opening regions; the first surface is a surface away from one side of the outer surface, and the second surface is a surface close to one side of the outer surface.

15. The antenna apparatus according to claim 14, wherein one part of the non-mm-wave antenna is arranged on the first surface, and the other part of the non-mm-wave antenna is arranged on the second surface; the antenna stand comprises an opening corresponding to the other part of the non-mm-wave antenna; the antenna apparatus comprises a third conductive member; the third conductive member is arranged on the circuit board and contacts the other part of the non-mm-wave antenna through the opening, so as to ground the other part of the non-mm-wave antenna; the third conductive member comprises a third metal block; the other part of the non-mm-wave antenna comprises a second intermediate part, a third antenna part, and a fourth antenna part; the third antenna part and the fourth antenna part are respectively connected to two ends of the second intermediate part; and each of the third antenna part and the fourth antenna part is electrically connected to one non-mm-wave antenna feed source assembly located on the circuit board.

16. The antenna apparatus according to claim 15, wherein the third metal block has a gap part; and at least part of the flexible printed circuit board passes through the gap part and is superposed and electrically connected with the circuit board.

17. An electronic device, the electronic device comprising the antenna apparatus according to claim 1.

18. An antenna apparatus, the antenna apparatus comprising:

a circuit board;

an antenna stand arranged on the circuit board;

an antenna structure arranged on the antenna stand, the antenna structure comprising a flexible printed circuit board, a millimeter wave (mm-wave) antenna arranged on the flexible printed circuit board, and a non-mm-wave antenna arranged on the flexible printed circuit board, wherein the antenna structure further comprises a mm-wave radio-frequency integrated circuit (RFIC); the mm-wave RFIC is arranged on the flexible printed circuit board and is located between the flexible printed circuit board and the antenna stand; the mm-wave RFIC is electrically connected to the mm-wave antenna; the antenna structure further comprises a mm-wave antenna connector; the mm-wave antenna connector is arranged on the flexible printed circuit board and is electrically connected to the mm-wave RFIC; the mm-wave antenna connector and the mm-wave RFIC are spaced apart from each other; the antenna stand has a first gap part; and at least part of the mm-wave antenna connector is located in the first gap part and is used to be connected to another connector, wherein the antenna apparatus further comprises a first conductive member; the antenna stand has an opening; the antenna structure covers the opening; one end of the first conductive member is arranged on the circuit board, and the other end of the first conductive member passes through the opening and is connected to the mm-wave RFIC; the mm-wave RFIC comprises the mm-wave RFIC main body electrically connected to the mm-wave antenna and a shielding case arranged at a periphery of the mm-wave RFIC main body; the shielding case is electrically connected to the non-mm-wave antenna; the shielding case is further grounded via the first conductive member; and the first conductive member comprises a first metal block.

* * * * *